US012527384B2

(12) United States Patent
Fiedler et al.

(10) Patent No.: US 12,527,384 B2
(45) Date of Patent: Jan. 20, 2026

(54) MAGNETIC LOCKING DEVICE WITH HOLD-OPEN MECHANISM

(71) Applicant: Fidlock GmbH, Hannover (DE)

(72) Inventors: Joachim Fiedler, Hannover (DE); Lisa Rehbock, Hannover (DE); Philip Naftali, Hod Hasharon (IL); Izik Moalem, Yarkona (IL); Jan Breite, Hannover (DE); Bruno Winter, Hannover (DE)

(73) Assignee: Fidlock GmbH, Hannover (DE)

( * ) Notice: Subject to any disclaimer, the term of this patent is extended or adjusted under 35 U.S.C. 154(b) by 0 days.

(21) Appl. No.: 18/580,704

(22) PCT Filed: Sep. 20, 2023

(86) PCT No.: PCT/EP2023/075983

§ 371 (c)(1),
(2) Date: Jan. 19, 2024

(87) PCT Pub. No.: WO2024/061993

PCT Pub. Date: Mar. 28, 2024

(65) Prior Publication Data

US 2025/0082082 A1 Mar. 13, 2025

(30) Foreign Application Priority Data

Sep. 21, 2022 (DE) ..... 10 2022 124 310.9

(51) Int. Cl.
*A45C 13/10* (2006.01)
*A45F 3/00* (2006.01)
(Continued)

(52) U.S. Cl.
CPC ..... *A45C 13/1069* (2013.01); *A45F 3/005* (2013.01); *A45F 3/04* (2013.01);
(Continued)

(58) Field of Classification Search
CPC .. E05B 15/00; E05B 15/0073; E05B 47/0006; E05B 2047/0038; B65D 33/00;
(Continued)

(56) References Cited

U.S. PATENT DOCUMENTS 2,319,292 A * 5/1943 Henry ..... A41F 1/002 2/96
3,326,399 A * 6/1967 Ausnit ..... A41F 1/002 428/323

(Continued)

FOREIGN PATENT DOCUMENTS

CN 103237473 A 8/2013
CN 105559301 A 5/2016

(Continued)

OTHER PUBLICATIONS

Garza-Cervantes et al., "Synergistic Antimicrobial Effects of Silver/Transition-metal Combinatorial Treatments", Scientific Reports, 2017, 16 pages, vol. 7.

*Primary Examiner* — Nathan Cumar
(74) *Attorney, Agent, or Firm* — The Webb Law Firm

(57) ABSTRACT

Provided is a closure device for closing an opening having at least one first closure part and at least one second closure part interact, in a magnetically attracting manner, in such a way that the opening is closed in a closed position of the closure device, and for releasing the opening the first closure part and the second closure part are displaceable into an open position, counter to a magnetic force applied by the first and second closure parts.

The closure device includes at least one hold-open mechanism, via which the first and second closure parts are locked (Continued)

in the open position, and which counteracts a displacement of the first and second closure parts into the closed position, by means of a holding force.

19 Claims, 80 Drawing Sheets

(51) Int. Cl.
*A45F 3/04* (2006.01)
*B65D 33/00* (2006.01)
*B65D 33/24* (2006.01)

(52) U.S. Cl.
CPC ..... *B65D 33/007* (2013.01); *B65D 33/24* (2013.01); *B65D 2313/04* (2013.01)

(58) Field of Classification Search
CPC .. B65D 33/007; B65D 33/24; B65D 2313/04; A45C 13/00; A45C 13/1069; A45F 3/005; A45F 3/04
USPC ..... 292/251.5
See application file for complete search history.

(56) References Cited

U.S. PATENT DOCUMENTS 4,420,097 A * 12/1983 Motsenbocker ..... A45F 3/16 222/215
4,815,893 A * 3/1989 Feder ..... B63C 11/02 128/202.15
5,060,833 A * 10/1991 Edison ..... A45F 3/16 215/388
5,498,364 A * 3/1996 Speer ..... B32B 27/36 428/35.8
5,545,157 A * 8/1996 Van Iten ..... A61F 13/5616 604/385.04
5,682,653 A * 11/1997 Berglof ..... G09F 1/10 224/183
5,781,561 A * 7/1998 Machida ..... H04N 19/37 375/E7.091
5,816,709 A 10/1998 Demus
5,941,640 A * 8/1999 Thatcher ..... A45F 3/04 383/30
7,636,989 B2 * 12/2009 Plourde ..... B65D 33/007 24/585.12
8,479,685 B2 * 7/2013 Sprung ..... A01K 63/006 119/51.04
9,963,913 B2 * 5/2018 Howell ..... E05C 19/16
9,966,174 B2 5/2018 Naftali et al.
11,027,889 B1 * 6/2021 Western ..... B65D 33/1675
11,156,242 B2 * 10/2021 Meyran ..... A45F 5/021
11,174,090 B2 * 11/2021 Rogers ..... A45C 13/008
2002/0094140 A1 * 7/2002 Gill ..... B65D 33/1666 383/68
2003/0077007 A1 * 4/2003 Turvey ..... B65D 33/007 383/33
2004/0010891 A1 * 1/2004 Byers, Jr. ..... A45C 13/10 24/30.5 R
2004/0183313 A1 * 9/2004 Sherman ..... E05C 19/16 292/251.5
2005/0276523 A1 * 12/2005 Munch-Fals ..... B65D 33/007 383/33
2006/0006969 A1 * 1/2006 Cassar ..... B23Q 3/1546 335/306
2006/0068662 A1 * 3/2006 Hanrahan ..... A01N 31/16 442/124
2006/0222845 A1 * 10/2006 Deng ..... A01N 25/34 428/522
2009/0017086 A1 * 1/2009 Racquet ..... B32B 27/08 424/618
2009/0100651 A1 * 4/2009 Naftalin ..... A44B 18/0003 24/452
2010/0071415 A1 * 3/2010 Voss ..... C03C 11/007 65/22
2010/0122393 A1 * 5/2010 Light ..... A41D 13/0015 2/84
2010/0187139 A1 * 7/2010 Schmiedinghoefer .... C02F 1/30 206/216
2011/0188785 A1 * 8/2011 Turvey ..... B65D 33/2508 383/33
2012/0305437 A1 * 12/2012 Shah ..... A45C 11/00 206/524.6
2013/0061431 A1 3/2013 Naftali et al.
2013/0243354 A1 * 9/2013 Lytle ..... A45C 3/001 383/59
2014/0029875 A1 * 1/2014 Mallett ..... B65D 33/2566 383/42
2015/0052617 A1 * 2/2015 Zar ..... H04B 1/3888 726/27
2015/0216276 A1 * 8/2015 Stratton ..... A45C 13/1069 224/183
2017/0095048 A1 * 4/2017 Kohn ..... A45C 11/26
2017/0225842 A1 * 8/2017 Yeh ..... B65D 33/2508
2018/0109662 A1 * 4/2018 Scheer ..... A45C 13/002
2018/0140026 A1 * 5/2018 Nijmeh ..... A41D 15/04
2018/0215633 A1 * 8/2018 Laufer ..... C02F 1/30
2019/0152840 A1 * 5/2019 Ferner ..... C03C 12/00
2020/0055659 A1 * 2/2020 Hochberg ..... B65D 75/5805
2020/0075209 A1 * 3/2020 Naftali ..... H01F 7/0263
2020/0113317 A1 * 4/2020 Okumi ..... A45F 3/04
2023/0210236 A1 * 7/2023 Fiedler ..... A45F 3/166 292/251.5
2023/0380560 A1 * 11/2023 Naftali ..... A45C 13/1069
2023/0389680 A1 12/2023 Naftali et al.

FOREIGN PATENT DOCUMENTS

CN 206243726 U 6/2017
CN 208715849 U 4/2019
CN 211211789 U 8/2020
CN 218650593 U 3/2023
CN 219330934 U 7/2023
DE 20109821 U 9/2001
DE 102006026033 A1 12/2007
DE 202009001015 U1 5/2009
DE 102010060775 A1 5/2012
DE 102015112400 A1 2/2017
DE 102016003868 A1 10/2017
DE 102020206048 A1 11/2021
EP 2571391 B1 2/2019
GB 2442542 A 4/2008
GB 2522655 A 8/2015
GB 2527063 A 12/2015
IL 205846 A 8/2016
JP S4526601 Y1 10/1970
JP S4846010 U 6/1973
JP S5037627 U 4/1975
JP S61146982 A 7/1986
JP S6294552 A 5/1987
JP H642691 U 6/1994
JP H655654 U 8/1994
JP 3030902 U 11/1996
JP 2000238802 A 9/2000
JP 2004083063 A 3/2004
JP 3170193 U 9/2011
JP 201619570 A 2/2016
WO 2007088392 A1 8/2007
WO 2014123367 A1 8/2014
WO 2016151433 A1 9/2016
WO 2020028397 A1 2/2020
WO 2020036791 A1 2/2020
WO 2021161299 A1 8/2021
WO 2022200012 A1 9/2022

* cited by examiner (A-A)

(B)

(A-A)

(B)

(A-A)

(B)

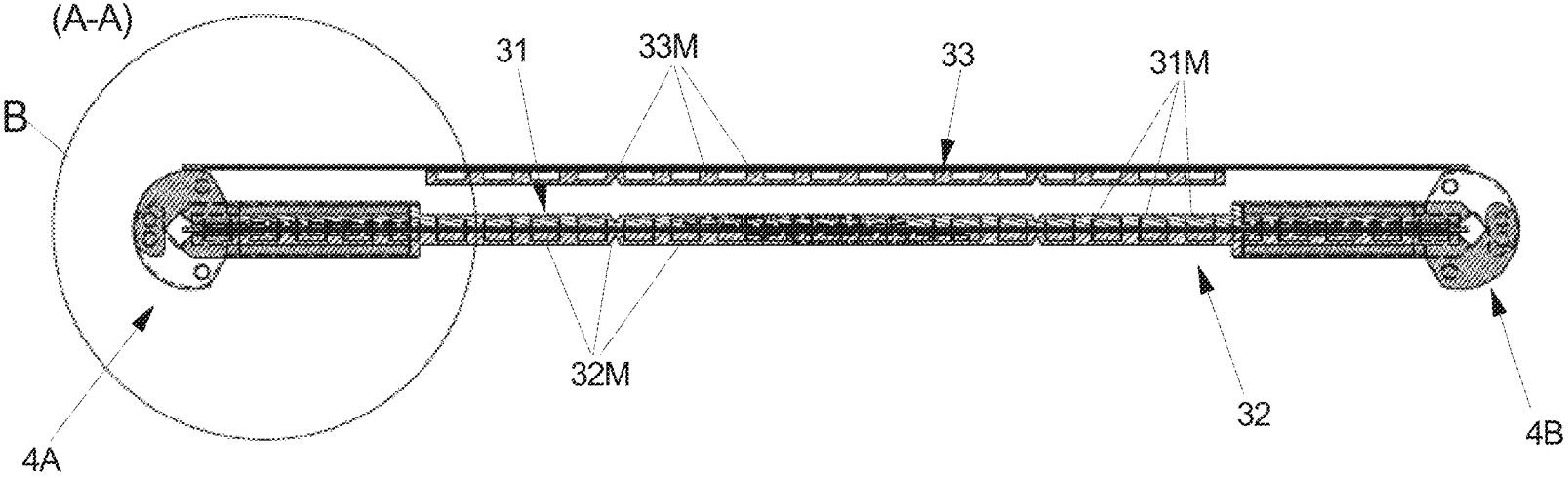
FIG 11A
(A-A)
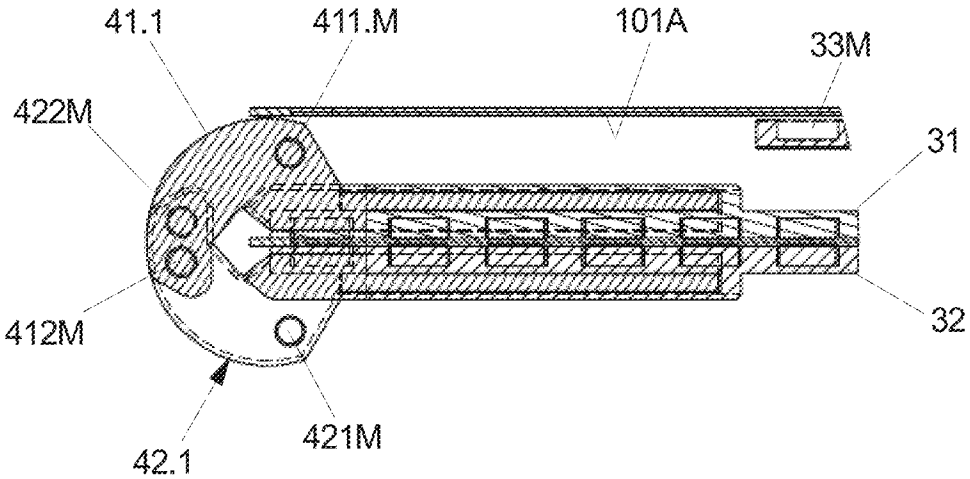
FG 11B
(B)

(A-A)

(B)

(A-A)

(B)

(A-A)

(B)

(A-A)

(B)

(A-A)

(B)

(A-A)

(B)

(A-A)

(B)

(A-A)

(B)

(A-A)

(B)

(A-A)

(B)

(A-A)

(B)

(A-A)

(B)

(A-A)

(B)

(A-A)

(B)

(A-A)

(B)

(A-A)

(B)

MAGNETIC LOCKING DEVICE WITH HOLD-OPEN MECHANISM

CROSS REFERENCE TO RELATED APPLICATIONS

This application is the United States national phase of International Patent Application No. PCT/EP2023/075983 filed Sep. 20, 2023, and claims priority to German Patent Application No. 10 2022 124 310.9, filed Sep. 21, 2022, the disclosures of which are hereby incorporated by reference in their entireties.

BACKGROUND OF THE INVENTION

Field of the Invention

The proposed solution relates to a closure device for closing an opening, which is formed between a first closing portion and a second closing portion.

Description of Related Art

In this case, the closing portions can be part of a storage device. Via the opening, which is closed by means of the closure device, a cavity in a hollow body of the storage device can then be closed. A storage device of this kind is provided for example for receiving an object, for example an electronic object such as a mobile telephone, a camera, a tablet or a laptop computer or the like, or also another object of daily life, for example a wallet or a payment means, such as a credit card, or documents, clothing and/or food. A storage device of this kind serves to receive objects and to protect them, in particular from moisture or dirt or also other external influences. This is intended to make it possible to carry the objects on one's person in difficult environments, for example during water sports, but also at work for example. In principle, a storage device can also be configured and provided for receiving a liquid, wherein then the liquid can be introduced into and/or removed from a hollow body via a closable opening.

A hollow body comprises a cavity, for example formed between a first wall and a second wall, in which cavity the object or liquid to be received in the storage device can be stored. The closure device is then provided for closing the hollow body, which closure device comprises at least one first closure part and at least one second closure part. In one variant, the first closure part comprises a first strip body extending along a transverse direction, and is arranged on a first closing portion of the first wall, and the second closure part comprises a second strip body extending along the transverse direction, and is arranged on a second closing portion of the second wall. The first closure part and the second closure part interact in a magnetically attracting manner in such a way that, in a closed position, in which the hollow body is closed, the first closing portion and the second closing portion rest on one another. A storage device of this kind is known for example from EP 2 571 391 B1.

Although a storage device known from EP 2 571391 B1 is very easy for a user to operate.

SUMMARY OF THE INVENTION

There is still essentially a need for storage devices that are improved in this respect, and/or improved closure devices.

A closure device with features as described herein provides a remedy here.

Thus, a closure device for closing an opening is proposed, wherein the closure device comprises at least one first closure part and at least one second closure part. The first closure part and the second closure part interact, in a magnetically attracting manner, in such a way that the opening is closed in a closed position of the closure device, for example in that the first and second closure parts rest directly against one another or first and second closing portions, on which the first and second closure parts are arranged. The first closure part and the second closure part are furthermore displaceable into an open position, counter to a magnetic force applied by the first and second closure parts, in order to release the opening. In addition, a proposed closure device comprises at least one hold-open mechanism, via which the first and second closure parts are locked in the open position, and which counteracts a displacement of the first and second closure parts into the closed position, by means of a holding (open) force.

A basic concept of the proposed solution is thus being able to hold a closure device in an open position via at least one hold-open mechanism, without a user having to apply a force to the closure device or its closure parts for this purpose, after the open position has been achieved. The closure parts consequently remain in the open position, without a user having to constantly engage on the closure parts. As a result, the introduction of an object and/or a liquid via the released opening can be facilitated, and the handling improved.

Locking of the open position via the hold-open mechanism is thus associated with the first and second closure parts remaining in an assumed open position, and being able to be transferred out of said open position again and into the closed position only when the holding force is overcome. Consequently, a holding force is applied by the locking, which holding force holds the first and second closure parts in the open position.

Furthermore, a magnetic attractive force of the first and second closure parts achieves an adjustment of the first and second closure parts into the closed position, and associated closing of the opening in a magnetic force-assisted manner, at least over a portion of a closing movement, after the holding force applied by the hold-open mechanism has been overcome. Under the action of the magnetic force, the closing portions are brought into contact, optionally into sealing contact, with one another again. Thus, both closing the opening and holding open the opening is facilitated for a user by means of a proposed closure device, and the operability of the closure device of a closure system formed therewith is improved.

In principle it is also possible, in the case of a proposed closure device, to preload the closure parts via at least one spring element and/or resilient closure parts, in the direction of the closed position. Automatic closing of the closure device is assisted hereby when the holding force of the hold-open mechanism has been overcome. In this case, a corresponding preload can act in particular in a first region of a closing path, to be bridged by the first and second closure parts, from the open position into the closed position, in that the magnetic force applied by the first and second closure parts is not yet sufficient to (alone) bring about an adjustment of the closure parts into the closed position.

An automatic adjustment of the closure parts in the direction of the closed position, or a corresponding closing force, can thus be provided by one or more spring elements, the magnetic attractive force of the first and second closure parts, and/or by a resilient design of the closure parts, such that after the holding force, applied by the at least one hold-open mechanism, has been overcome, an automatic adjustment of the first and second closure parts in the direction of the closed position takes place. Thus, an actuation force need be applied merely manually, for example, to the closure device, which force exceeds the holding force, in order to unlock the hold-open mechanism and trigger an automatic adjustment of the closure parts in the direction of the closed position.

Alternatively, in one variant it can be possible for a restoring force in the direction of the open position to be applied by the hold-open mechanism, at least over a limited part of the closing path, in the direction of the closed position, in order to also hold open the closure device and/or to transfer it back into the open position, if an actuating force is applied to the hold-open mechanism that exceeds the holding force only briefly and/or in an amount that disproportionately exceeds a threshold value. A corresponding actuating force then consequently has to be applied for example by a user over a longer time period and/or in an amount that disproportionately exceeds a threshold value, in order to adjust the closure parts in the direction of the closed position already beyond a defined amount and thus over a predefined part of the (overall) closing path, in order to prevent an automatic return of the closure parts into the open position from taking place.

In principle, the closure parts can be provided for arrangement on first and second closing portions, such that the closure parts can act on the closing portions. In this case, the opening can be formed between the first and second closing portions. Consequently, the closing portions are separated from one another in the open position. In the closed position, in order to close the opening, the first and second closure parts can rest against one another or first and second closing portions, on which the first and second closure parts are arranged, in particular integrated therein. In the latter case, the closure parts that interact in a magnetically attracting manner can thus magnetically hold the closing portions in contact with one another, in the closed position, when the first and second closure parts are in their closed position.

In order to provide a magnetic interplay, the first closure part and/or the second closure part can in each case be formed from a magnetic material, for example in that the closure parts are formed from a plastics material, in particular a polymer material, or a silicon material, to which a magnetic material, in the form of magnetic particles, is mixed. Alternatively, the closure parts can each receive a magnet arrangement of discrete magnetic elements, such that the closure parts interact in a magnetically attracting manner by interplay of the magnet arrangements. It is conceivable for each closure part to act in a permanently magnetic manner, for example in that a closure part is formed having permanently magnetic particles and is thus produced from a permanently magnetic material, or in that the magnet arrangements of the closure parts are in each case formed of an arrangement of permanent magnets. It is alternatively also possible, however, for one closure part to be permanently magnetic, at least in one portion, and for the other closure part to act as a ferromagnetic armature, in at least one portion. For example, a ferromagnetically acting closure part comprises a body which consists of a ferromagnetic material (for example a plastics material into which ferromagnetic particles are mixed), or comprises discrete ferromagnetic elements. In principle, the proposed solution in particular includes the situation where at least one pair composed of magnet element and armature, or a plurality of magnet elements and armatures in alternation, is provided in one closure part, and one or more offset matching pairings of armatures and magnet elements are provided in the other closure part.

If one closure part comprises a magnet arrangement of discrete magnetic elements, then the discrete magnetic elements can be lined up against one another, for example in a linear manner along a transverse axis, wherein the discrete magnetic elements can be spaced apart from one another at regular intervals along the transverse axis, for example. It is also conceivable and possible, however, to arrange the discrete magnetic elements in rows and columns on the basis of a two-dimensional matrix, so as to be diagonally offset relative to one another, and/or in different sizes and at different spacings from one another.

In principle it is preferred for the holding force is specified, via the hold-open mechanism, such that it can be overcome manually. A proposed closure device is thus configured and intended for manual operability, although this is of course not obligatory. For example it can be provided, in one embodiment, for the holding force to be specified via the hold-open mechanism such that it (initially) cannot be overcome manually, and for the hold-open mechanism to comprise a latching device which has to be initially unlocked, preferably manually, before the hold-open mechanism again allows an adjustment of the first and second closure parts into the closed position. Therefore, upon reaching the open position, not only is the open position locked, but rather also at the same time latching is provided, which applies the holding force that counteracts an adjustment. Thus, without releasing the latching provided by the latching device no adjustment of the first and second closure parts into the closed position can any longer be brought about, without the latching device being irreversibly destroyed, damaged or worn. Although a hold-open mechanism developed in this way thus requires for example an additional handle compared with a variant in which the holding force applied by the hold-open mechanism can be overcome by purely manual action of force on the first and second closure parts, and thus without additional separate displacement of a component of the hold-open mechanism, unintended adjustment into the closed position can be more reliably excluded in this way.

An additional latching device can for example provide form-fitting latching of two latching components, which are provided on two locking elements of the hold-open mechanism.

The holding force can be applied via at least a form-fitting connection, a force-fitting connection, and/or a magnetic force. The first and second closure parts can consequently be locked in the open position, via the hold-open mechanism, in a form-fitting, force-fitting and/or magnetic manner. In other words, the hold-open mechanism an act in a form-fitting, force-fitting and/or magnetic manner in order to apply the holding force and thereby to lock the first and second closure parts in the open position.

The hold-open mechanism can apply an opening force which at least assists with the first and second closure parts assuming the open position and/or with the locking of the first and second closure parts in the open position. Said opening force can be higher in the open position of the first and second closure parts than in the closed position, in particular can be at a maximum, in order to assist with achieving and securing the open position. For the closed position, the hold-open mechanism is then configured, in a variant, in such a way that the opening force of the first and second closure parts is lower than in the open position, in particular is at a minimum. In contrast, in the closed position a closing force applied by the first and second closure parts can be higher, in particular can be at a maximum, which force assists with a displacement of the first and second closure parts in the direction of the closed position. Said closing force is in turn lower, in particular at a minimum, in the open position.

In a variant, the hold-open mechanism comprises at least one first locking element and at least one second locking element, wherein the first and second locking elements interact with one another in the open position in order to lock the first and second closure parts in the open position. In this case, the first and second locking elements can interact magnetically, in a form-fitting manner, and/or in a frictionally engaged manner, in order to achieve locking of the closure parts in the open position.

For example, for locking the first and second closure parts in the open position, the first and second locking elements are adjusted relative to one another from a rest position, bridging a predefined adjustment path, into a locking position. This in particular includes the situation where the first and second locking elements are also adjusted along with a displacement of the first and second closure parts out of the closed position into the open position, and specifically out of the rest position and into their locking position. However, this furthermore also includes the situation where an adjustment of the locking elements out of a rest position and into the locking position leads to an adjustment of the closure parts out of the closed position and into the open position. The situation in which at least one of the first and second locking elements is provided on, in particular formed on, one of the first or second closure parts is also included.

As already stated above, the first and second locking elements can interact with one another, for example in a magnetically attracting manner, in order to lock the first and second closure parts in the open position. For example, in this connection, the first and second locking elements interact with one another in a magnetically attracting manner in such a way that the first and second locking elements are transferred automatically into the locking position, under action of a magnetic force. In this case, the automatic transfer can depend on the first and second locking elements having been adjusted, relative to one another, out of their rest position, by at least a defined amount of the predefined adjustment path, in the direction of the locking position. In a variant, for example a (further) adjustment of the locking elements into the locking position is brought about in a manner caused by magnetic force, when the first and second locking elements have been adjusted, relative to one another, out of their rest position, by at least half the adjustment path, in particular by at least two-thirds of their adjustment path, in the direction of the locking position. The first and second locking elements are consequently configured and dimensioned in such a way, in particular with respect to a position and size of magnet elements provided on or in the locking elements, that the locking elements are automatically adjusted into the locking position that locks the closure parts, when the closure device has been opened beyond a defined amount.

In a variant, it can alternatively or additionally be provided that a magnetic force applied by the first and second locking elements, which assists with a displacement of the first and second locking elements in the direction of the locking position, is higher in the open position of the first and second closure parts than in the closed position, in particular is at a maximum, and is lower in the closed position of the first and second closure parts than in the open position, in particular is at a minimum, while a magnetic force applied by the first and second closure parts, which force assists with a displacement of the first and second closure parts in the direction of the closed position, is higher in the closed position, in particular at a maximum, and lower in the open position, in particular at a minimum. Force curves of corresponding (magnetic) closing and hold-open forces are thus opposing in a variant of this kind, such that, from a user perspective, both the opening and the closing of the closure device is perceived as comfortable, and both the holding of the closure parts in the open position and in the closed position takes place with sufficiently high force.

For example, for locking the first and second closure parts in the open position, the first and second locking elements each comprise at least one magnet element. The magnet elements of the locking elements then interact with one another in order to hold the locking elements in the locking position. Yet a further magnet element can be provided on at least one of the first and second locking elements. Said further magnet element can be polarized opposingly to a magnet element of the other locking element, such that magnet elements of the first and second locking elements repel one another in the rest position, and thus (initially) counteract a displacement of the first and second locking elements in the direction of the locking position, until a minimum adjustment path of the first and second locking elements relative to one another has been bridged. One or more additional magnet elements of the first and second locking elements can thus assist with the locking elements assuming the rest position, during closure of the closure device.

Alternatively or in addition, the first and second locking elements can be coupled to the first and second closure parts, in particular fixed or shaped thereon, such that the first and second locking elements are transferred into the locking position when the first and second closure parts are displaced out of the closed position and into the open position, in which locking position the first and second locking elements interact with one another in order to lock the first and second closure parts in the open position. For example, in this case the first and second locking elements are in each case pivotable about a pivot or hinge axis, into the locking position, with displacement of the first and second closure parts into the open position. In this case, it can be possible for an adjustment force for displacing the first and second closure parts to be applied (manually) for example to the closure parts and/or to the locking elements.

In a variant, the first locking element comprises at least one first magnet element, and the second locking element comprises at least one second magnet element. The first and second magnet elements can be displaceable towards one another or beyond one another, at least in part, with displacement of the first and second locking elements into the locking position. The first and second locking elements having the first and second magnet elements provided thereon are consequently configured and arranged on the closure device in such a way that the displacement of the first and second locking elements out of their rest position and into the locking position is associated with a displacement movement of the first and second magnet elements towards one another or beyond one another, at least in part, in order to move the first and second magnet elements towards one another and to hold the locking elements in their locking position via the applied magnetic force or the applied magnetic forces.

In a first variant, in which the first and second magnet elements are displaceable towards one another with displacement of the first and second locking elements into the locking position, the first and second magnet elements then for example attract one another with a magnetic force which, in the locking position, acts substantially, in particular exactly, in parallel with a closing axis along which the first closure part and the second closure part are displaceable towards one another, after the holding force has been overcome, out of the open position and into the closed position, and/or which force, in the locking position, acts substantially, in particular exactly, perpendicularly to a hinge axis, about which a locking element is displaceable out of the rest position and into the locking position. In the latter case, a force vector of the magnetic force can thus be in a normal plane with respect to the hinge axis, and can for example also extend at an angle different from 90° with respect to a closing axis.

In an alternative variant, in which the first and second magnet elements are displaceable beyond one another, at least in part, with displacement of the first and second locking elements into the locking position, the first and second magnet elements attract one another with a magnetic force which, in the locking position, acts substantially, in particular exactly, perpendicularly to a closing axis along which the first closure part and the second closure part are displaceable towards one another, after the holding force has been overcome, out of the open position and into the closed position, and/or which force, in the locking position, acts substantially, in particular exactly, in parallel with a hinge axis, about which a locking element is displaceable out of the rest position and into the locking position. In the latter case, a force vector of the magnetic force can thus be in a plane in which the hinge axis also extends.

Alternatively or in addition to a magnetically assisted locking of the first and second locking elements, it can be provided that the first and second locking elements of the hold-open mechanism are interconnected in a form-fitting manner, in the open position of the first and second closure parts, in order to lock the first and second closure parts in the open position. This for example includes a variant in which the first and second locking elements are latched together, in the open position of the first and second closure parts, for example in that at least one latching element provided on one of the locking elements engages in a latching opening or another latching element which is provided on the other locking element. In the case of latching elements engaging in one another, for example latching lugs of the locking elements can latch together. A resilient or resiliently mounted latching element, for example in the form of a latching lug, can thus latch or snap into a latching opening, or latch to a further latching lug, when the first and second locking elements have assumed their locking position, in order to mechanically secure the locking position assumed. In this case, a latching opening can be configured for example as a recess or groove on a locking element. In particular, in the present case a form-fitting connection for locking in the locking position is intended to include mechanical latching with the aid of a ball latch or a spring preloaded adjusting cam.

In a variant, the first closure part and the second closure part are displaceable towards one another, out of the open position and into the closed position, after a holding force applied by the hold-open mechanism has been overcome. The first and second locking elements can in turn be provided for arrangement on first and second closing portions in such a way that the at least one first locking element protrudes beyond an edge, preferably lateral edge, of the first closing portion, and the at least one second locking element protrudes beyond a corresponding edge, in particular lateral edge, of the second closing portion, such that the first and second locking elements are opposite one another. The locking elements of the closure device, which interact with one another in the open position of the closure parts in order to hold the closure parts in the open position, thus protrude on mutually opposing edges of the first and second closing portions, for example along a transverse direction along which the closure parts extend in the closed position, or at an angle to said transverse direction. This facilitates the accessibility and operability of the hold-open mechanism. In addition, the length of a (virtual) lever, and thus a leverage transferred via the locking elements, can be varied comparatively easily via the length of the overhang of the locking elements, for example if an opening force for transferring the closure parts into the open position is intended to be able to be introduced onto the locking elements.

In a possible development, the first and second closure parts in each case extend along a transverse axis, and the first and second locking elements in each case protrude, by at least one portion, along the transverse axis, beyond ends of the closure parts. Analogously to the design explained above, having locking elements protruding beyond lateral edges of the closing portions, corresponding advantages can also be achieved by locking elements protruding (laterally) beyond ends of the closure part.

In this connection, it can also be provided that, in the open position, the first and second locking elements fix the first and second closure parts in a locking position, in order to lock the first and second closure parts in the open position, and the first and second locking elements in each case comprise (in particular form) an operating portion which is coupled to an associated closure part and is provided for manual force application, and said elements are configured to adjust the closure parts out of their closed position and into the open position by displacement of the first and second locking elements out of a rest position in the direction of the locking position, as a result of an actuation force applied manually to the operating portions. Consequently, in this variant, operating portions are provided on the locking elements, which operating portions are configured for applying an actuating force, in order to adjust the closure parts out of the closed position and into the open position, in which locking of the closure parts then takes place, via the locking elements. In this case, corresponding locking element-side operating portions can also be provided, in addition to the actuating portions of the first and second closure parts, via which operating portions a manual force application on the closure parts for the displacement thereof out of the closed position into the open position, and/or vice versa, is made possible or at least facilitated. Actuating portions on the closure part side can for example be formed by handle portions protruding in a tab-like manner. Alternatively, locking element-side operating portions form the only option, provided on the closure device, for a force application as intended, in order to displace the first and second closure parts out of the closed position and into the open position, and/or vice versa.

In a variant the first and second locking elements are provided for arrangement in a cavity accessible via the opening. In this case, a first end piece of the first locking element and a second end piece of the second locking element are spaced apart from one another in the closed position and interact with one another in the open position in order to apply the holding force. Consequently, in the case of a storage device equipped with the proposed closure device, in this variant the locking elements are provided inside the cavity and are spaced apart from one another when the first and second closure parts are present in their closed position. For example, in the case of a storage device, the first and second, in this case inner, locking elements are in each case connected, on the inside, to an associated lateral edge of a closing portion or of a portion of the storage device adjacent thereto. The opening of the closure device is associated with the first and second end pieces of the locking elements moving closer together, inside the storage device, such that said end pieces can interact with one another in order to apply the holding force. Thus, by the transfer into the open position for example the first and second locking elements are interconnected at their first and second end pieces, and are held in said connected state. The connection of the end pieces then counteracts an adjustment of the first and second closure parts into their closed position, since initially a force for releasing the connection between the locking elements has to be applied (manually) on the first and second end pieces.

For example, in each case at least first and second magnet elements can be provided on the first and second end pieces. A first and a second magnet element of the first and second end pieces can interact in a magnetically attracting manner in the open position of the first and second closure parts, in order to fix the two end pieces against one another and thereby apply the holding force which counteracts closing of the closure device.

Alternatively or in addition it can be provided, in this connection, that the first and second closure parts (in the closed position) in each case extend along a transverse axis, and the first and second locking elements are intended to be brought into contact with one another at their end pieces, by adjustment from the closed position into the open position, in order to interact with one another and, in the open position, to apply a tensioning force, via the first and second locking elements, to ends of the closure parts provided laterally along the transverse axis. Consequently, if the end pieces are interconnected in the open position, a tensioning force is maintained by the locking elements comprising the end pieces, which tensioning force holds the first and second closure parts in the open position. Thus, a tensioning force applied by the locking elements, in the case of interacting end pieces, in the open position of the first and second closure parts, thus acts, optionally via a lateral edge of the storage device, in each case on lateral outside ends of the two closure parts extending along a transverse axis. In this way, an outward bulging of the closure parts transversely to the transverse axis is assisted and maintained via the tensioning force, for example, by means of which the two closure parts, in their open position, release the opening.

In principle, a variant can provide for a plurality of (at least two) hold-open mechanisms to be part of the closure device. This then for example also includes the situation in which two pairs of locking elements are provided at ends of the closure parts that are spaced apart from one another along a transverse axis.

The first closure part and/or the second closure part can extend along a transverse axis, in particular in a strip-like manner. The first closure part and/or the second closure part can thus in particular have a strip body extending along the transverse axis.

In a variant, the first closure part and/or the second closure part are configured having at least two portions, which are interconnected via a weakening region. The at least two portions are then displaceable relative to one another, via the weakening region. In this case, the at least two portions or segments are consequently interconnected via a weakening region made of the material of which the respective closure part consists, for example in the manner of a film hinge, such that when the first and second closure parts are adjusted between their closed position and their open position, displaceability of the at least two portions, about a hinge axis defined by the weakening region, relative to one another is made possible. For example, the weakening region is formed by a notch in the material of the respective closure part.

If first and/or second closure parts are provided, these can be separate from one another and separated in the transverse direction, such that a flexible region of each closing portion, on which the first or second closure parts are arranged, can act as a film hinge.

Thus, when producing a closure part, flexibility is purposely introduced into the respective closure part via one or more weakening regions, without the closure part itself having to be produced from a flexible or even resilient material (which is of course in principle also possible, as part of the proposed solution). A respective closure part can thus consist of an inherently rigid material, in which portions displaceable relative to one another are provided by one of more weakening regions. This in particular includes the situation where the first closure part and/or second closure part comprise a plurality of weakening regions, i.e. more than 2, 3 or 4 weakening regions, such that the respective closure part forms a plurality of portions or segments that are displaceable relative to one another.

In a further variant, the first and second closure parts can in each case extend along a transverse axis, and the at least one hold-open mechanism comprises a flexible, in particular resilient, locking element for arrangement in a cavity that is accessible via the opening, wherein said flexible locking element is provided to apply a tensioning force to ends of the closure parts provided laterally along the transverse axis, in the open position. In this connection, the flexible tensioning element can engage on mutually opposing end portions of the first and second closure parts and/or on a lateral edge of the storage device, and can be preloaded, such that a transfer of the first and second closure parts out of their open position and into the closed position can take place only counter to the tensioning force applied by the flexible locking element. Consequently, for maintaining the closed position of the first and second closure parts, at least the tensioning force must always be overcome, via which force the first and second closure parts strive to assume their open position.

For example, the flexible locking element is provided for arrangement in an intermediate wall within the cavity. In the case of a storage device equipped with such a variant of a proposed latching device, it can thus be provided that at least two compartments are defined in the storage device, via an intermediate wall within the cavity. The flexible locking element accommodated in said intermediate wall-typically in the region of an upper edge of the intermediate wall facing the opening-then applies the holding force for maintaining the open position of the first and second closure parts.

In this connection, it can also be provided for the flexible locking element to be able to be re-tensioned. A tensioning force applied by the flexible locking element can thus be readjusted manually. Thus, for example, a flexible locking element configured as a tensioning cable can be tensioned more strongly by manually pulling on a cable portion accessible inside the cavity, and can be locked in the respective more strongly tensioned position via a clamp, in particular in the manner of a cord clamp provided on an item of clothing.

In a further alternative variant, a U-shaped tensioning element can be provided on the closure device for the application of the holding force in the open position, and thus the maintenance of the open position. A U-shaped tensioning element of this kind comprises a base and two limbs that are interconnected via the base, wherein the two limbs are preloaded towards one another, and the tensioning element is provided for applying the holding force over the two limbs that are preloaded towards one another, in the open position. The tensioning element can thus be provided, here, to allow an adjustment of the first and second closure parts out of the open position and into the closed position only counter to a preload force applied by the two limbs. Under action of the two limbs, the first and second closure parts thus strive to assume and maintain their open position. In order to transfer the first and second closure parts into the closed position, the preload force of the two limbs then has to be overcome manually.

In a variant, the U-shaped tensioning element can for example be formed by a U-shaped spring element. The limbs of said spring element, which are resiliently preloaded towards one another and are interconnected via the base, then apply the holding force in the open position. In another variant, the tensioning element is not formed by a separate component, but rather, for example, by a U-shaped cavity which is provided as part of the closure device in an edge of a storage device equipped with the closure device. In this case, the cavity is shaped in such a way that the limbs of the U shape are preloaded towards one another, and thus pushed (inwards) towards one another, under pressure applied by inflating the cavity.

For applying the holding force, a further variant provides at least one spring strip which is preloaded against an adjustment of the first and second closure parts out of the open position and into the closed position. A spring element of this kind can for example, by means of bulging transversely to a longitudinal extension direction of the spring strip, assist a (corresponding) bulging of the flexible first or second closure part, by means of which the respective closure part is displaced into the open position, if a sufficiently high closing force does not act on the first and second closure parts in order to (still) hold these in their closed position. For example, the spring strip can comprise a convex steel strip or can be formed by a convex steel strip.

In the case of a closure device configured having at least one spring strip, the spring strip can for example extend along the first or second closure part. Alternatively, the at least one spring strip can be an integral component of the first or second closure part.

In a further alternative variant the at least one spring strip can extend, in the open position of the first and second closure parts, between an end of the first closure part and an opposing end of the second closure part. The spring strip preloaded in the direction of the open position of the first and second closure parts thus strives, in the last-mentioned variant, to space the mutually opposing ends of the first and second closure parts apart from one another, and to hold them spaced apart. A transfer of the first and second closure parts out of their open position and into their closed position can in turn take place only counter to a restoring force applied by the at least one spring strip. Until reaching their closed position, in which the first and second closure parts are secured against resetting, the first and second closure parts would thus always automatically assume their open position, under action of a spring strip or a plurality of spring strips.

In principle, the first and second closure parts form a closure combination in the closed position, which combination is adjustable from a release position, in which the first and second closure parts can be moved away from one another for releasing the opening, into a closure position, in which the closure combination and at least one third closure part of the closure device interact with one another in such a way that the closure combination is held in the closure position. Thus, in the closure position, for example first and second closing portions, on which the first and second closure parts are arranged, can be folded or rolled up, in particular in that the first and second closing portions, and thus any walls of a storage device comprising the closing portions, are bent or folded, at least once, about 180°. By means of the interaction of the closure combination with the third closure part, the closure combination is held securely in a closure position assumed in this way. It is thereby possible for additional securing of a closed state of the closure device to be provided, since initially the closure combination has to be transferred out of the closure position into the release position before a displacement of the first and second closure parts out of the closed position and into the open position can take place.

For example, the third closure part and the closure combination can interact mechanically, e.g. in a form-fitting manner, in particular via a hook and loop fastener, and/or in a magnetically attracting manner, in order to hold the closure combination in the closure position. In this case, a magnetic interaction also includes for example an interaction of at least one magnet element of the third closure part with at least one magnet element of the first or second closure part, via which the first and second closure parts are held in the closed position. At least one magnet element of the first or second closure part thus has a dual function, on the one hand in interaction with a magnet element of the respective other (second or first) closure part, and in interaction with the third closure part.

The closure combination can in principle be adjustable out of the release position and into the closure position, folding over or rolling in the first and second closing portions at least once, for example about a pivot axis in parallel with a first spatial direction. A securing force, e.g. a magnetic force, for holding the closure combination in its closure position with respect to the third closure part, then acts for example along a spatial axis which is in parallel with a second spatial direction extending perpendicularly to the first spatial direction. As already discussed above, the closure combination having the first and second closure parts present in the closed position can consequently be transferred out of the release position and into the closure position by pivoting the closure combination about a pivot axis in parallel with a first spatial direction (e.g. based on a cartesian coordinate system of the x-direction). It is thus possible, for example, for the closure combination to be folded out of the release position and into the closure position. Consequently, here, the closure combination is folded about the pivot axis in parallel with the first spatial direction, for example about approximately 180°. A (resulting) magnetic force, for holding the closure combination in its closure position with respect to the third closure part, then acts along a spatial axis which is in parallel with a second spatial direction (y) extending perpendicularly to the first spatial direction.

In principle, the third closure part can (also) be configured so as to extend along a transverse axis, in particular in a strip-shaped manner. In this case, for example the third closure part is arranged in an offset portion of a first wall of a storage device which is different from the first closing portion. The third closure part can thus be arranged for example perpendicularly to a transverse axis and spatially offset relative to the first closing portion. In a variant of this kind, for example at least one strip-shaped third closure part extends in parallel with a strip-shaped first closure part, but in this case is arranged so as to be offset transversely to the first closure part.

In connection with a closure device which comprises a third closure part for securing the closure combination in the closure position, it can be provided for the third closure part to be provided for arrangement in a cavity accessible via the opening. If the closure combination interacts magnetically with an inner third closure part of this kind, in order to secure the closure position, consequently the corresponding magnet elements are provided here, in such a way that the magnetic interaction is also possible through the walls of a storage device comprising the closure device.

In view of holding the first and second closure parts in their open position following transfer of the closure combination into the release position, an inner third closure part can have a dual function. Thus, a variant can provided that the third closure part, which is provided for arrangement in the cavity and is thus the inner closure part, is formed by two locking elements of the hold-open mechanism. Said two locking elements are displaceable relative to one another and overlap one another, in an overlap region, in the event of an adjustment of the first and second closure parts from the closed position into the open position. Portions of the two locking elements then interact in a magnetically attracting manner, and/or latch together in a form-fitting and/or force-fitting manner, in the overlap region, in order to apply the holding force. Consequently, for transferring the first and second closure parts out of the open position and into the closed position, the connection of the first and second locking elements acting in the overlap region must first be released again.

For the magnetic attraction in the overlap region, for the variant first mentioned above, precisely those magnet elements of the two locking elements of the third closure part can also interact with one another which, in the case of a closed closure device and thus in the case of a closure combination in the closure position, hold the closure combination in the closure position under interaction with magnet elements of the first closure part.

In principle, the closure device can be provided for closing an opening via which a hollow body is accessible, and/or the closure device can be provided for arrangement on a storage device. Any hollow body can for example be bounded by at least one flexible wall, wherein a closing portion is then provided or formed on a flexible wall of this kind.

In a variant, the first closure part and/or the second closure part and/or a third closure part are configured so as to be resilient, or are configured so as to be flexible via one or more weakening regions having portions that are displaceable relative to one another. In this case, a closure part can then have increased rigidity, for example with respect to a wall of a hollow body on which the closure device is arranged, but in this case be so flexible that it can be bent, in particular about a vertical direction that is perpendicular to a transverse axis.

The proposed solution in particular includes a storage device which comprises a hollow body for receiving at least one object and/or a liquid, wherein the at least one object and/or the liquid can be introduced into the hollow body via an opening which can be closed by a variant of a proposed closure device.

In a variant, the first closure part is enclosed for example between an inner layer and an outer layer of a first wall, which bounds a cavity of the hollow body that is to be closed by the closure device. In addition or alternatively, the second closure part can be enclosed between an inner layer and an outer layer of a second wall of the hollow body. The respective closure part, which can be configured for example as a solid strip-shaped band, is thus located in an intermediate space between the inner layer and the outer layer, and is thus enclosed between the inner and outer layers, and thus covered towards the inside by the inner layer and towards the outside by the outer layer.

In a variant, the first closing portion is formed by the inner layer of the first wall, and the second closing portion is formed by the inner layer of the second wall. The closing portion of the respective wall is thus formed integrally on the inner layer of the respective wall. In the closed position, the closing portions rest flat against one another and establish an optionally sealing termination, such that the hollow body is closed (in a sealing manner) towards the outside, in particular in a manner so fluid-tight that no moisture can enter the interior of the hollow body. However, in the closed position the opening can also be closed, in particular closed in a sealed manner, in that the first and second closure parts rest directly against one another. Consequently, in principle a closure part can be arranged on the side of a wall by which the closing portions rest against one another in the closed state, or can be arranged on a side of a wall that is on the outside in the closed state, and is not adjacent.

In a variant, the first wall and/or the second wall are flexible. In particular, both the first wall and the second wall can be flexible and non-rigid such that the hollow body can be deformed in a flexible, easily moldable manner, and can thus adapt its shape for receiving an object. The hollow body is thus formed by the walls in the manner of a pouch, in that an object, in particular an electronic object such as a mobile telephone or another object of daily life, can be received and enclosed therein in a protective manner. Alternatively, the hollow body can be configured for receiving a liquid, and thus e.g. as part of a hydration bladder.

In principle, first and second walls, to which the first and second closing portions of a proposed closure device are connected, can be part of a continuous wall element. The first and second walls can thus in particular be formed in one piece. For example, first and second walls, which are opposite one another in a cross-sectional view, can be formed by a single, integral wall element in the form of a blow-molded part.

BRIEF DESCRIPTION OF THE DRAWINGS

The accompanying drawings illustrate possible variants of the proposed solution, by way of example.

DESCRIPTION OF THE INVENTION

Figure 2:
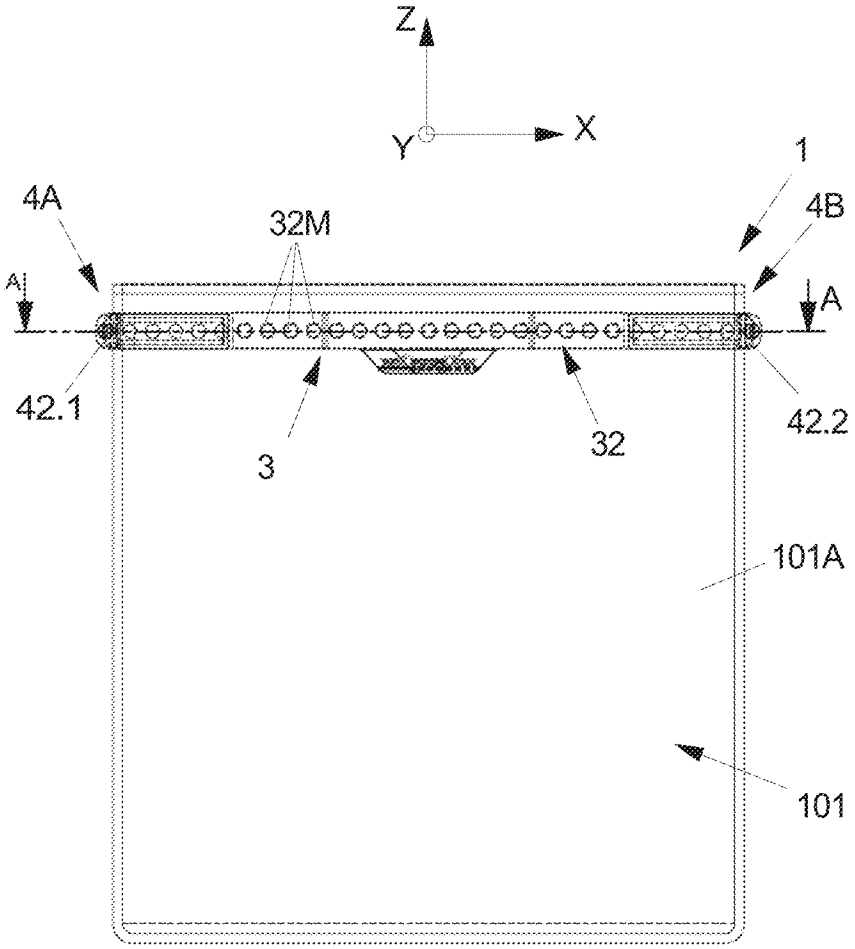
FIG. 2 shows a front view of the storage device from FIG. 1.

FIGS. 1 to 9 are views of a first embodiment of a storage device 1, which device comprises a hollow body 10 which is bounded by walls 101, 102 and is configured to receive an object, in particular an electronic object such as a mobile telephone, or another object of daily life, for example a wallet or a payment means. For example, the storage device 1 can be a bag or a pouch. The storage device 1 can also be a liquid container, for example a hydration bladder. A liquid is then stored in the hollow body 10, which liquid can flow out via an outlet provided on the hollow body 10, e.g. into a drinking tube connected thereto.

The walls 101, 102 are interconnected at parallel side edges, remote from one another along a transverse direction x and transverse axis extending in parallel therewith, and at a lower edge along a vertical direction z, for example by welding, adhesive bonding or folding over at one of the mentioned edges, and are to be closed, in the region of an upper end, by a closure device 2 in such a way that an inner volume of the hollow body 10 or a cavity defined thereby is closed in a sealing manner in a closed position of the storage device 1. In principle, each wall 101, 102 can be formed by two layers, of which an inner layer faces towards the inner volume of the hollow body 10, and an outer layer faces towards the outside. The walls 101, 102 are configured to be flexible, such that the hollow body 10 is flexibly deformable, in particular in order to be able to flexibly receive an object therein or to be able to expand when a liquid is received in the hollow body 10.

The closure device 2 comprises three closure parts 31, 32, 33. Of these closure parts 31, 32, 33, a first closure part 31 is arranged on a closing portion 101S of the first wall 101, while a second closure part 32 is arranged on a closing portion 102S of the second wall 102, and specifically in such a way that the first and second closure parts 31, 32 extend along the vertical direction z at the same height on the respectively associated wall 101, 102. The closure parts 31, 32 interact in a magnetically attracting manner, such that, in the closed position of the closure device 2, the closing portions 101S, 102S, which are in each case formed by the inner layer of the associated wall 101S, 102S, rest flat, and thus in a sealing manner, against one another, and form a closure combination 3.

Figure 6:
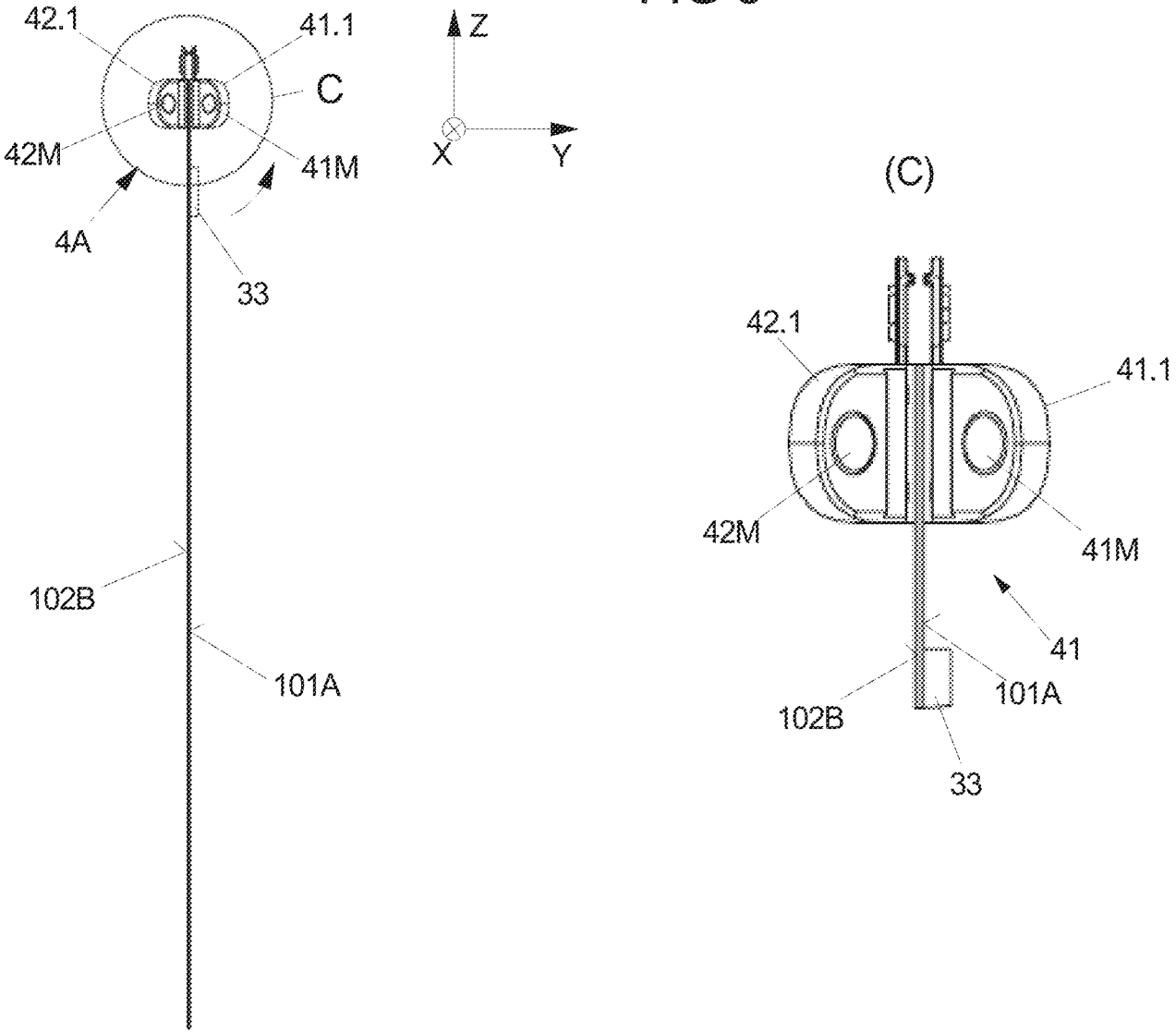

A third closure part 33 is arranged on a front side 101A of the wall 101, on a portion of the first wall 101 that is offset with respect to the closing portion 101S of the first wall 101, and, viewed along an extension path proceeding from the closing portion 101S, in the cross section according to FIG. 6, is arranged so as to be transversely offset with respect to the first closure part 31.

The closure parts 31, 32, 33 are in each case configured in a strip-shaped manner, and extend along the transverse direction x, and thus transversely to the vertical direction z.

The closure parts 31, 32, 33 are configured to interact in a magnetically attracting manner. In the embodiment shown, the closure parts 31, 32, 33 are in each case produced from a plastics material or a silicone material, in which a series of permanent magnets is embedded. In particular, discrete magnet elements 31M, 32M, 33M (of a magnet arrangement on the closure part side) can be arranged in one or more of the strip-shaped closure parts 31, 32, 33. In this case, the discrete magnet elements 31M, 32M, 33M are lined up along the transverse direction x, and thus form a linear array of magnet elements 31M, 32M or 33M. In this case, the closure parts 31, 32, 33 can have opposite poles, such that the closure parts 31, 32, 33 act on one another in a magnetically attracting manner, in pairs. In an alternative variant, opposite poles can also alternate in an array of magnet elements 31M, 32M or 33M of a closure part. An array of this kind is then provided for interaction with a corresponding opposing array on another closure part 32, 33, 31. The discrete magnet elements 31M, 32M, 33M of the magnet arrangements can in each case be formed by discrete permanent magnets, for example made of a neodymium material. It is also conceivable, however, for just one or two of the magnet arrangements to comprise discrete permanent magnets, while the other magnet arrangement(s) is/are formed of discrete ferromagnetically active elements.

Alternatively, for example just the first closure part 31 can act in a permanently magnetic manner, while the other closure parts 32, 33 are configured to be ferromagnetic, in particular as ferromagnetic armatures, such that the associated closure parts 32, 33 act as magnetic armatures. It is also conceivable, for example, for the first and second closure parts 31, 32 to be configured to be permanently magnetic, while the third closure part 33 acts ferromagnetically.

The closing portions 101S, 102S are pushed flat into contact with one another by the first closure part 31 and the second closure part 32, in the present case in such a way that the closing portions 101S, 102S formed by inner layers of the walls 101, 102 rest against one another in the manner of diaphragms and close the hollow body 10 in a sealing manner. The closure combination 3 formed by the closure parts 31, 32 is held in a defined closure position by the third closure part 33, wherein folding of the walls 101, 102 about 180° is brought about in a region between the closing portions 101S, 102S and the portions transversely offset relative to the closing portions 101S, 102S, as is clear from FIG. 1. As a result, the tightness of the closure device 2 in the closure position is further improved.

The first closure part 31 and the second closure part 32 in each case comprise an actuation portion in the form of a tab-like handle element 310, 320, on which a user can engage. By means of application of a force to the closure parts 31, 32, in particular on the handle elements 310, 320, the closure parts 31, 32 can be released from the further, third closure part 33 and adjusted into a release position. In said release position, the closure parts 31, 32 can be moved away from one another along an opening direction y (and thus at least in portions along a closing axis S in parallel therewith, which is oriented perpendicularly to the transverse axis x and to the vertical direction z), and thus the closing portions 101S, 102S can be separated from one another, such that the interior of the hollow body 10 is accessible via the opening O that is thereby released (cf. by way of example FIGS. 7 and 8A).

Figure 1:
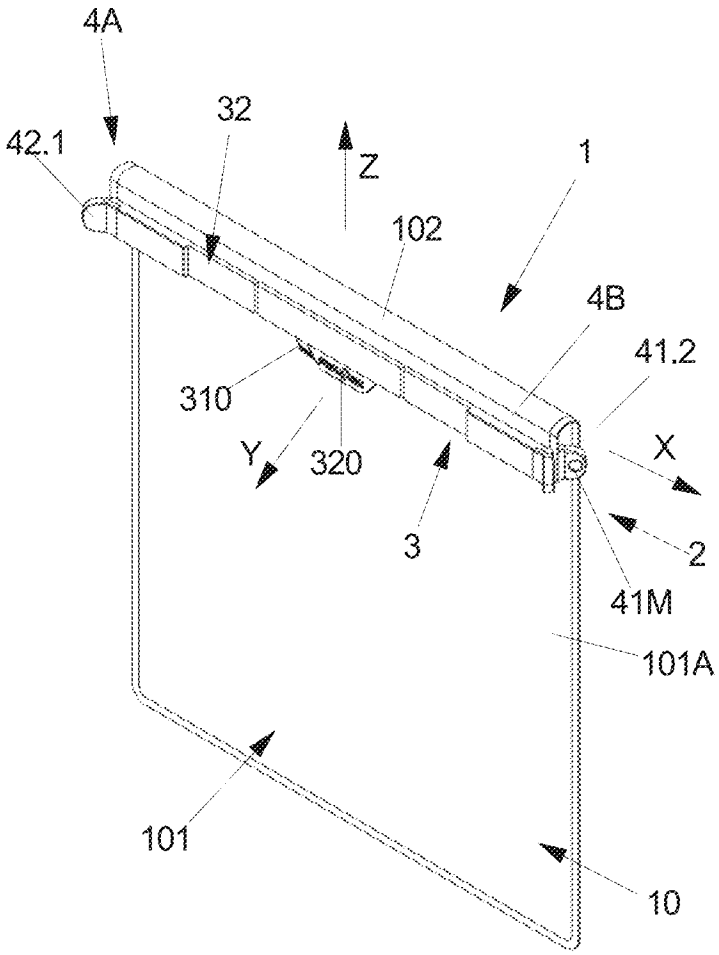
FIG. 1 shows a perspective view of a storage device comprising a variant of a proposed closure device in a closure position.
Figure 2A:
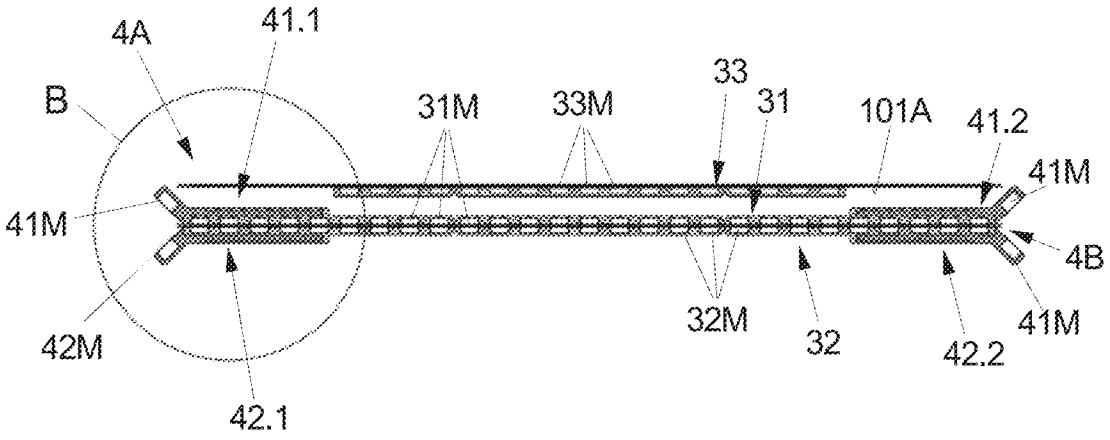
FIG. 2A shows a side view corresponding to the cutting line A-A of FIG. 2.
Figure 2B:
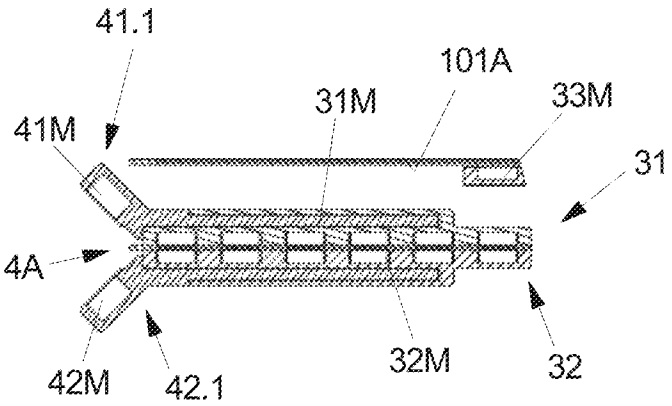
FIG. 2B shows an enlarged detail of the sectional view from FIG. 2A.
Figure 3:
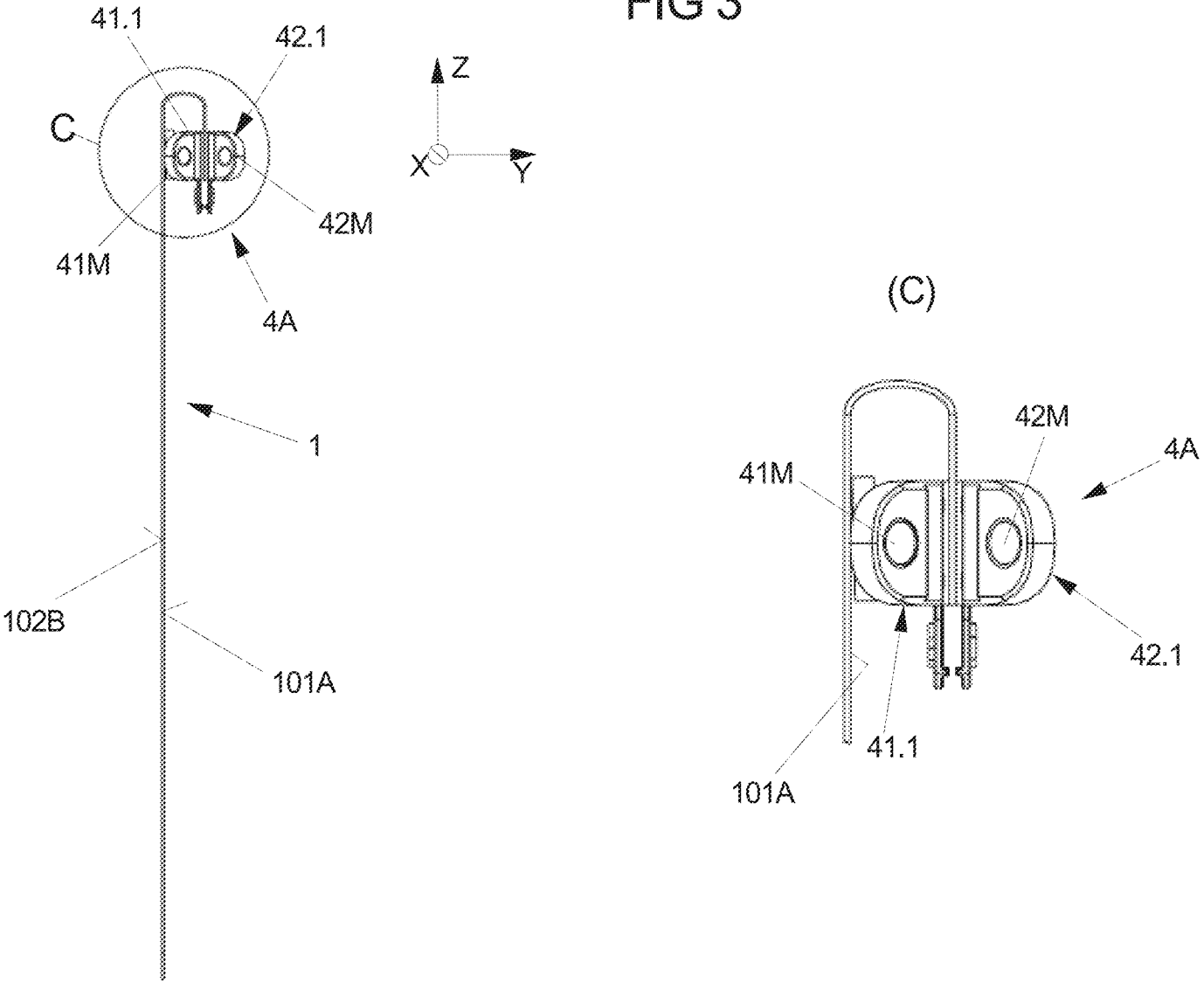
FIG. 3 shows a side view of the storage device of FIGS. 1 and 2, with an enlarged detail.
Figure 5:
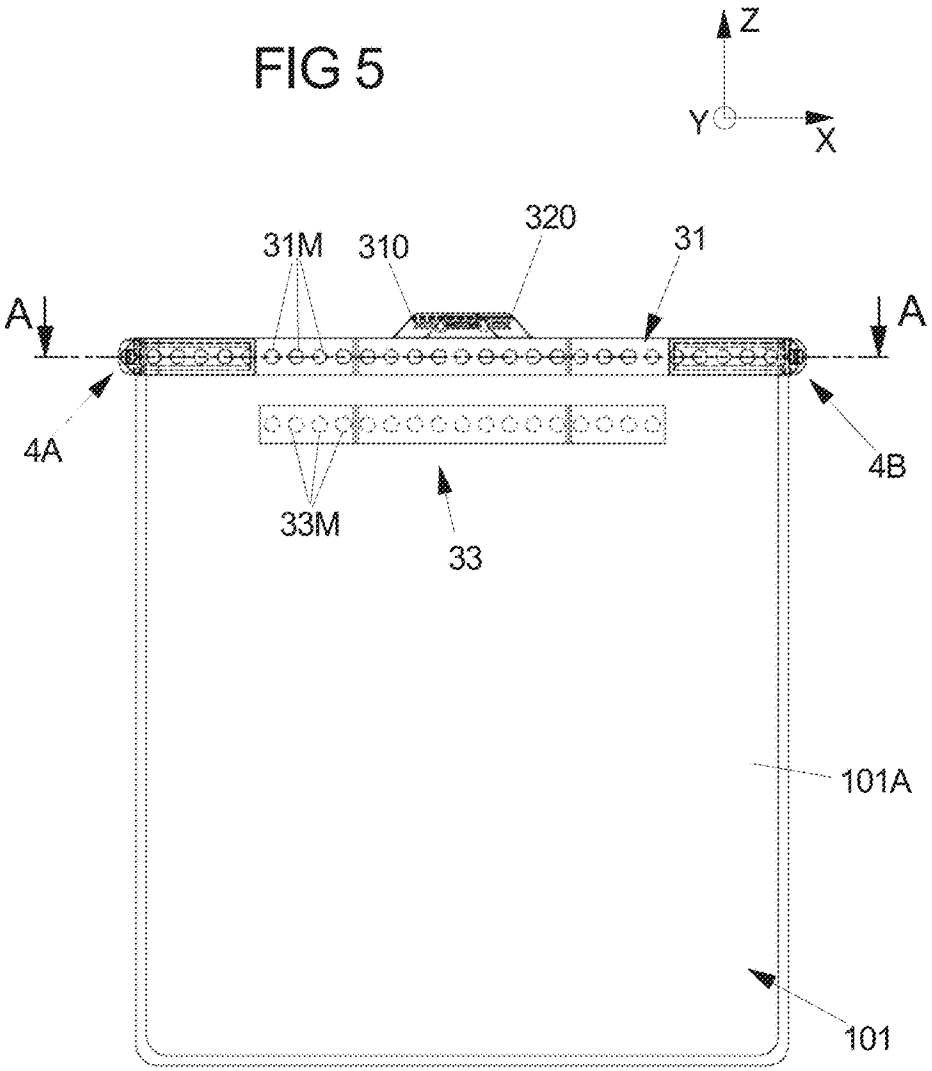
FIGS. 4-6 show, in views corresponding to FIGS. 1 to 3, the storage device comprising the closure device in a release position, in which first and second closure parts of the closure device are present in a closed position.
Figure 4:
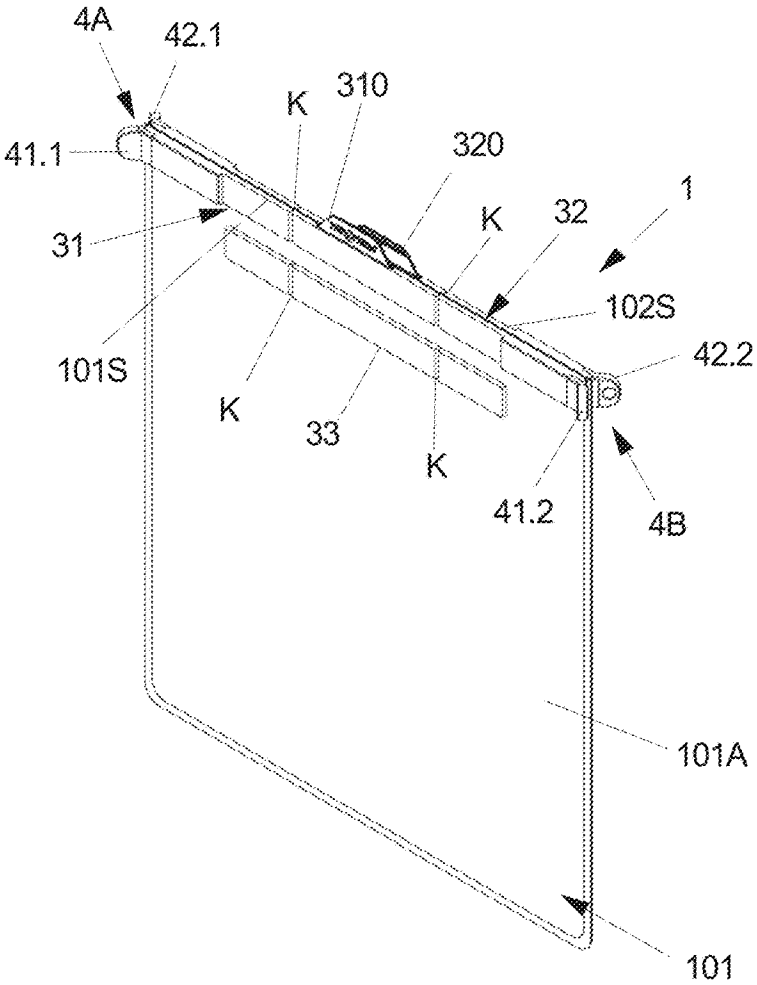
Figure 5A:
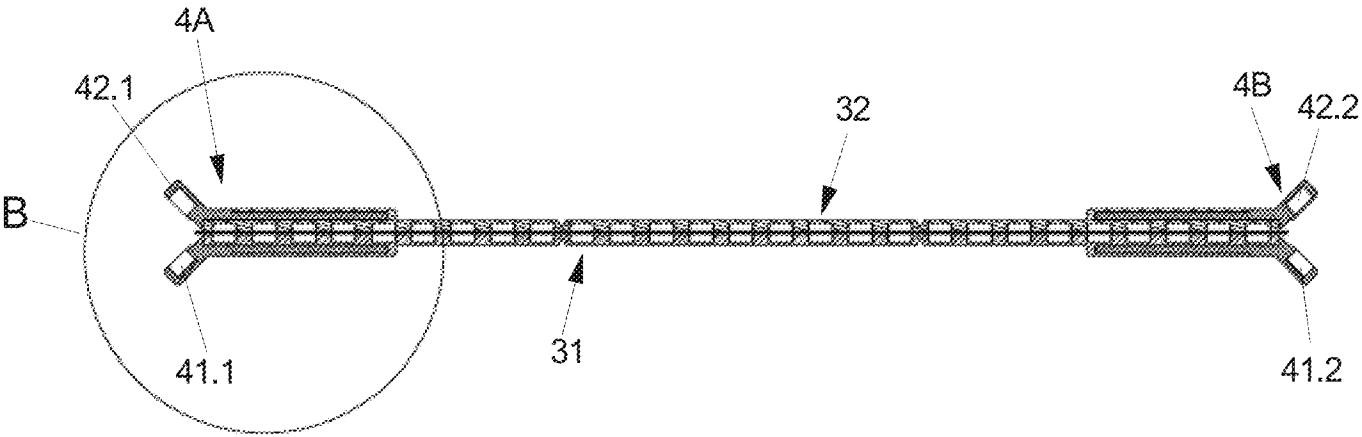
Figure 5B:
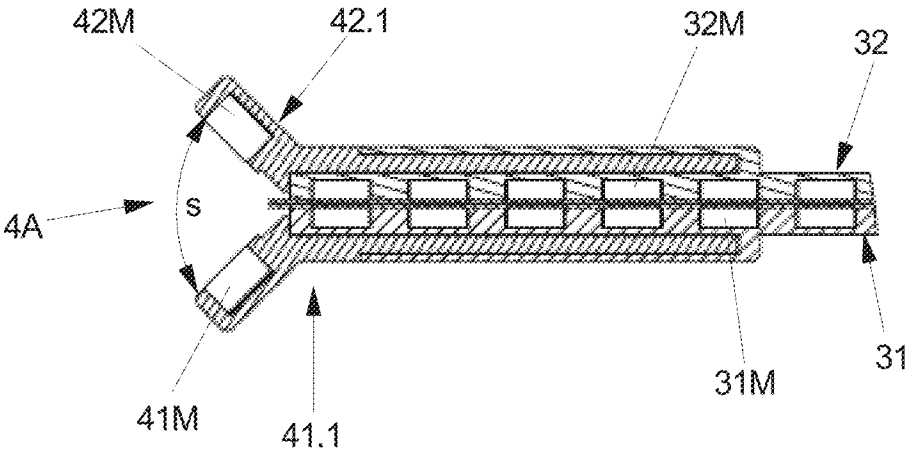
Figure 8:
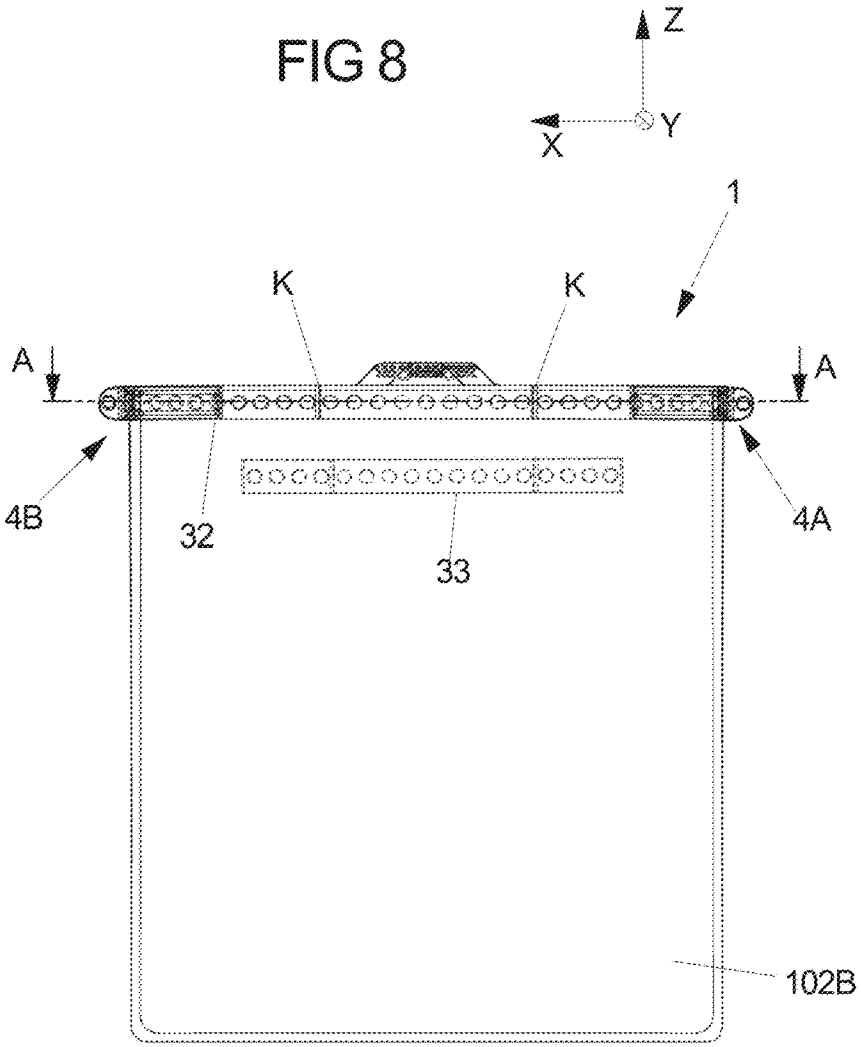
FIGS. 7-9 show, in views corresponding to FIGS. 4 to 6 but rotated about 180° in each case, the storage device comprising the closure device in a locked open position, in which a hollow body of the storage device is accessible via an opening.
Figure 7:
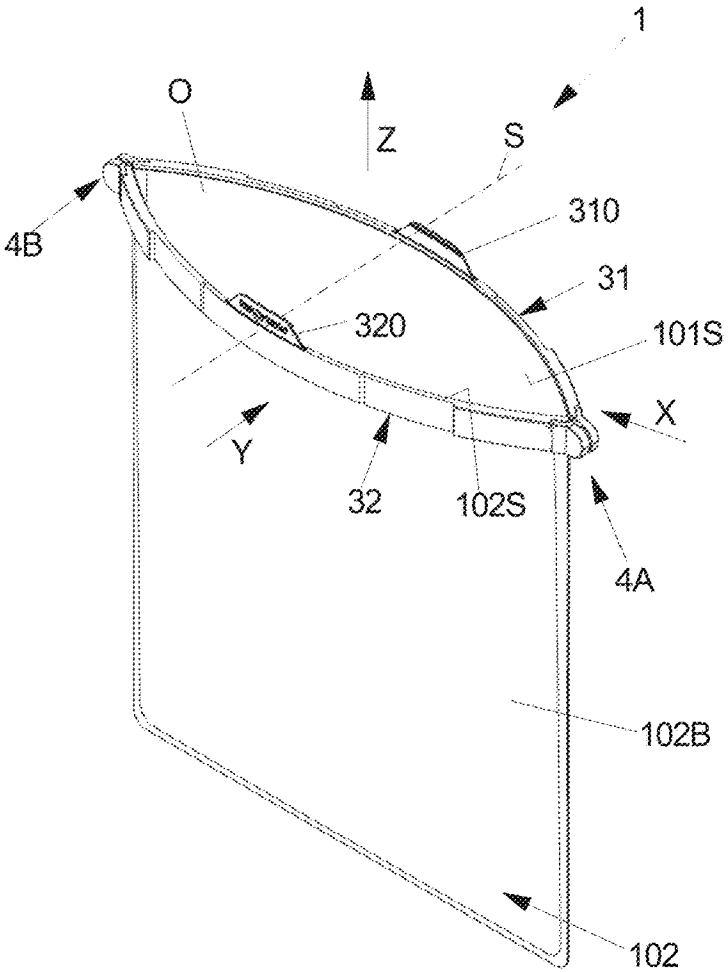
Figure 8A:
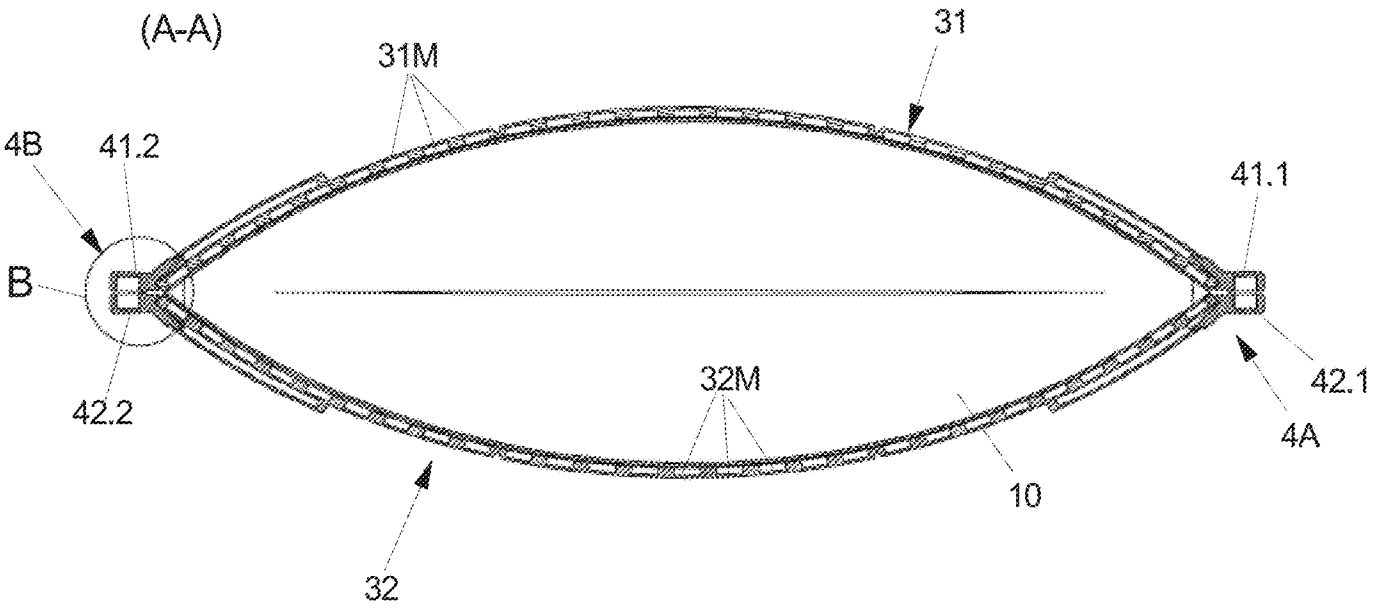
Figure 8B:
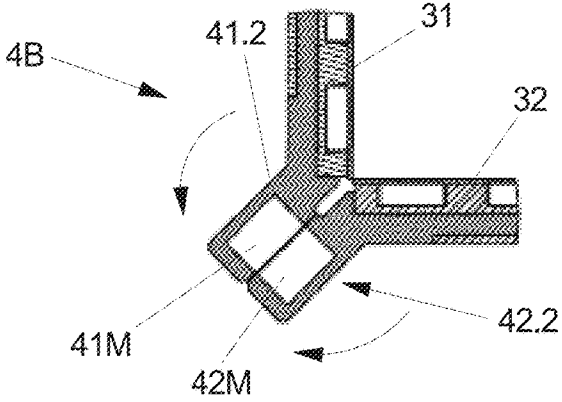
Figure 9:
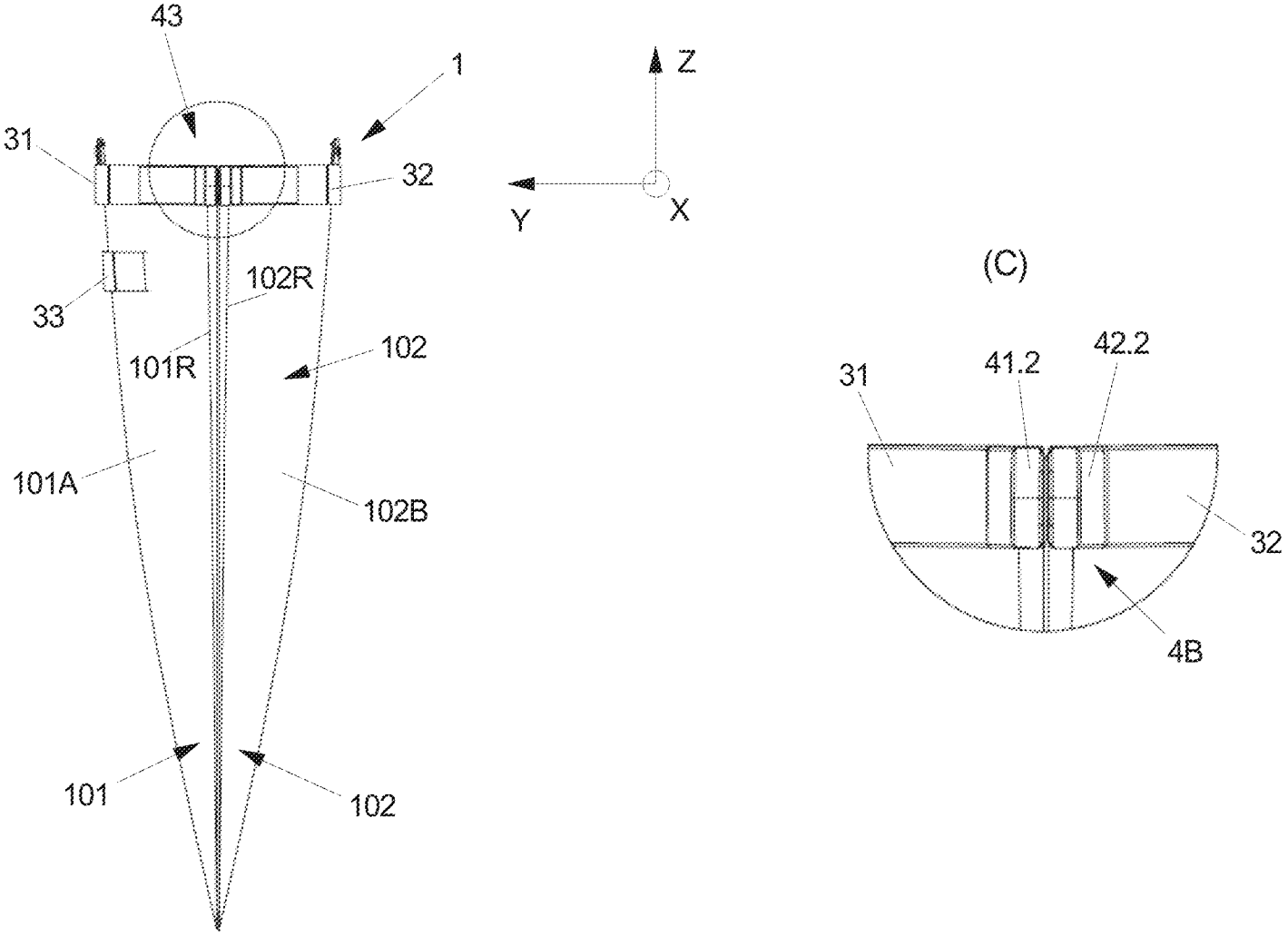
Figure 11:
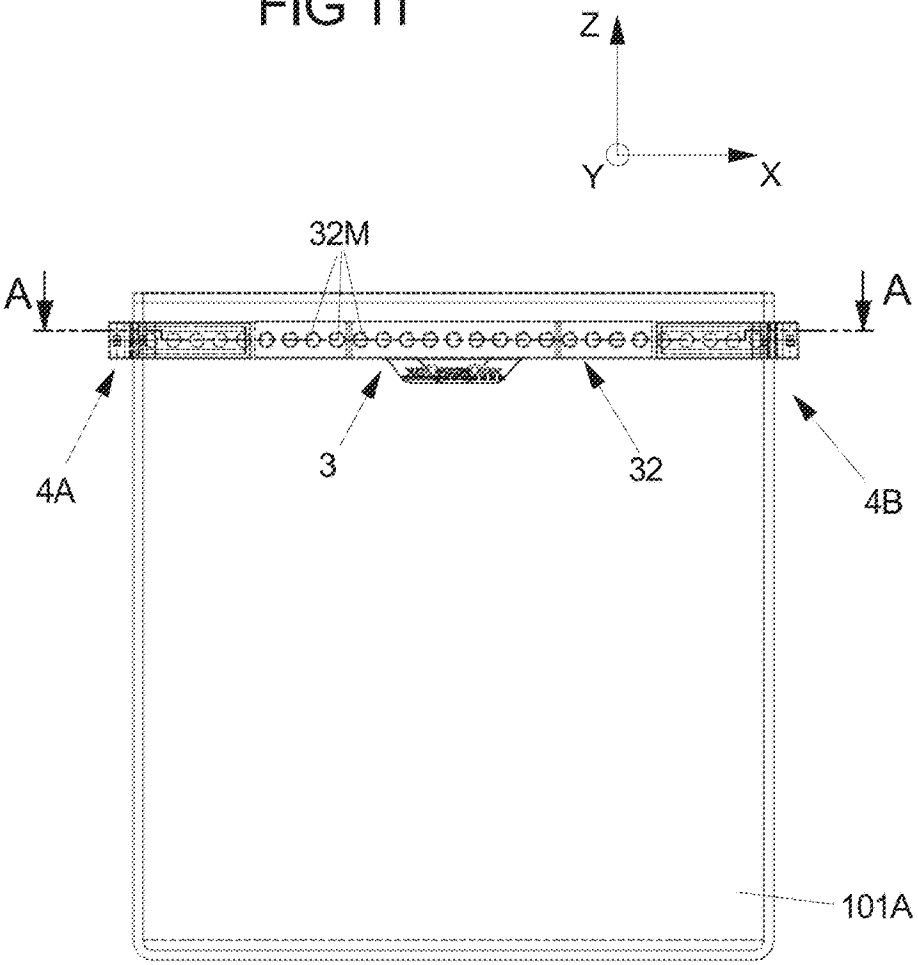
FIGS. 10-18 show, in views corresponding to FIGS. 1 to 9, the storage device comprising a further variant of a proposed closure device.
Figure 10:
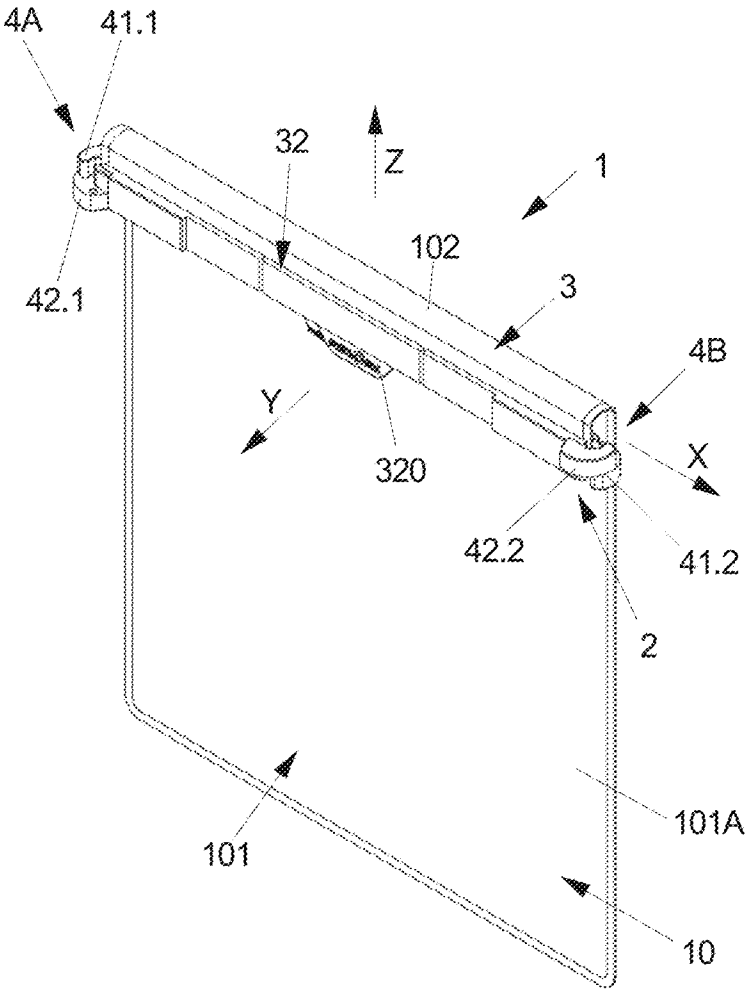
Figure 12:
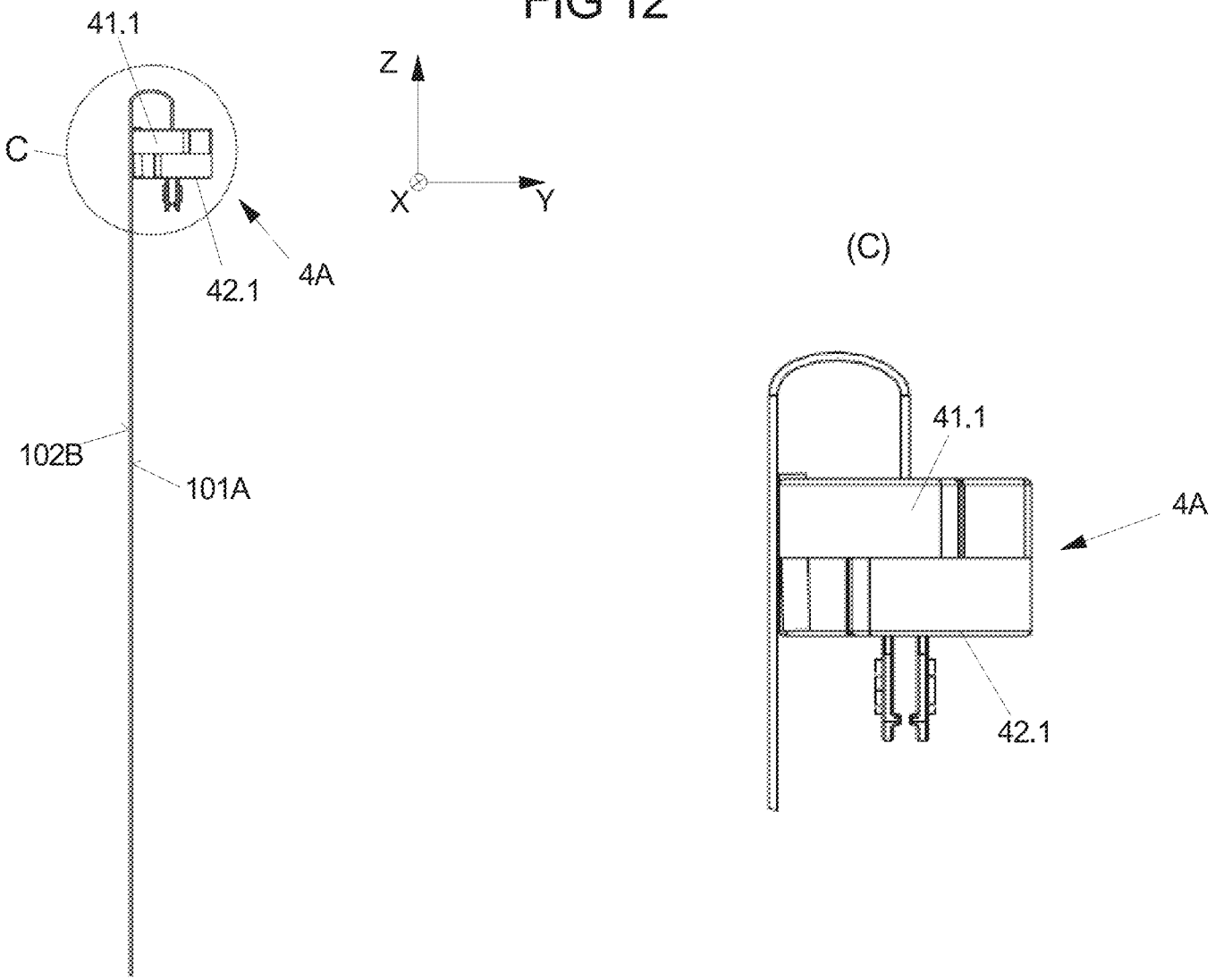
Figure 14:
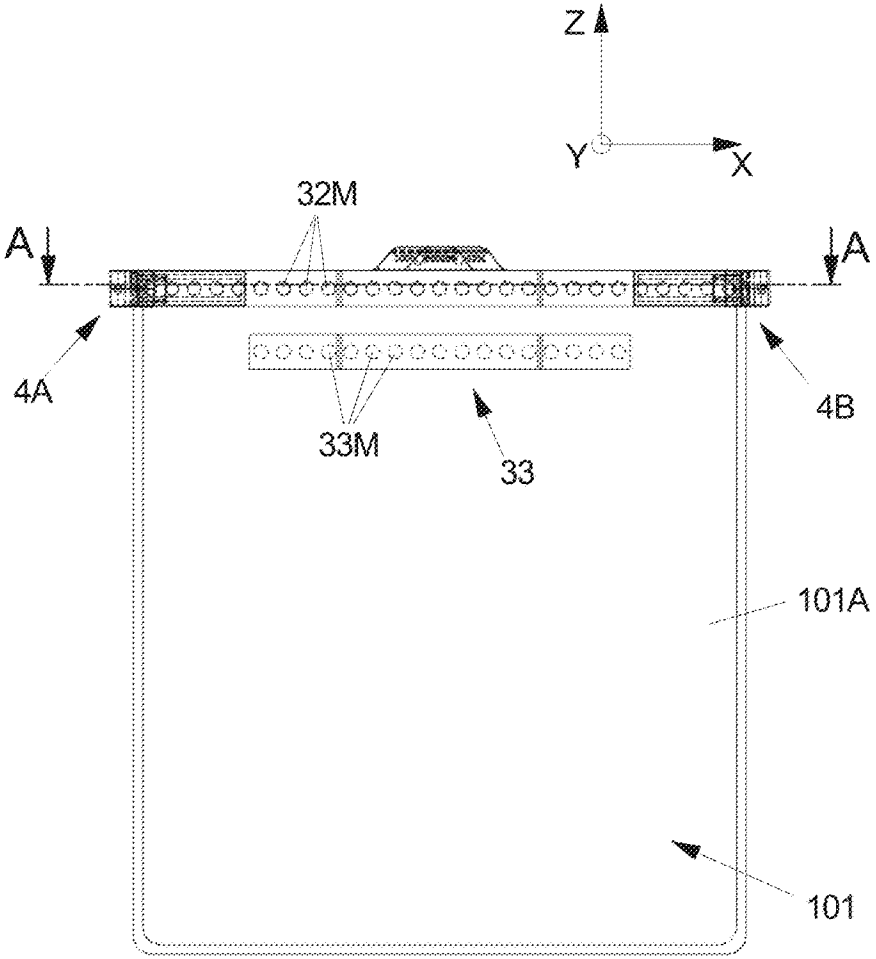
Figure 13:
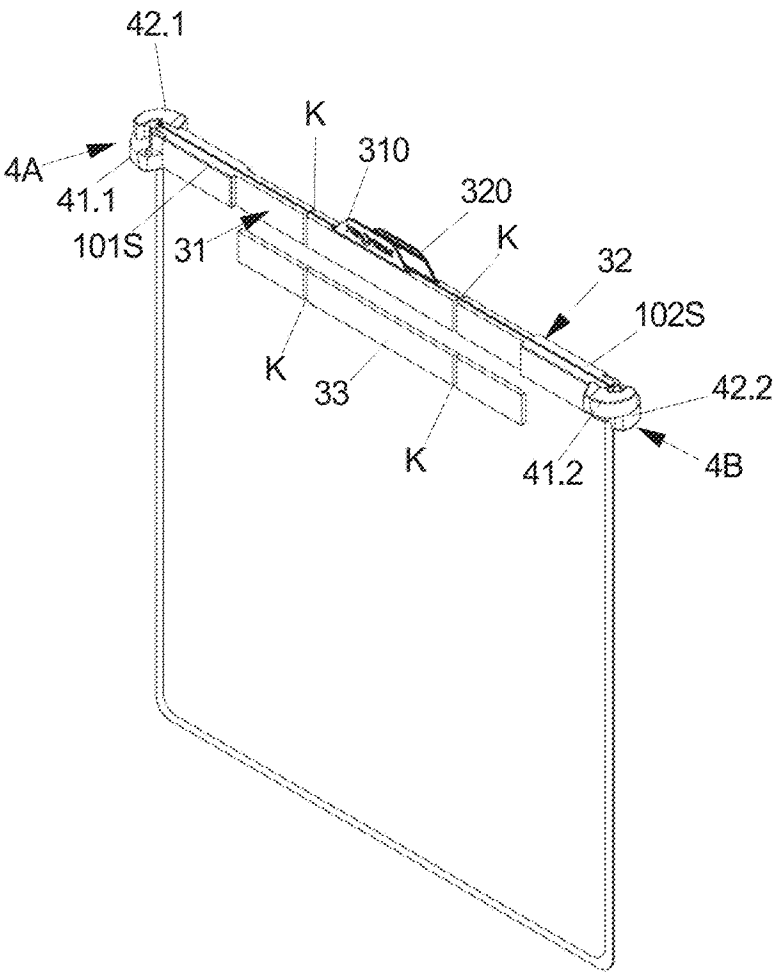
Figure 14A:
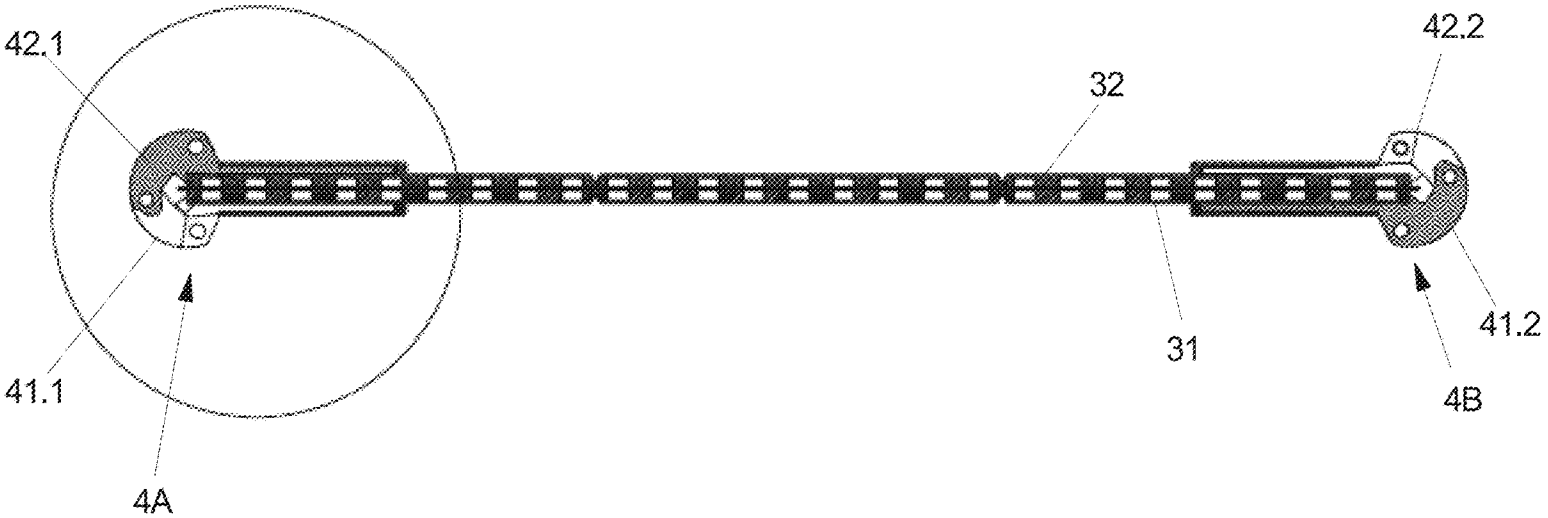
Figure 14B:
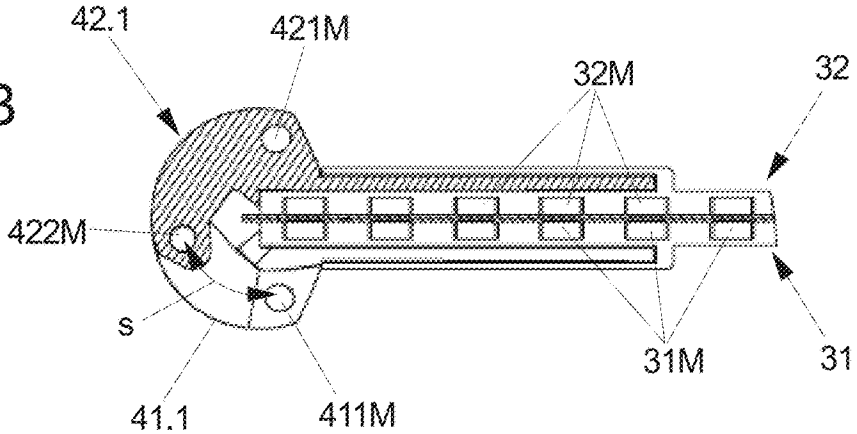
Figure 15:
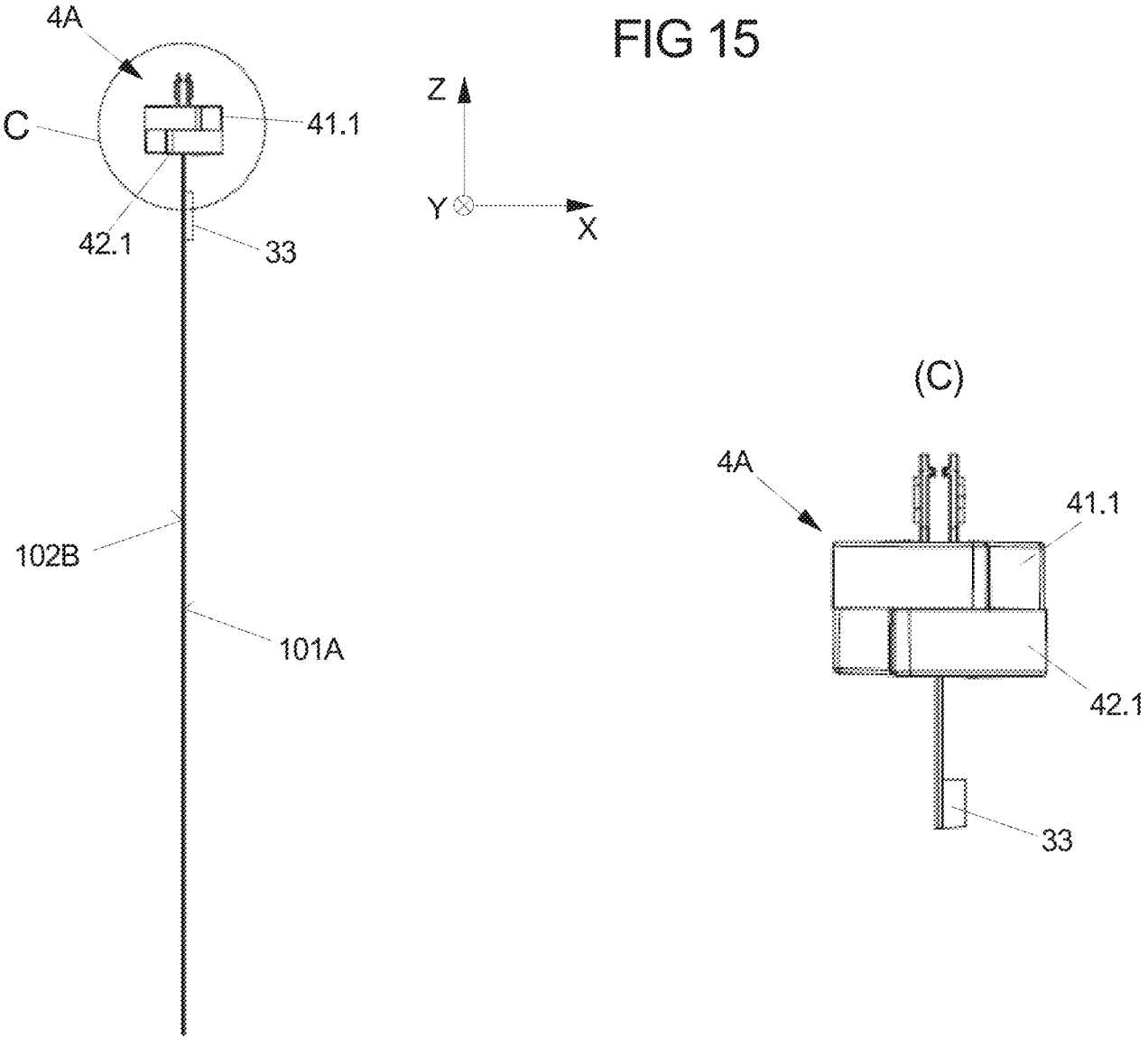
Figure 17:
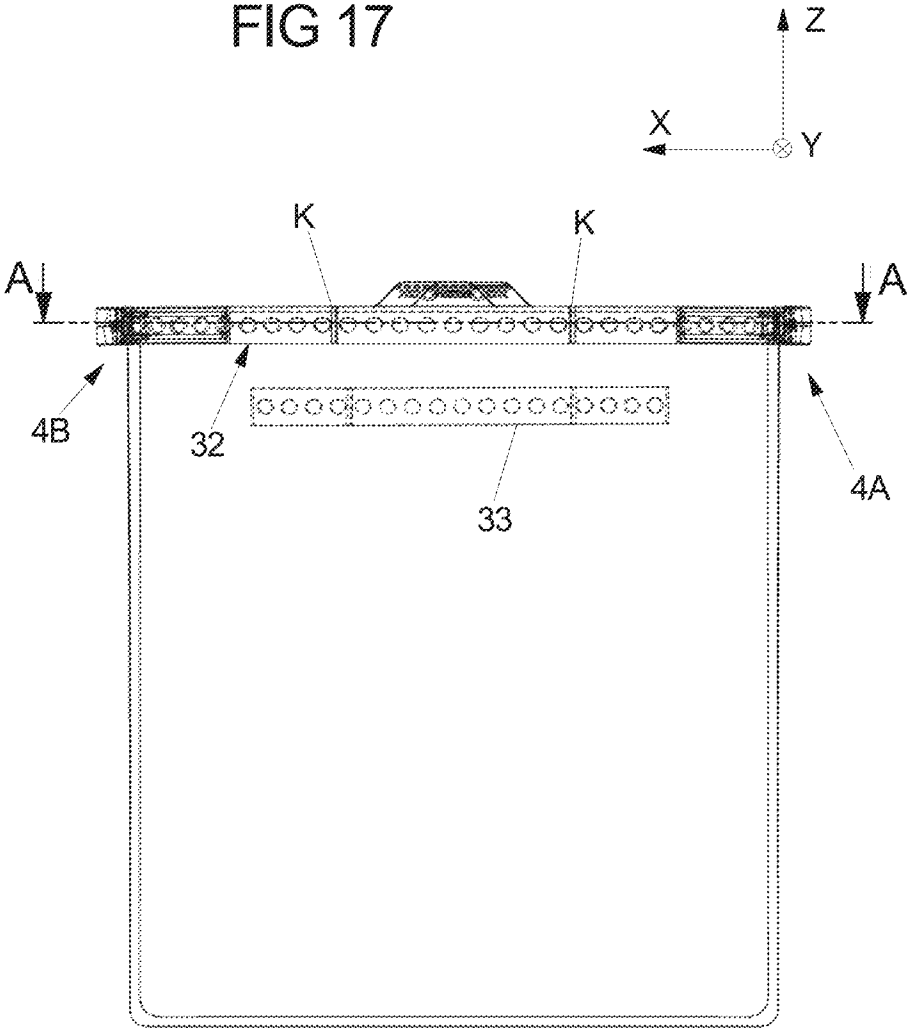
Figure 16:
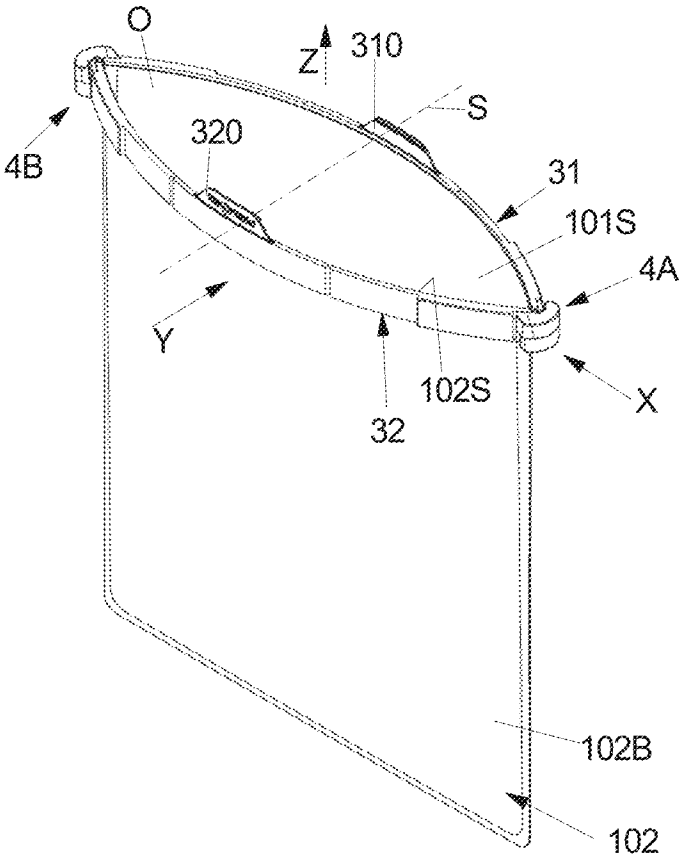
Figure 17A:
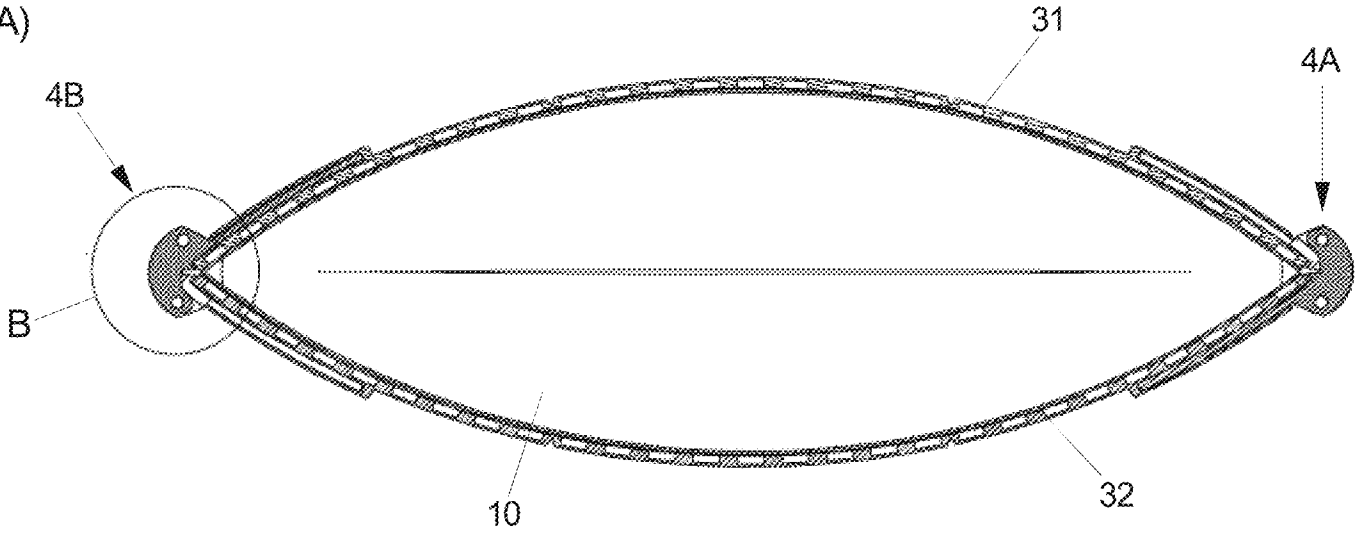
Figure 17B:
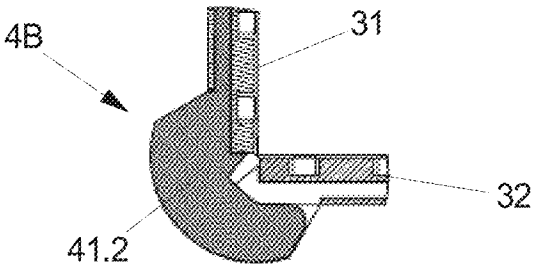
Figure 18:
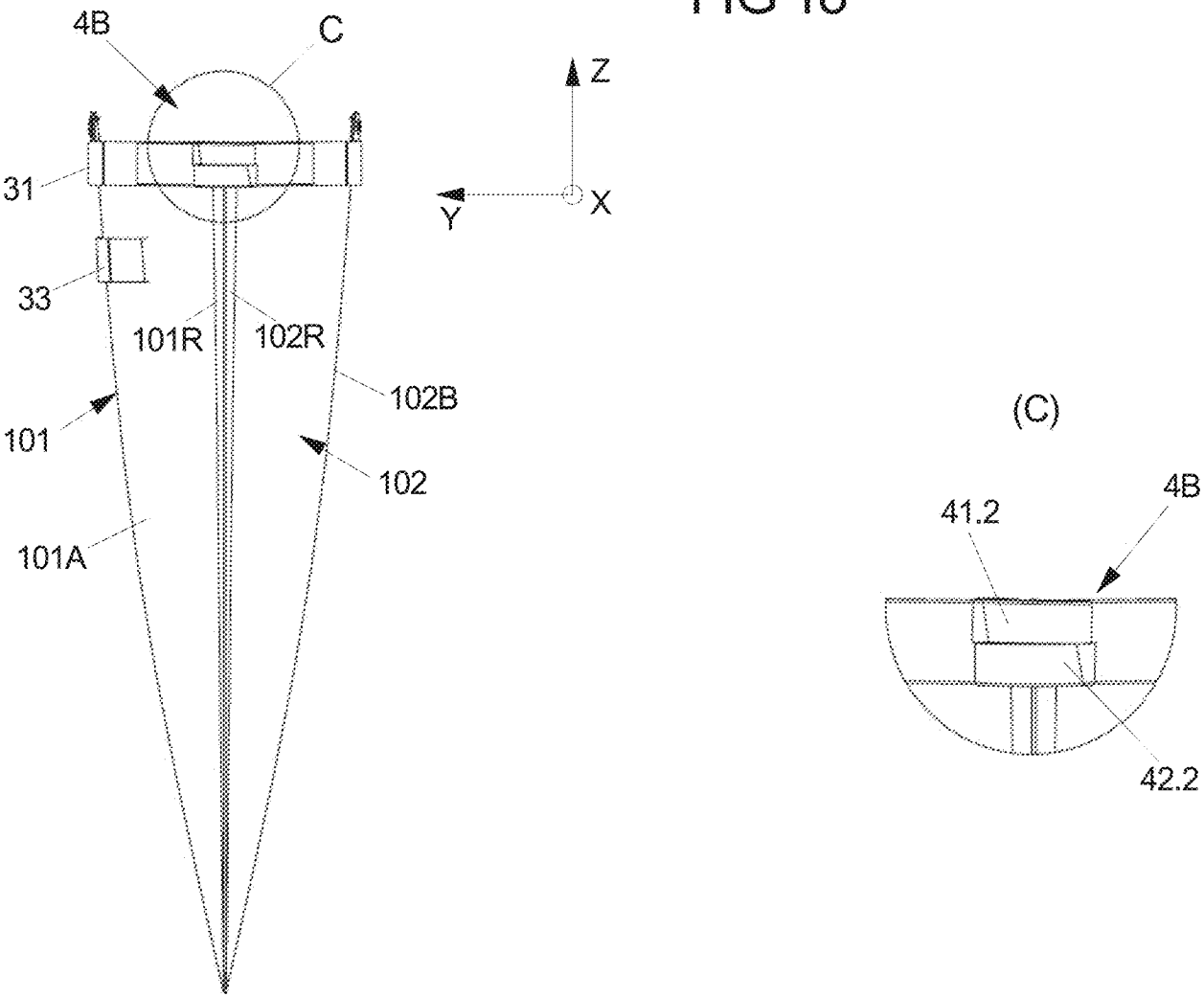
Figure 20:
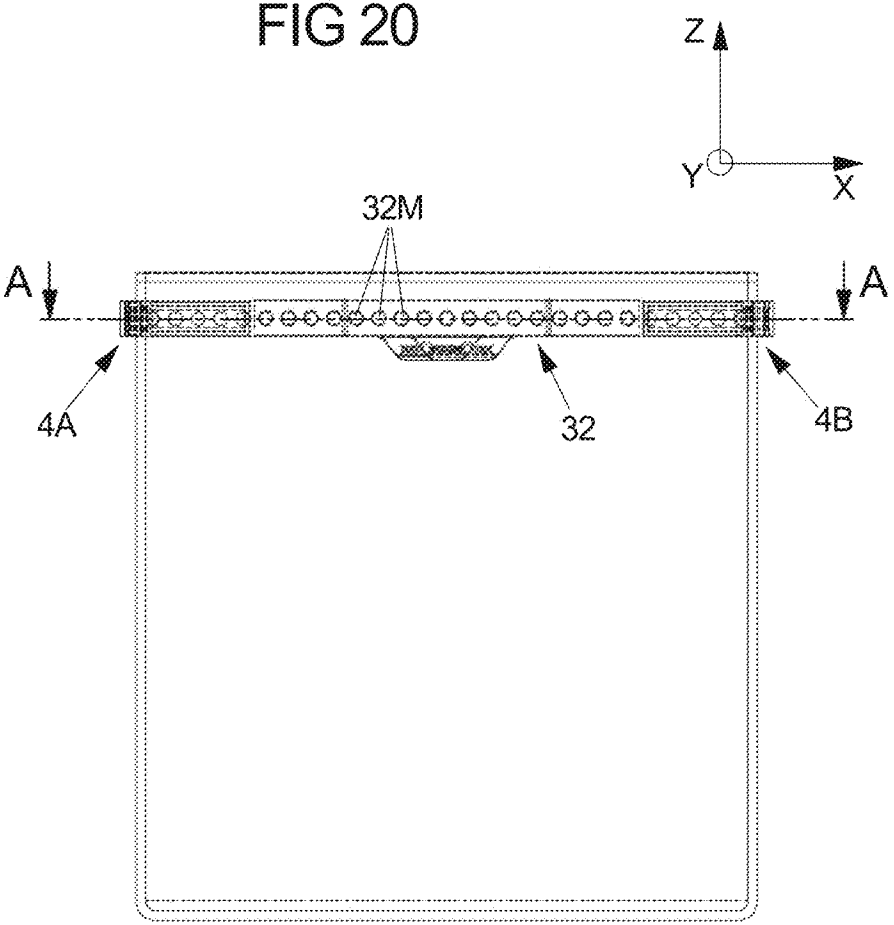
FIGS. 19-27 show, in views corresponding to FIGS. 1 to 9, the storage device comprising a further variant of a proposed closure device.
Figure 19:
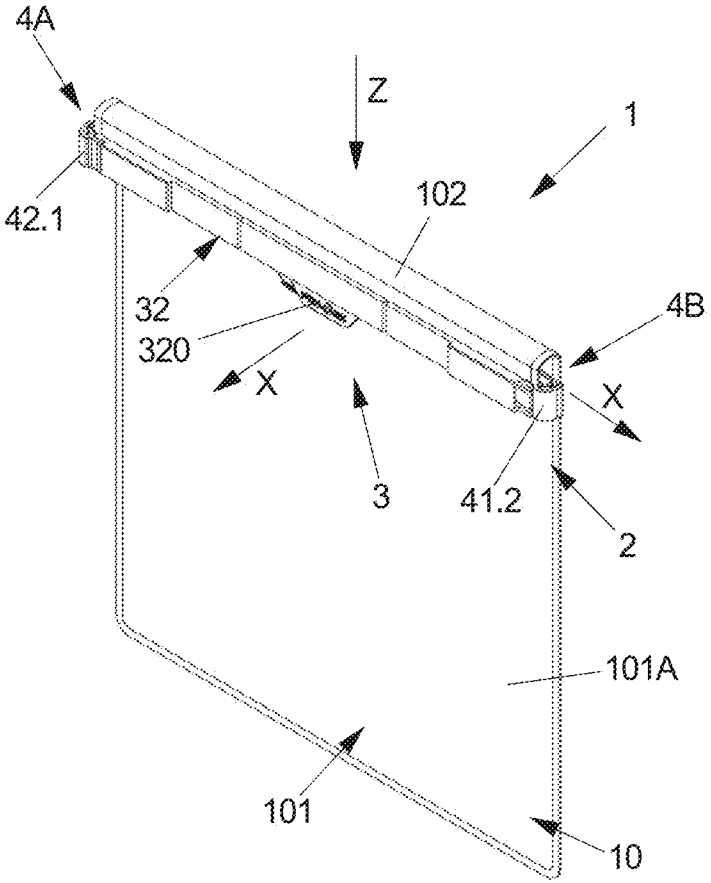
Figure 20A:
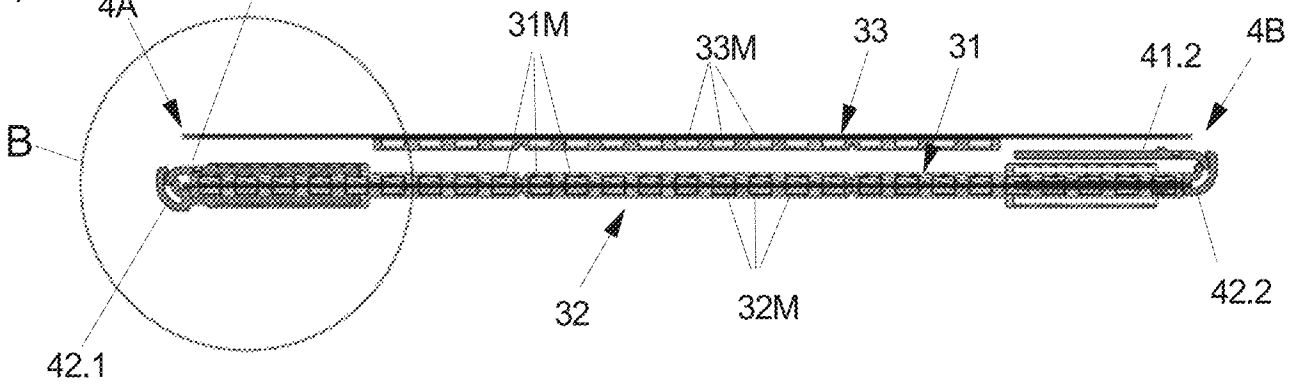
Figure 20B:
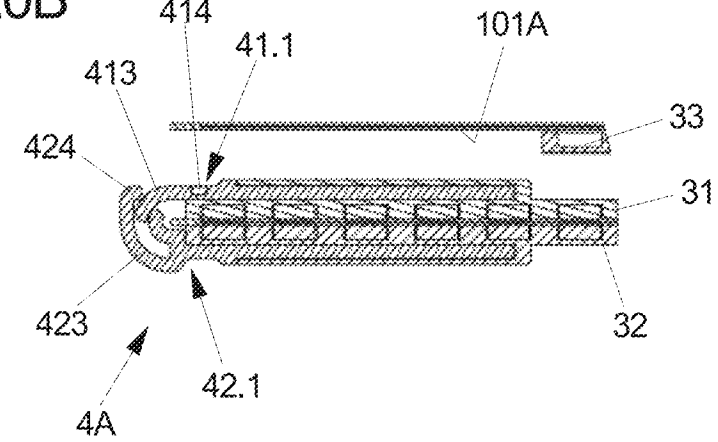
Figure 21:
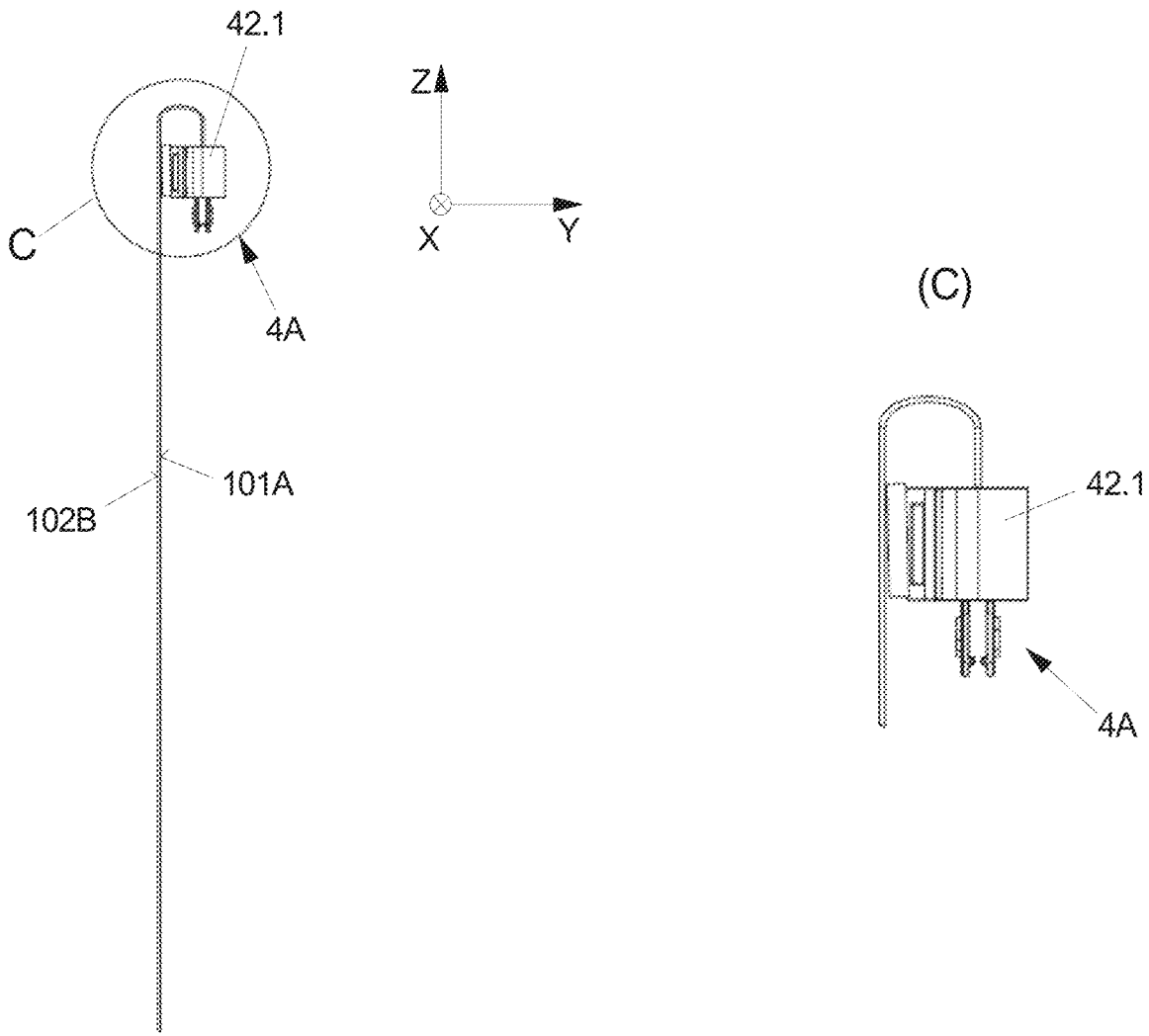
Figure 23:
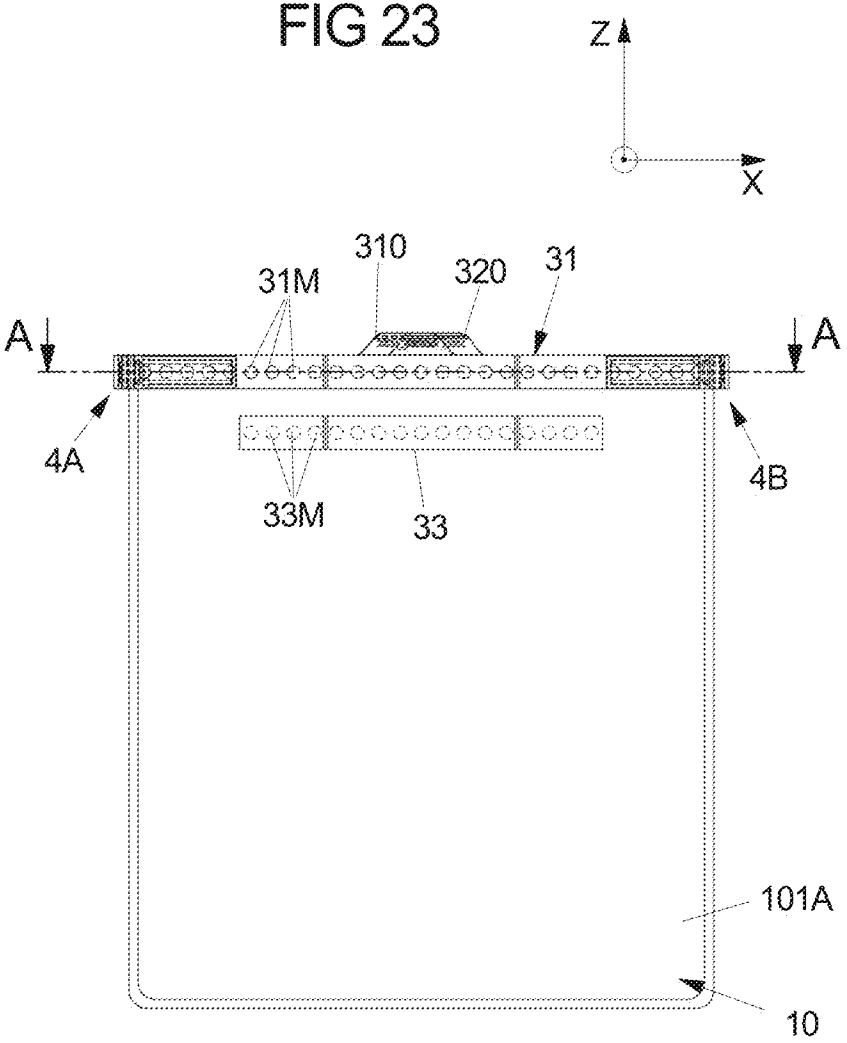
Figure 22:
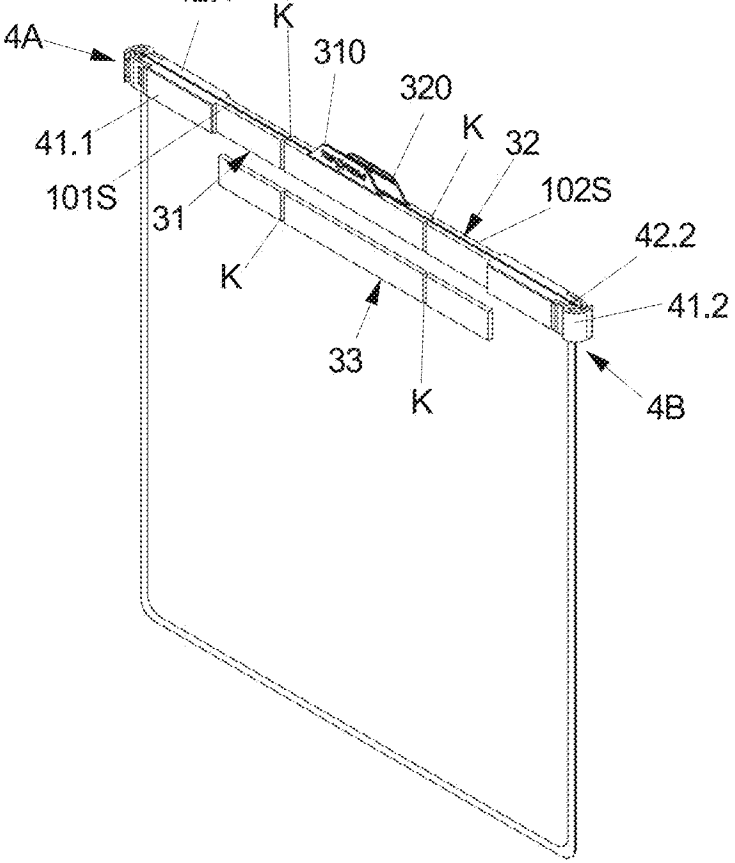
Figure 23A:
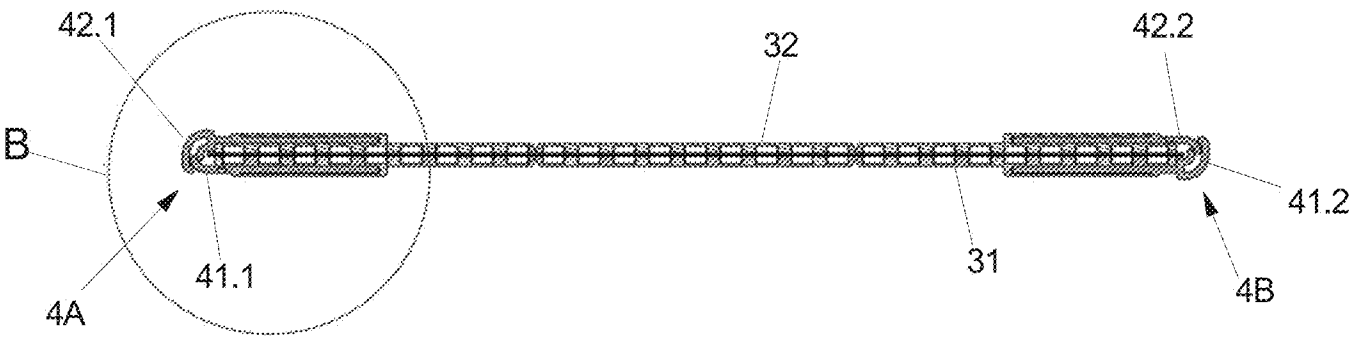
Figure 23B:
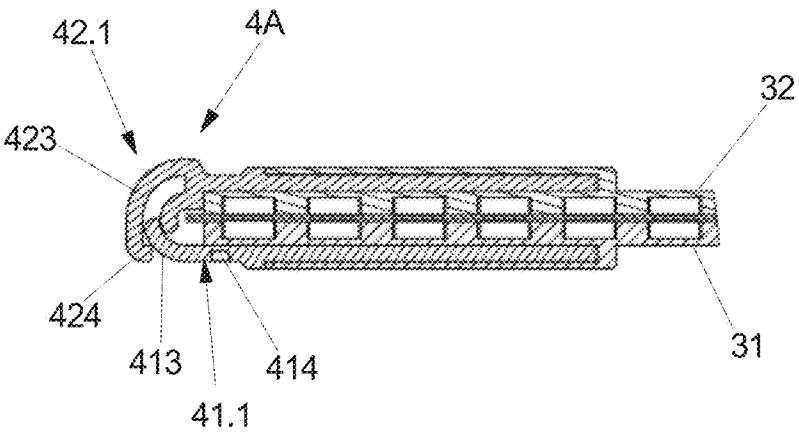
Figure 24:
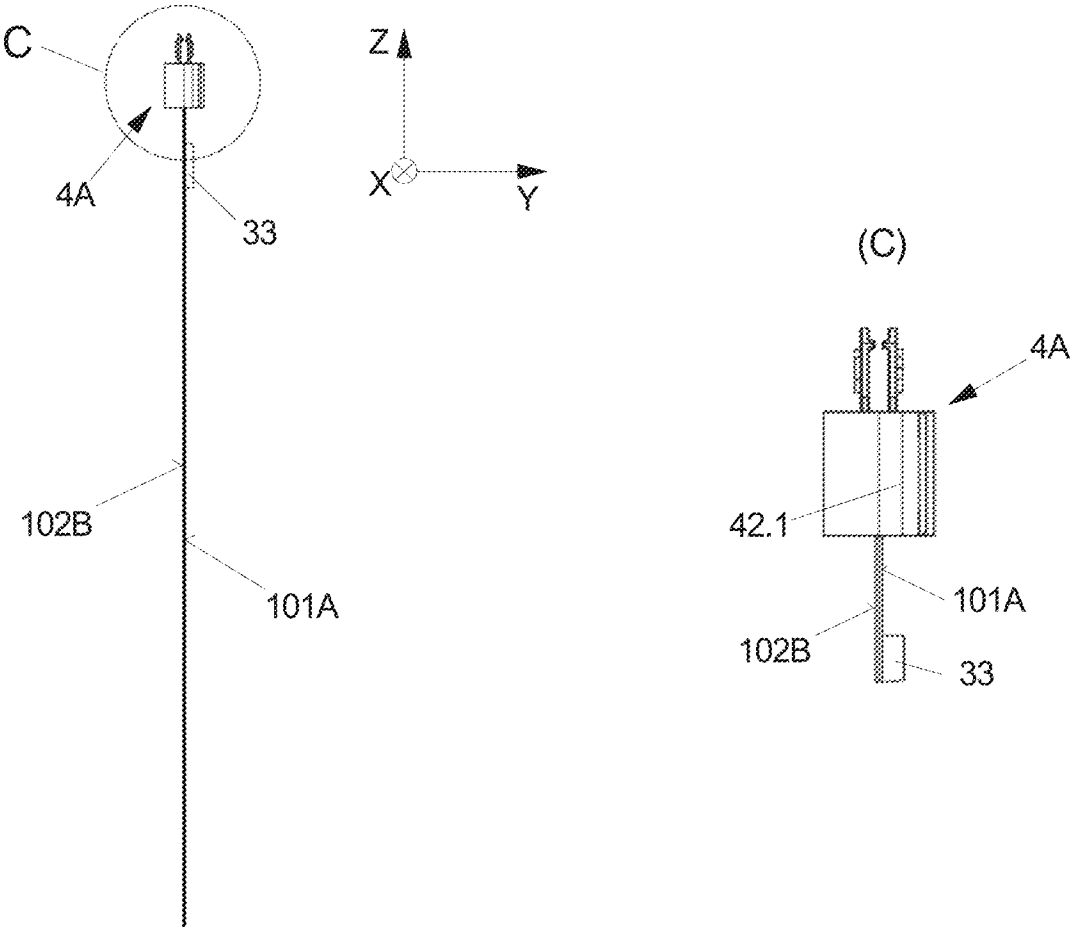
Figure 26:
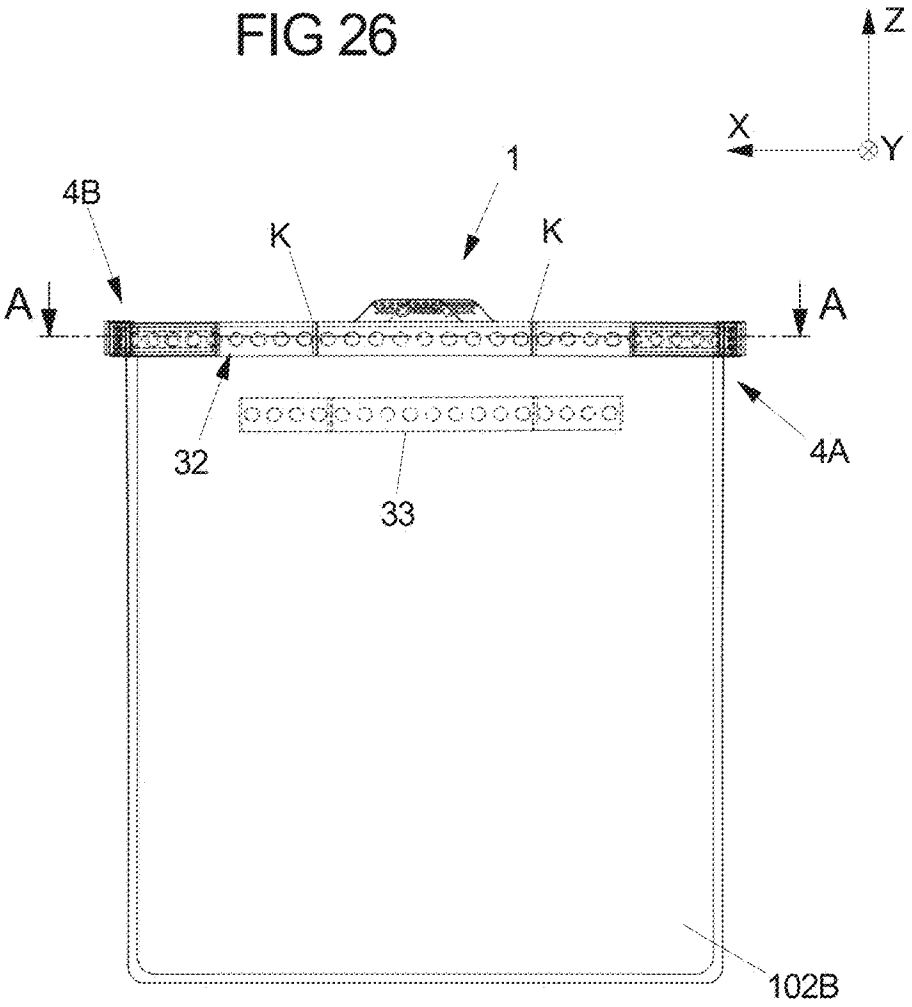
Figure 25:
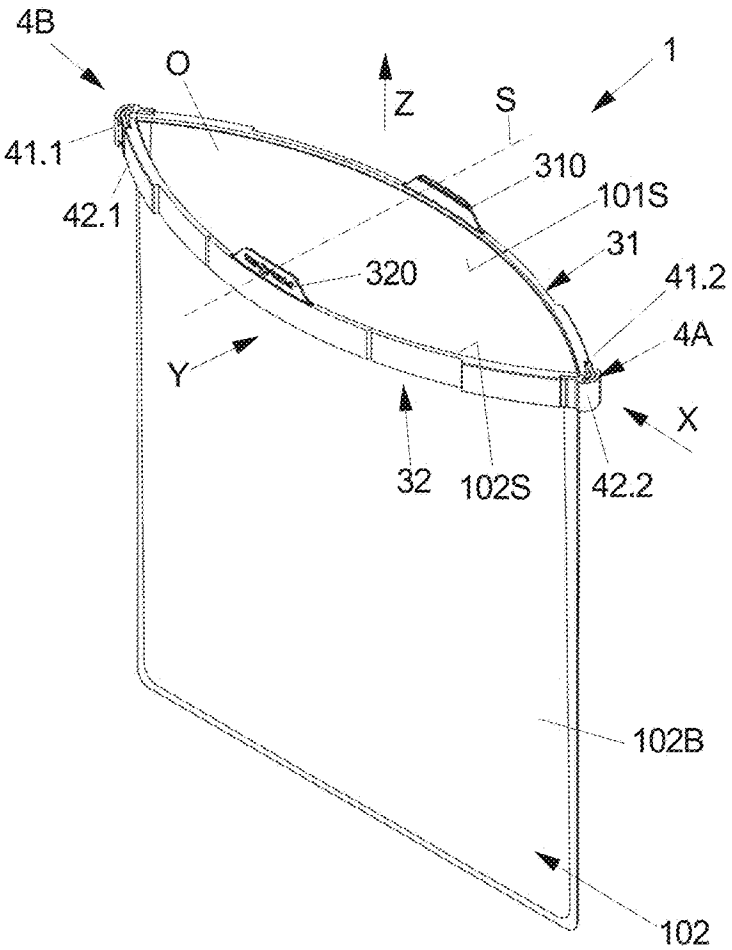
Figure 26A:
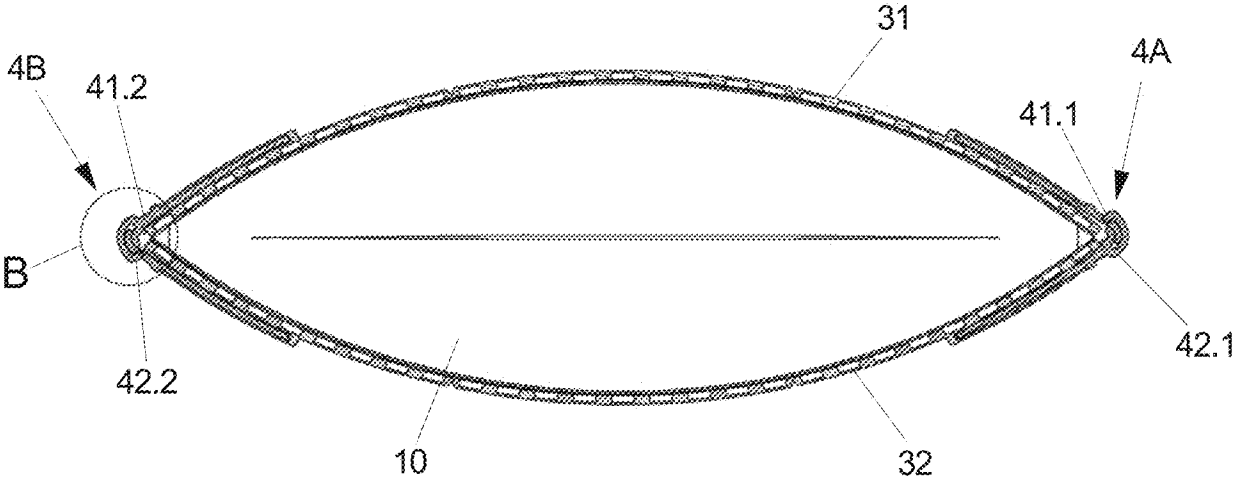
Figure 26B:
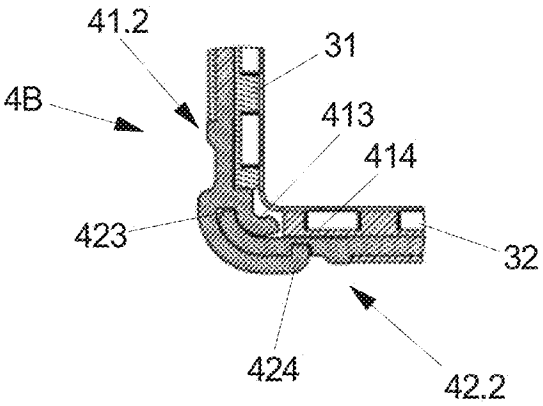
Figure 27:
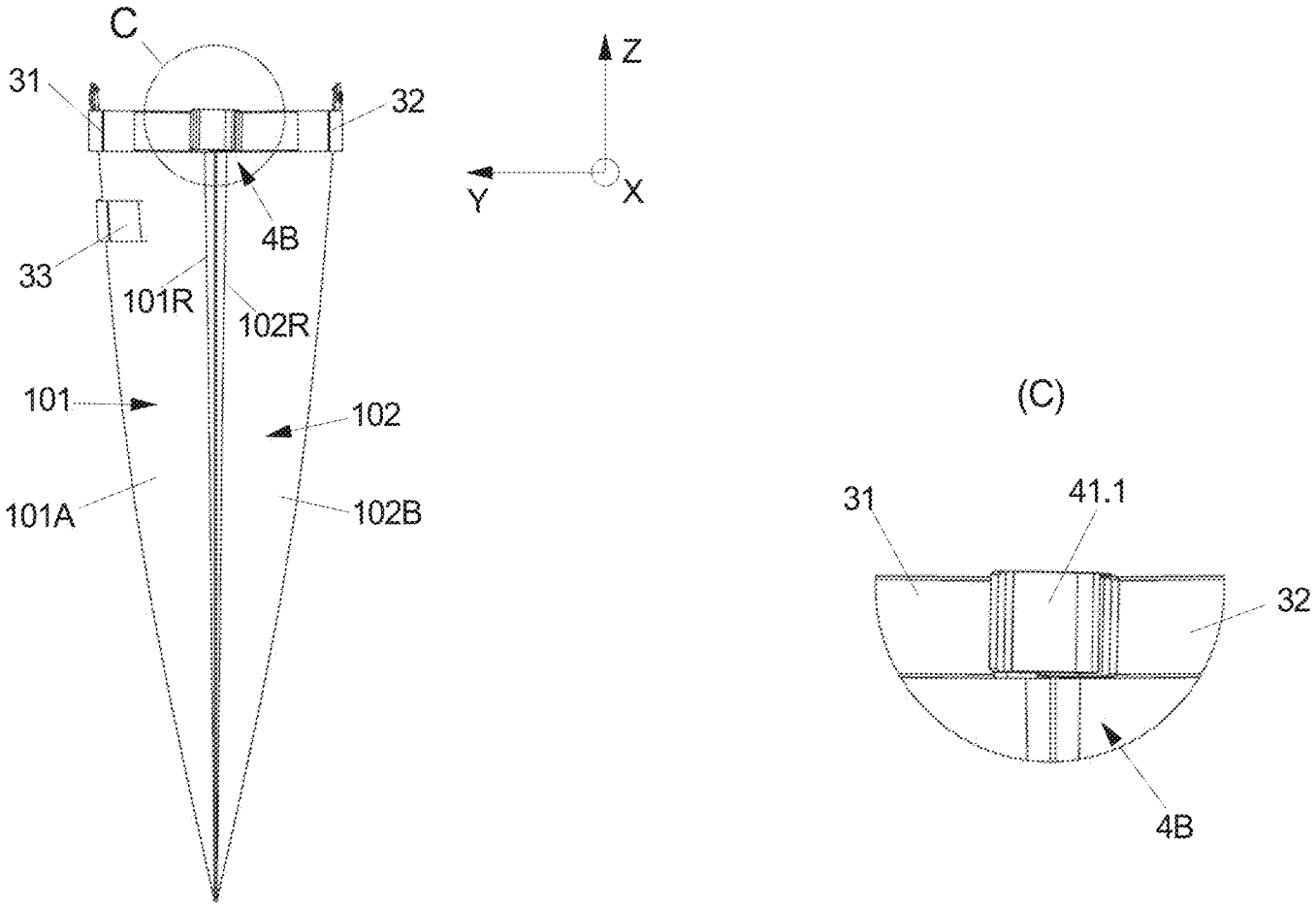
Figure 29:
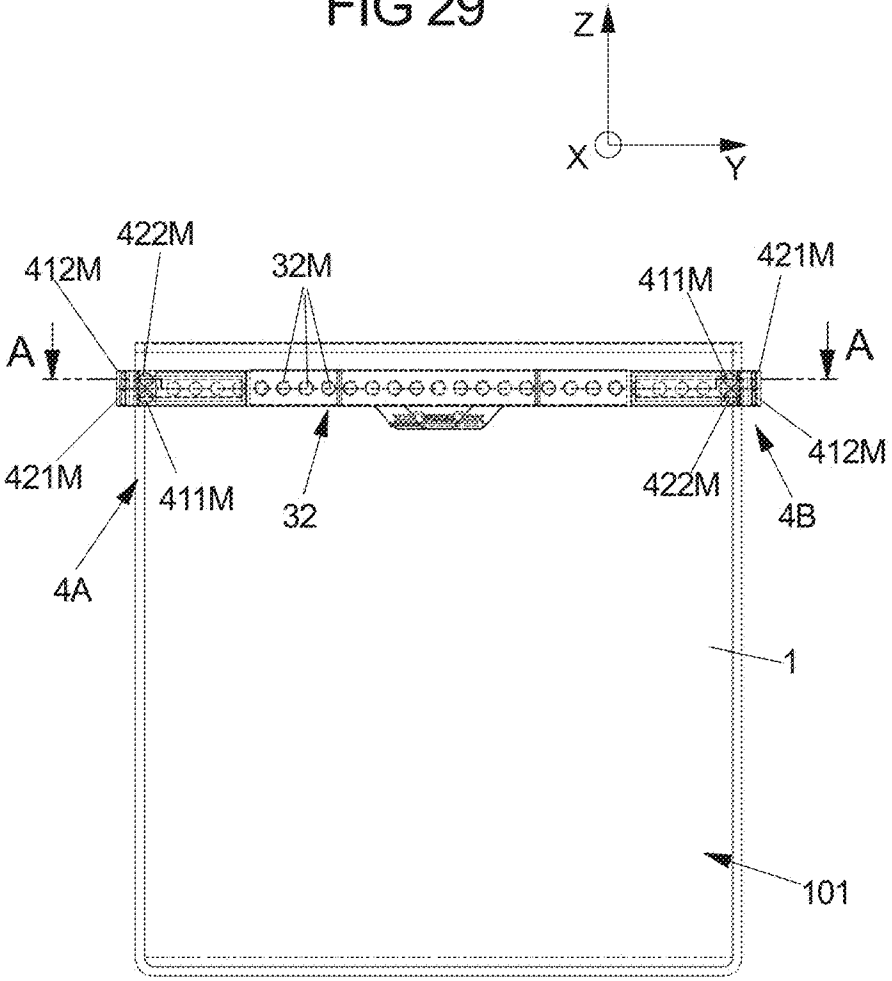
FIG. 28-36 show, in views corresponding to FIGS. 1 to 9, the storage device comprising a further variant of a proposed closure device.
Figure 28:
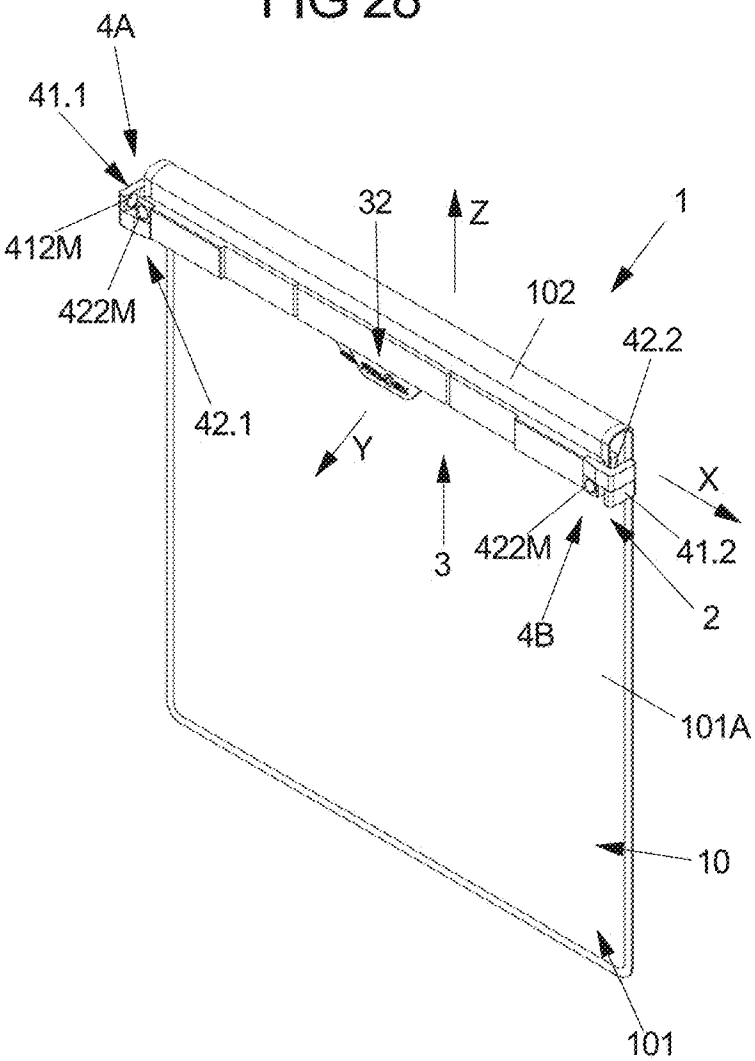
Figure 29A:
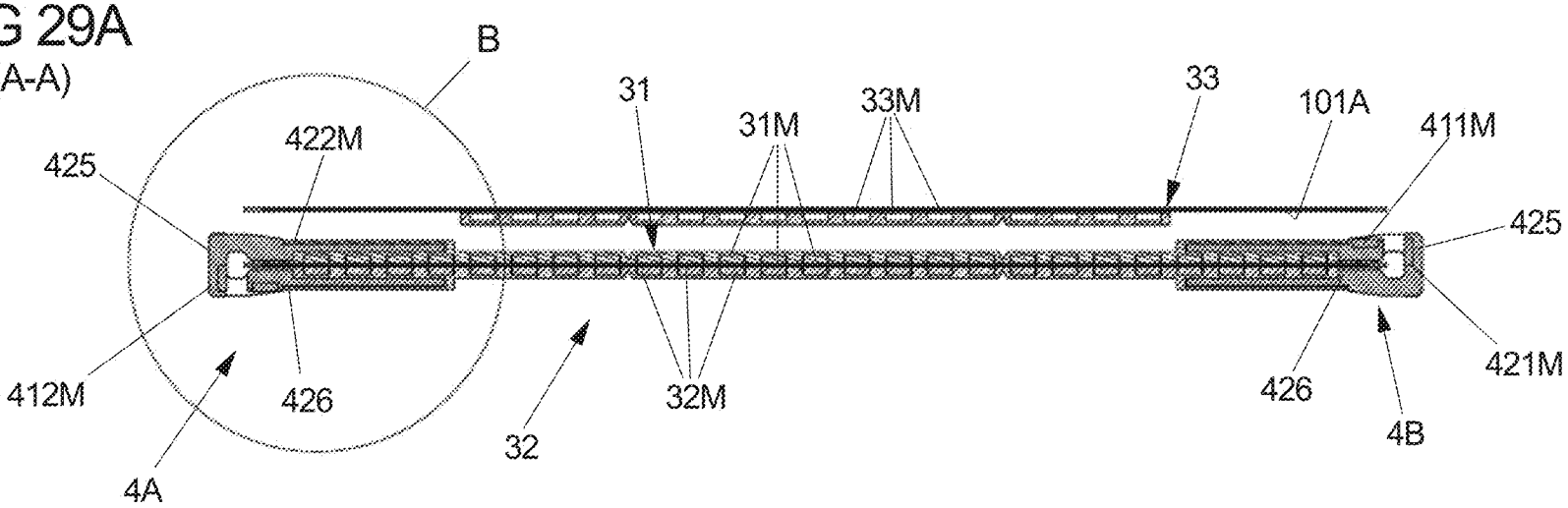
Figure 29B:
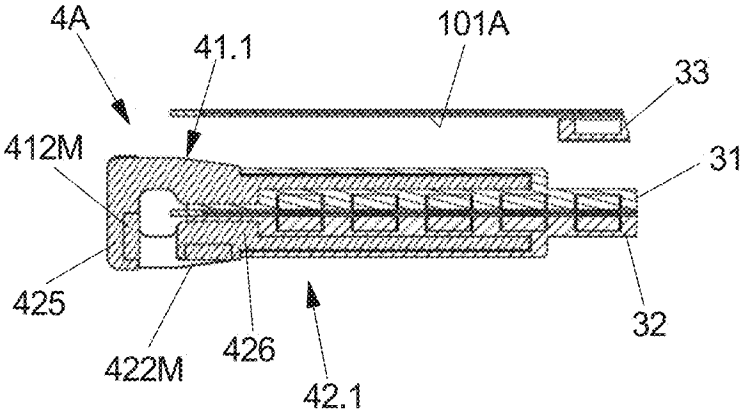
Figure 30:
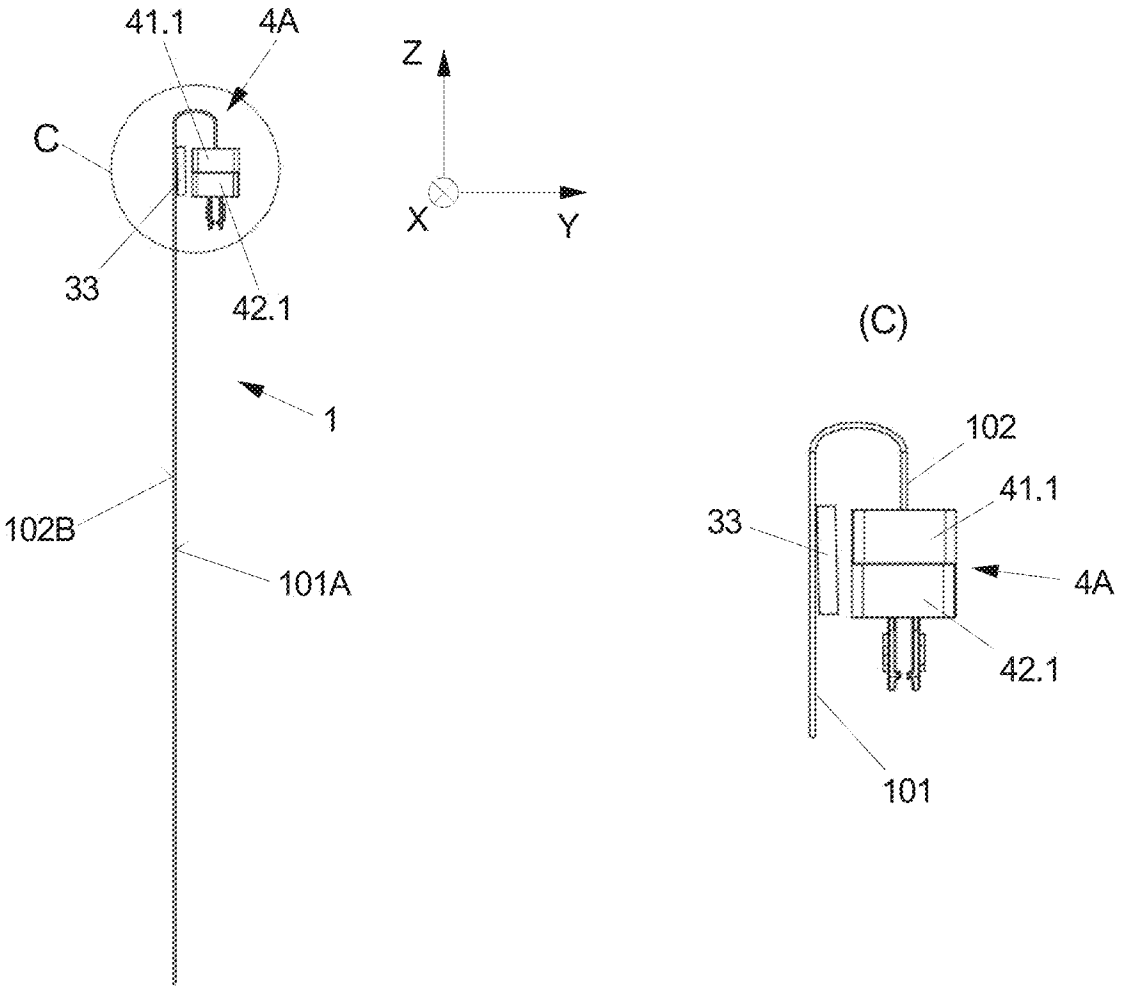
Figure 32:
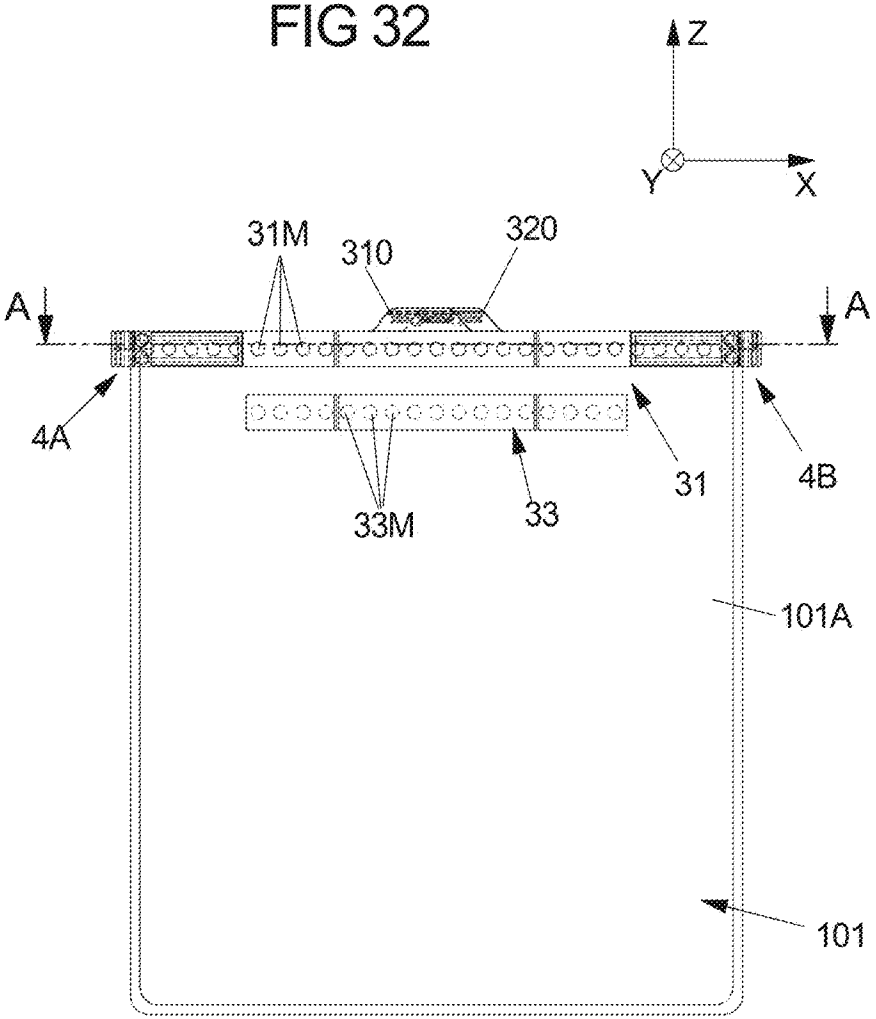
Figure 31:
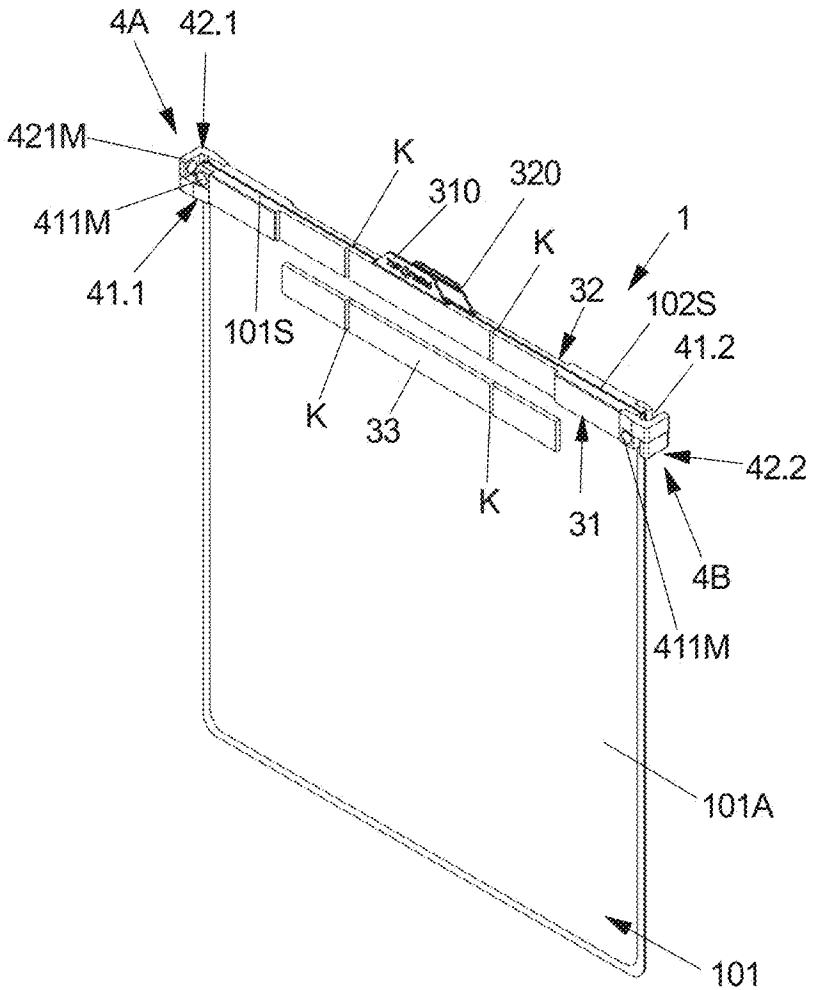
Figure 32A:
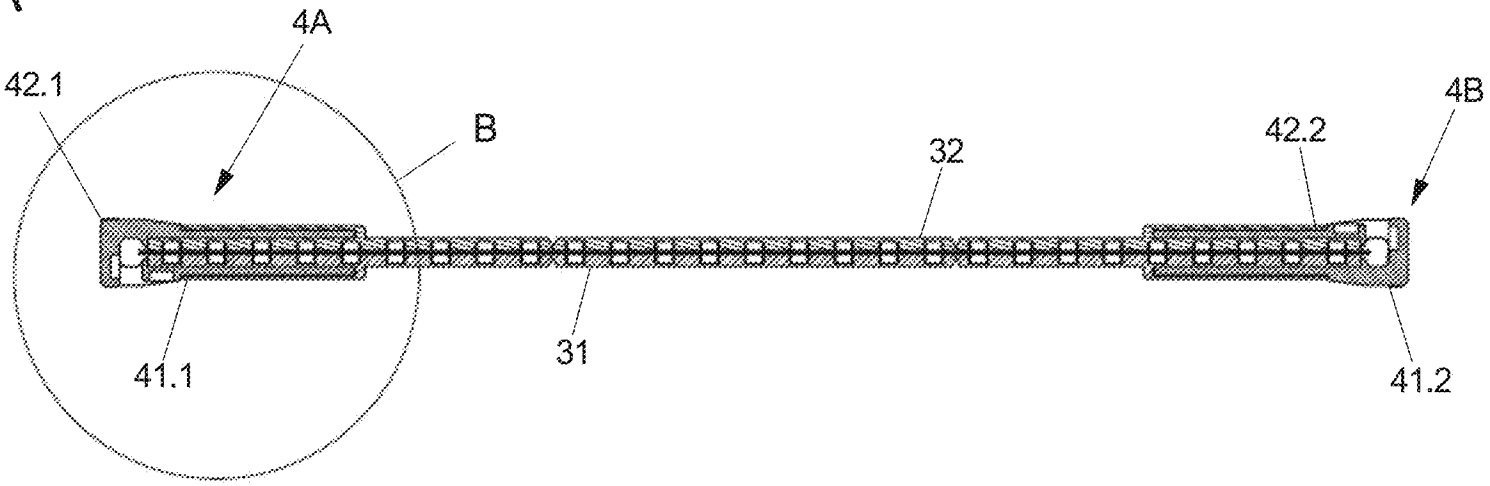
Figure 32B:
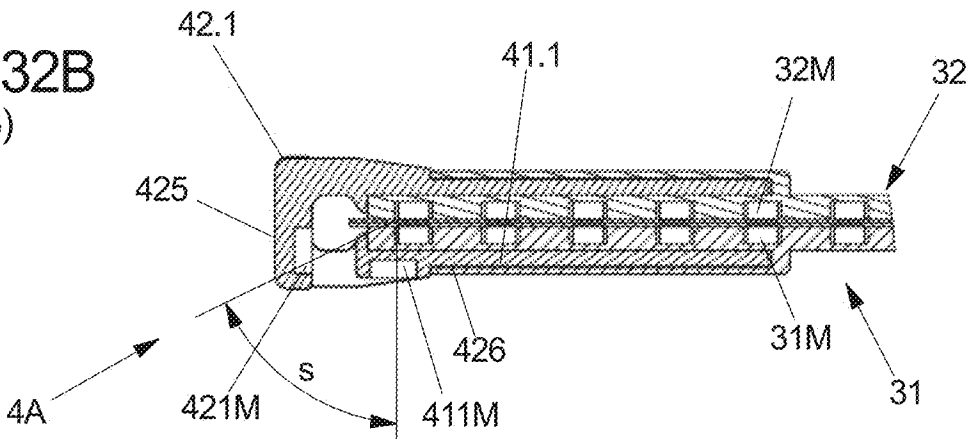
Figure 33:
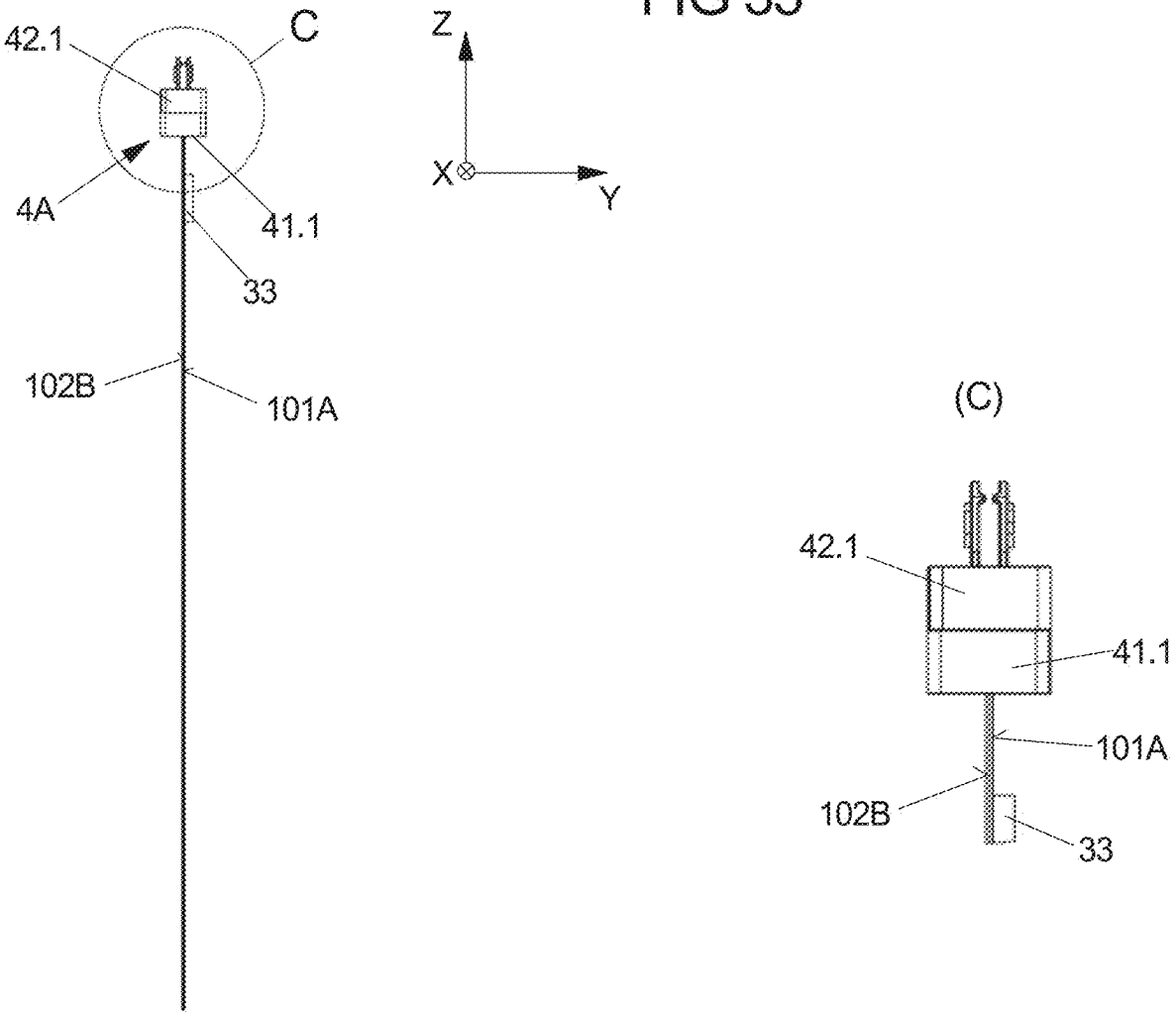
Figure 35:
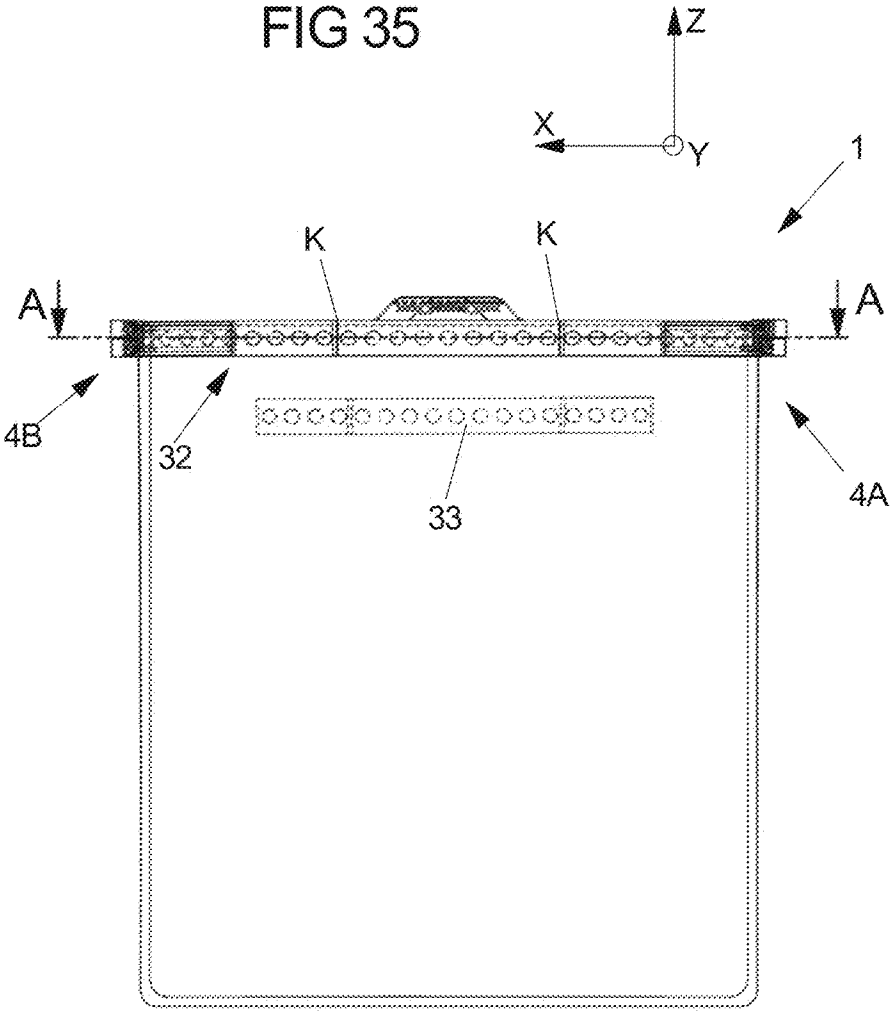
Figure 34:
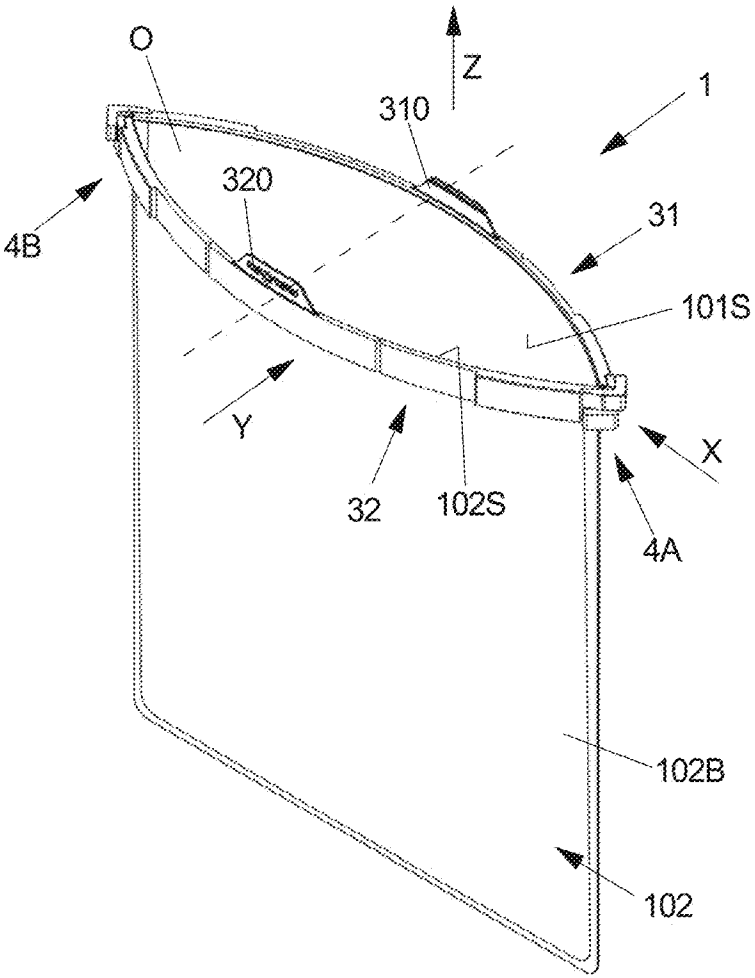
Figure 35A:
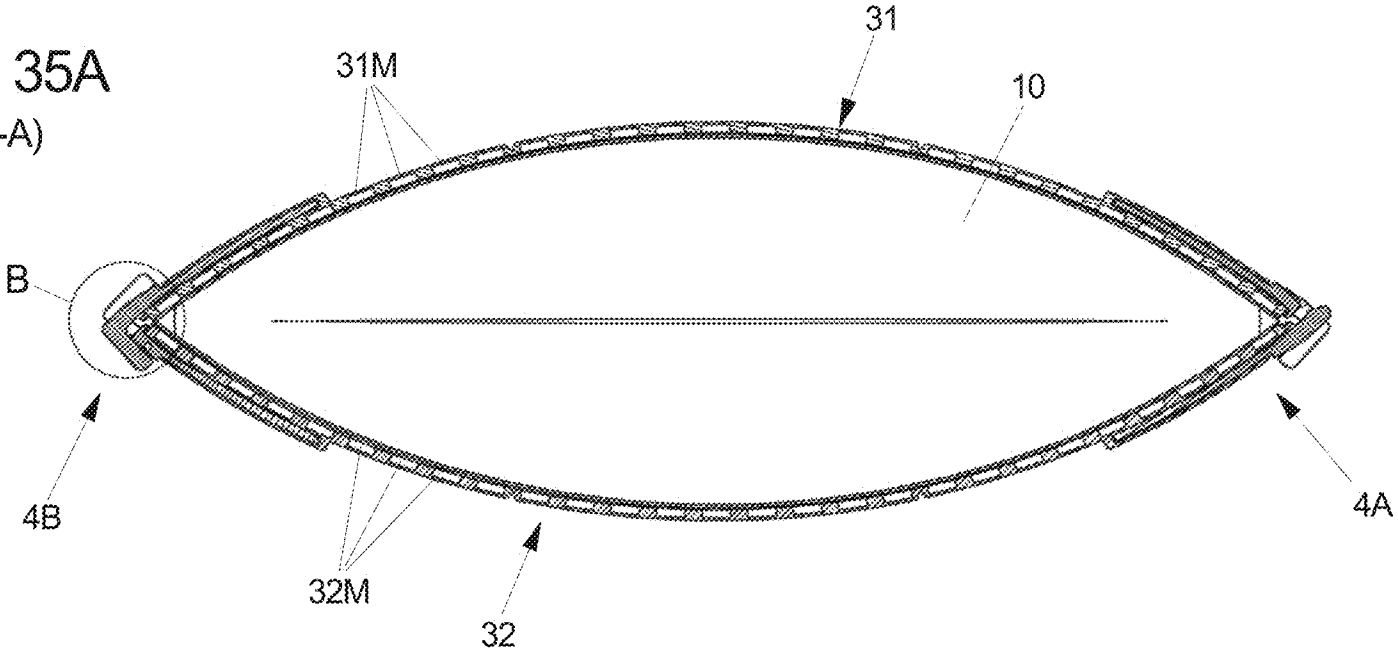
Figure 35B:
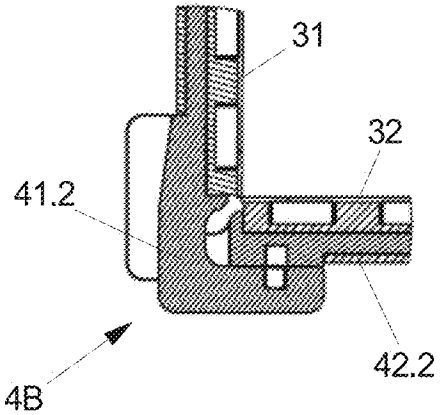
Figure 36:
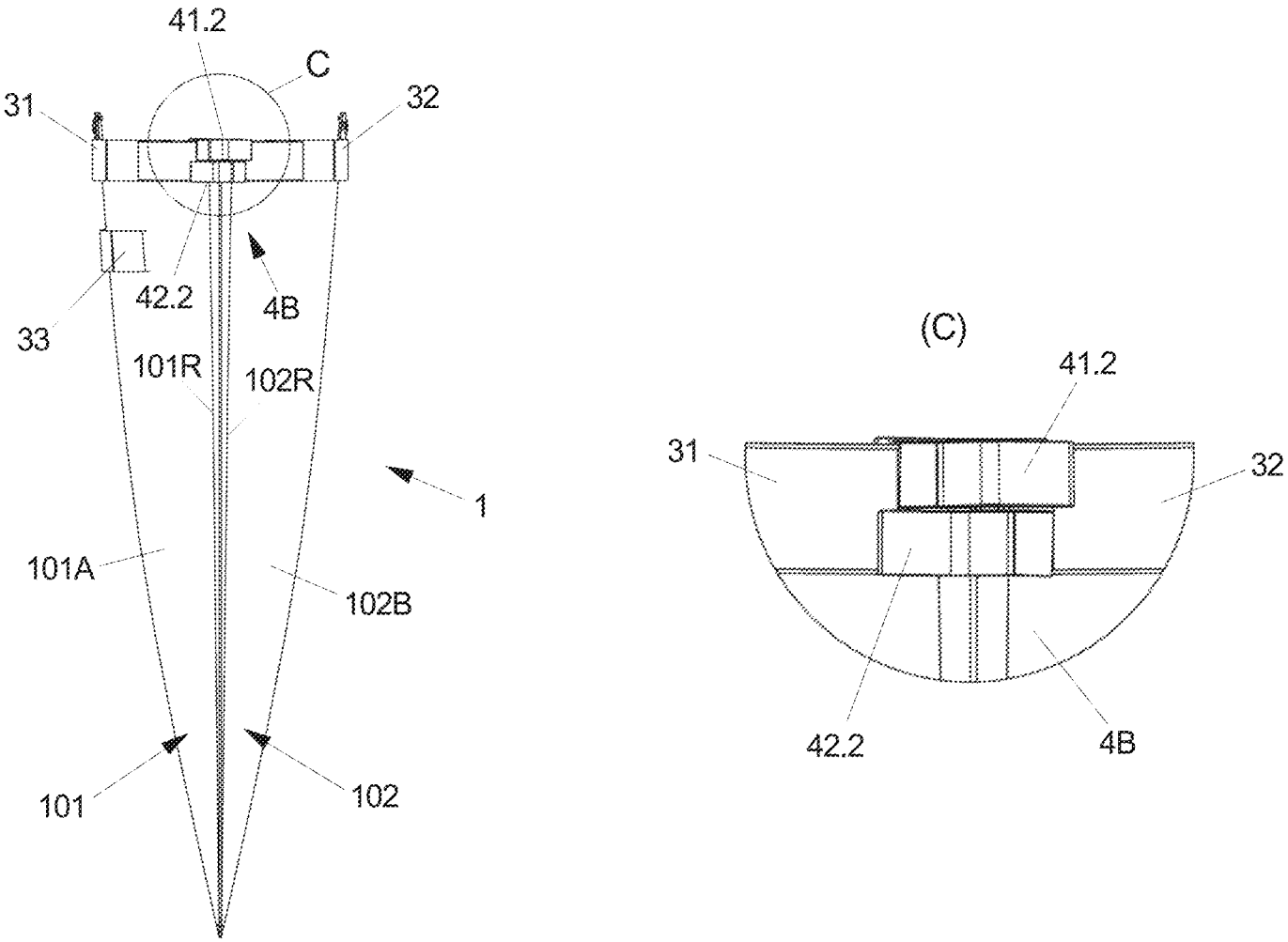
Figure 38:
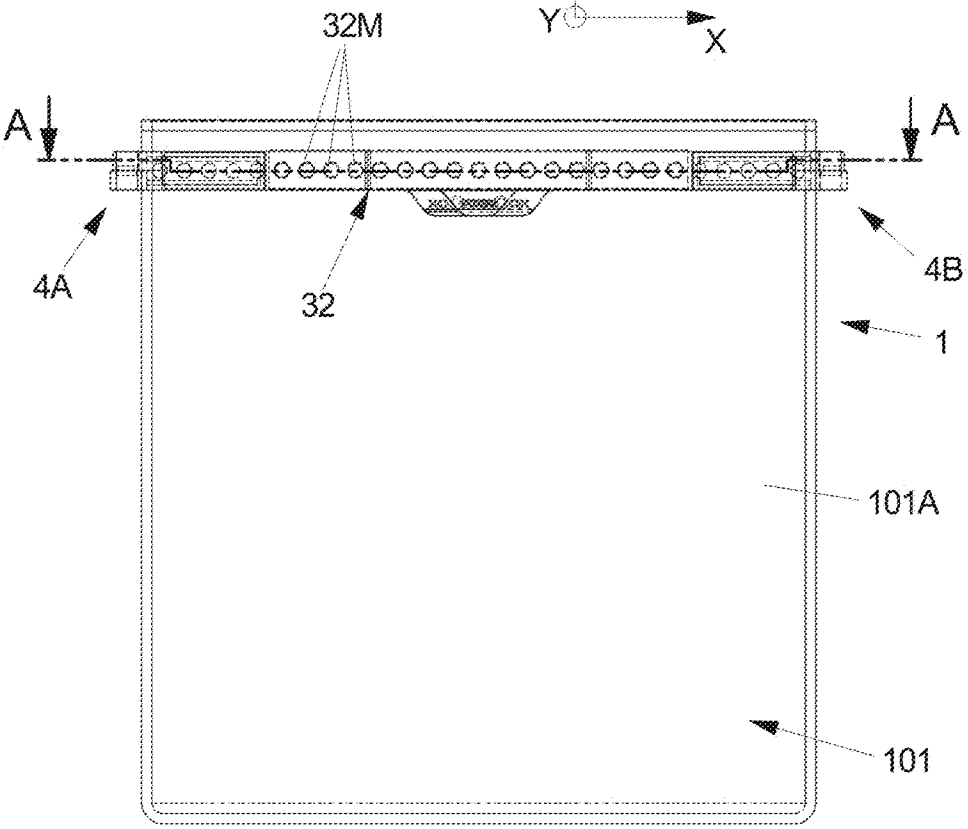
FIGS. 37-45 show, in views corresponding to FIGS. 1 to 9, the storage device comprising a further variant of a proposed closure device.
Figure 37:
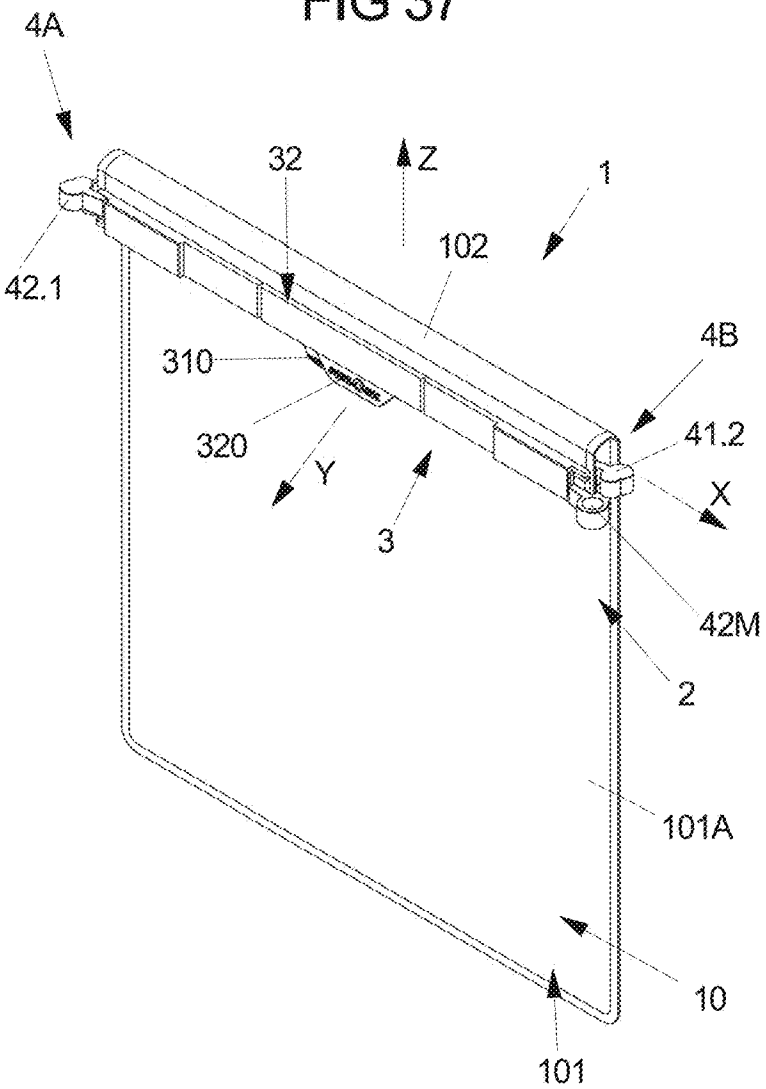
Figure 38A:
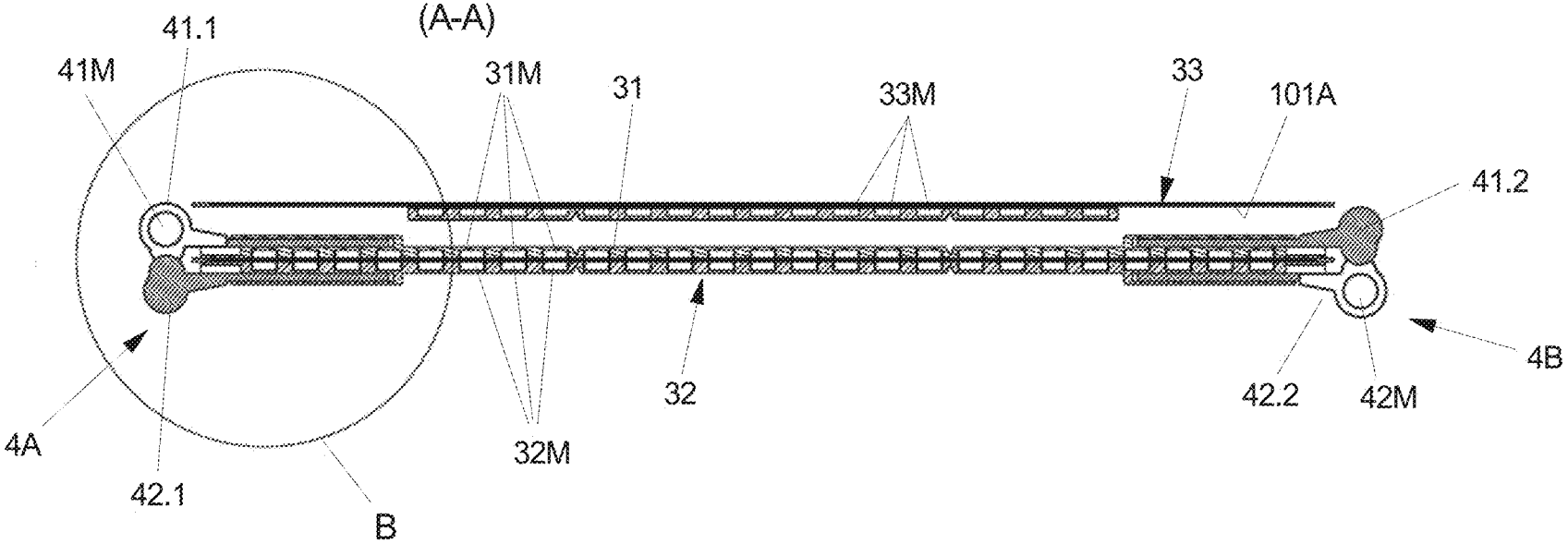
Figure 38B:
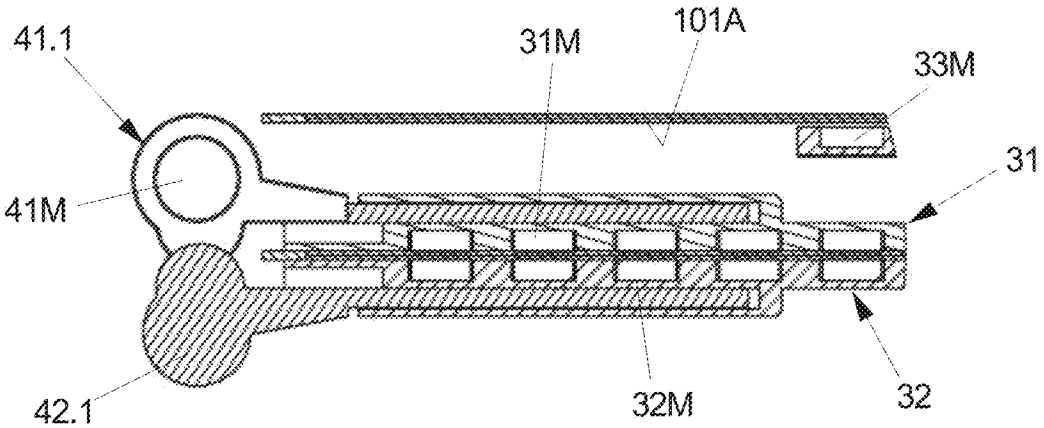
Figure 39:
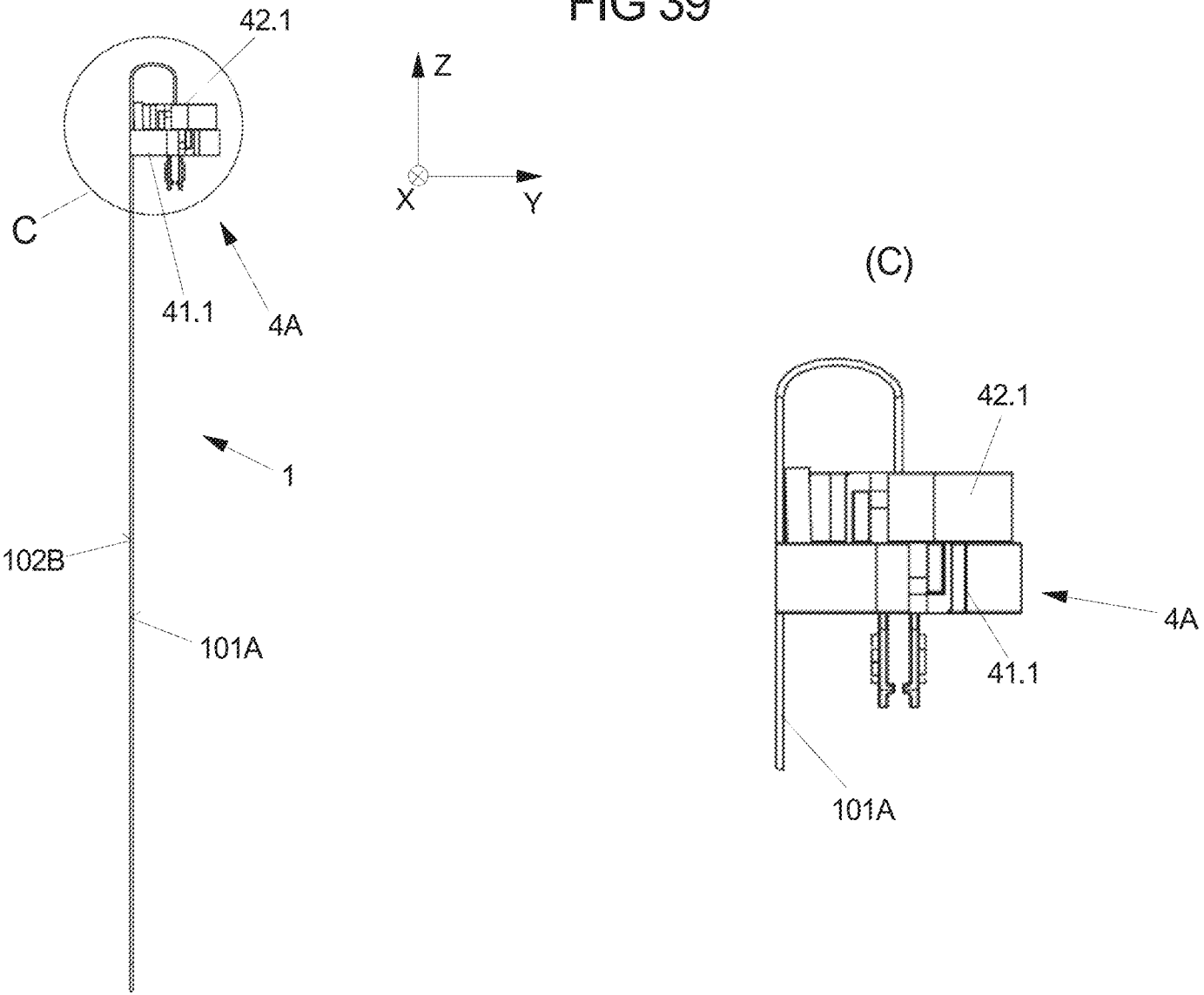
Figure 41:
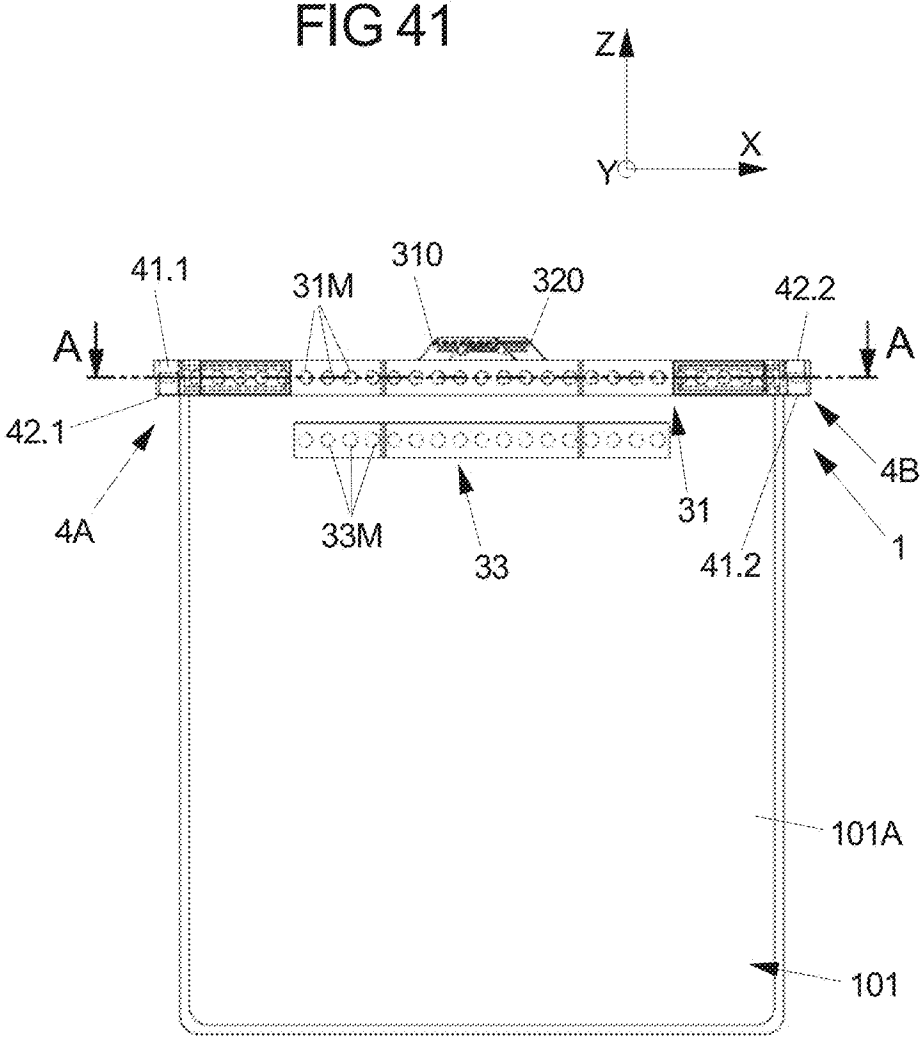
Figure 40:
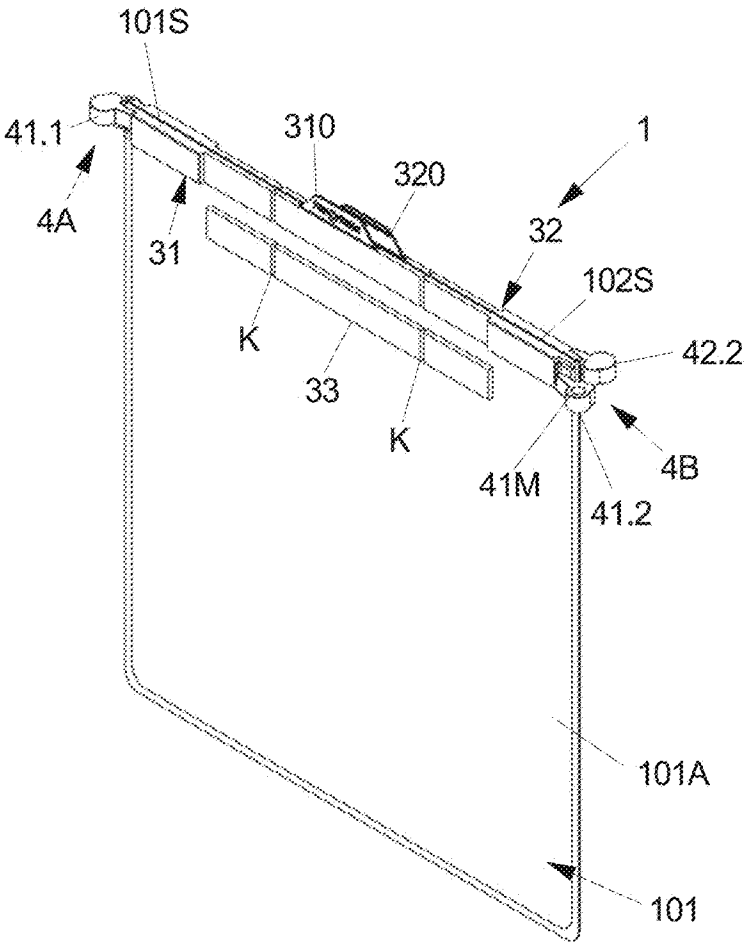
Figure 41A:
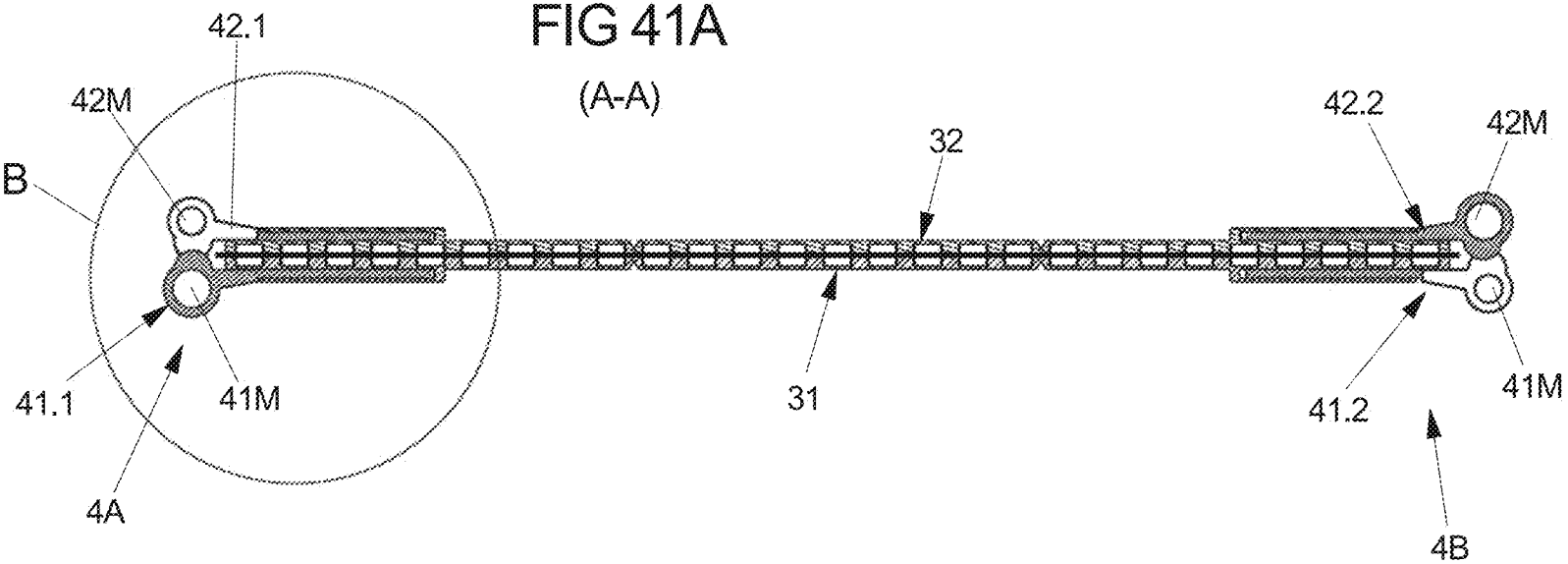
Figure 41B:
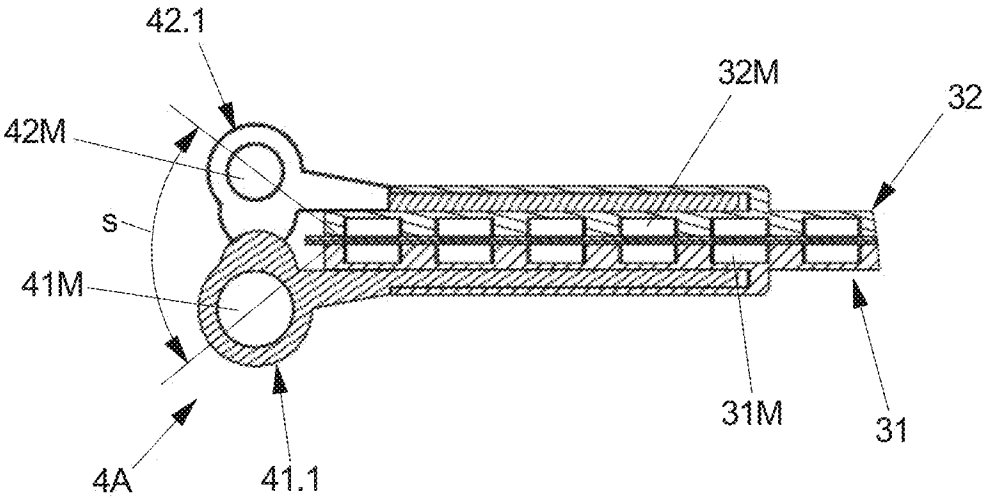
Figure 42:
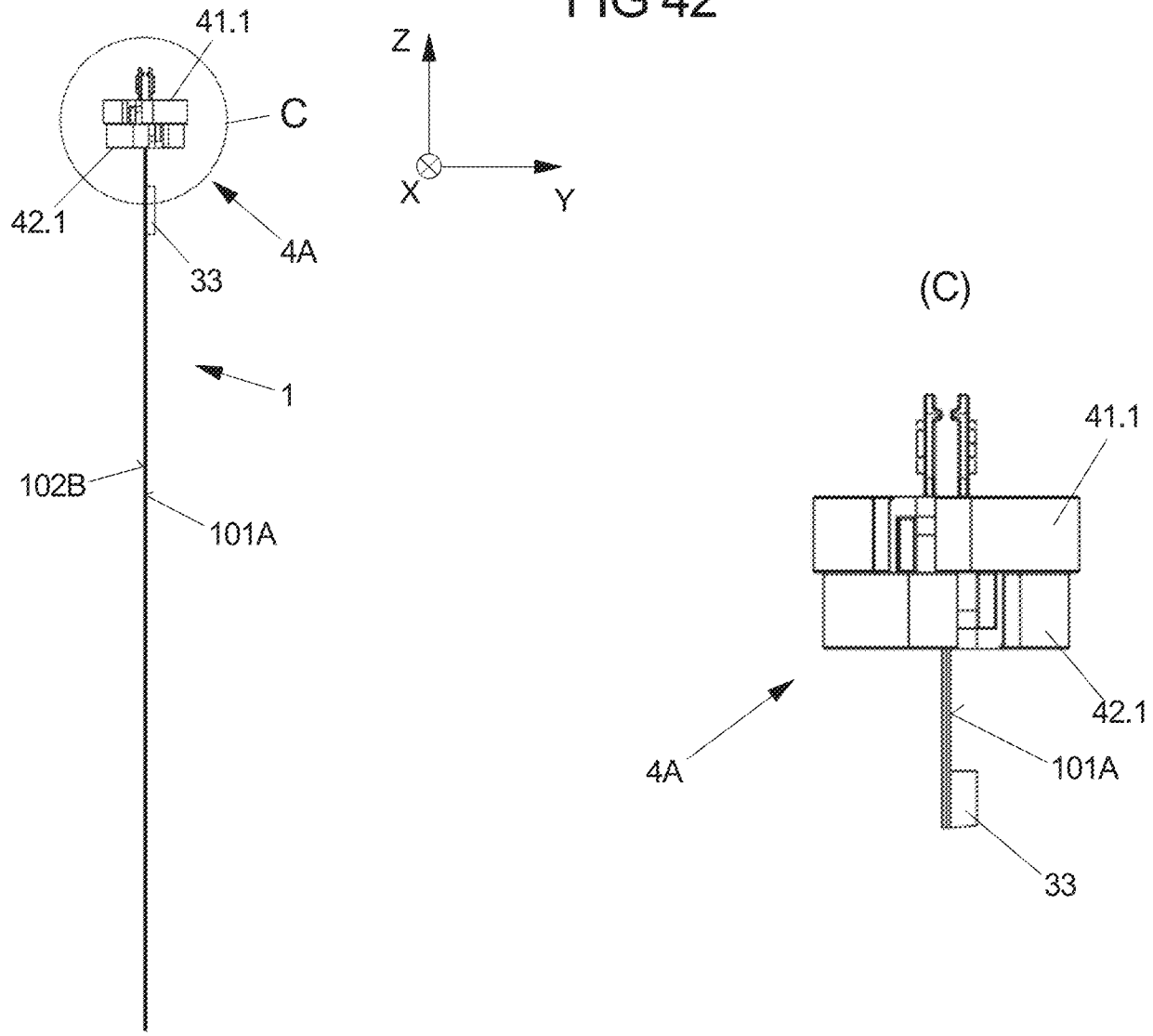
Figure 44:
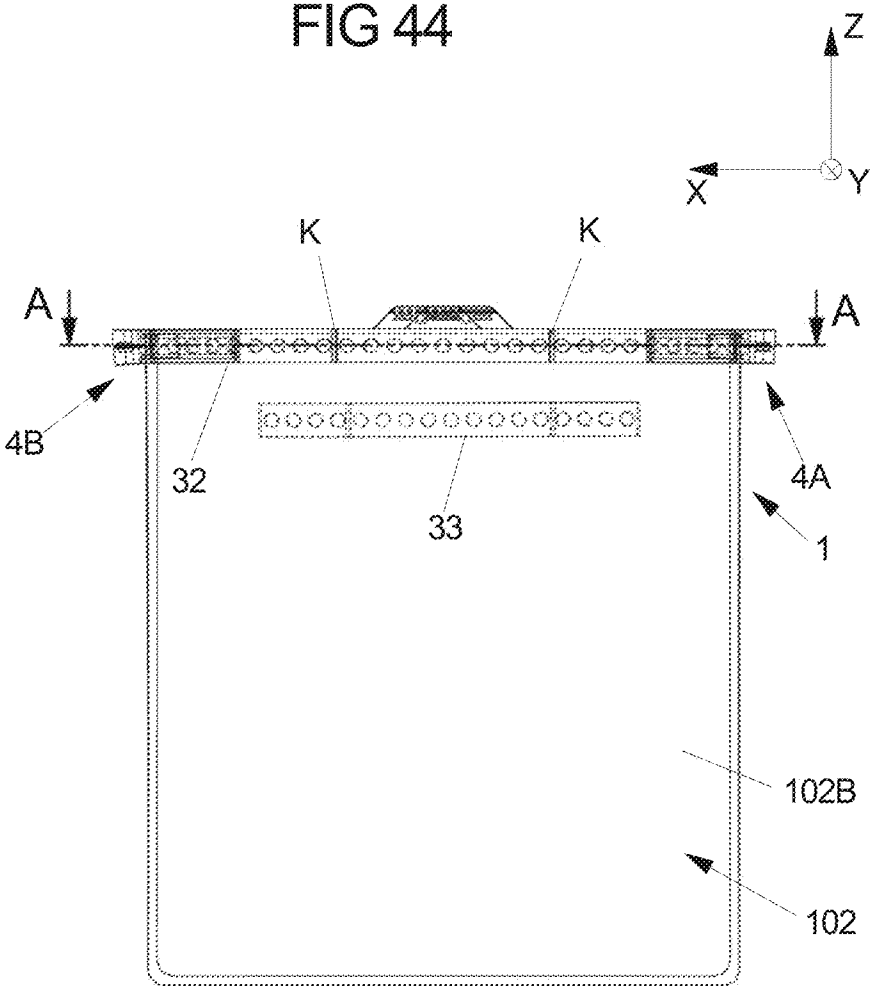
Figure 43:
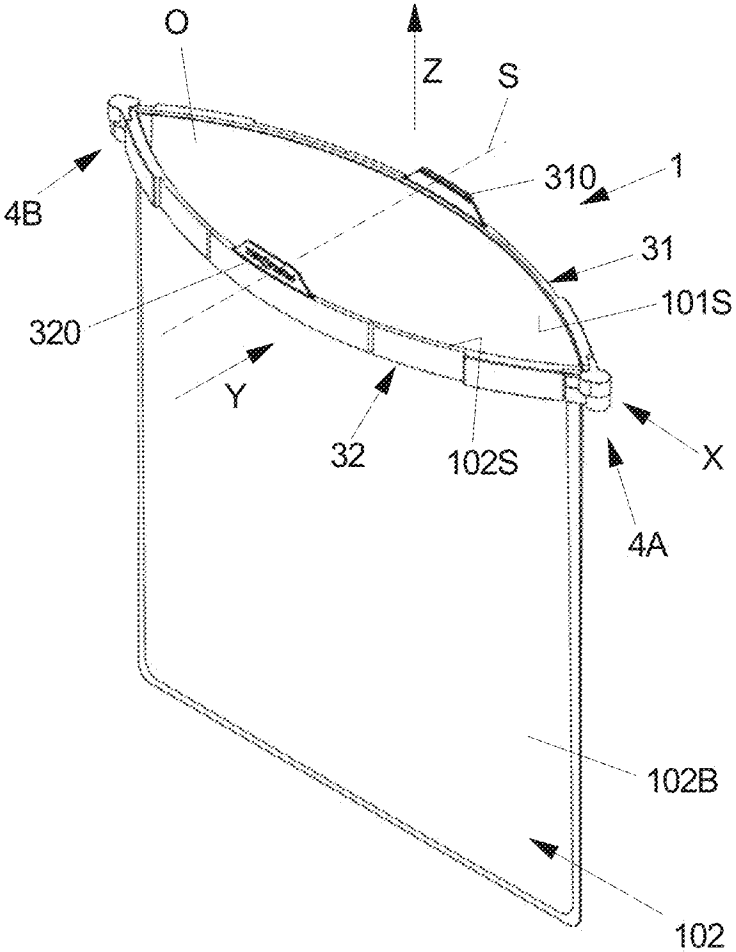
Figure 44A:
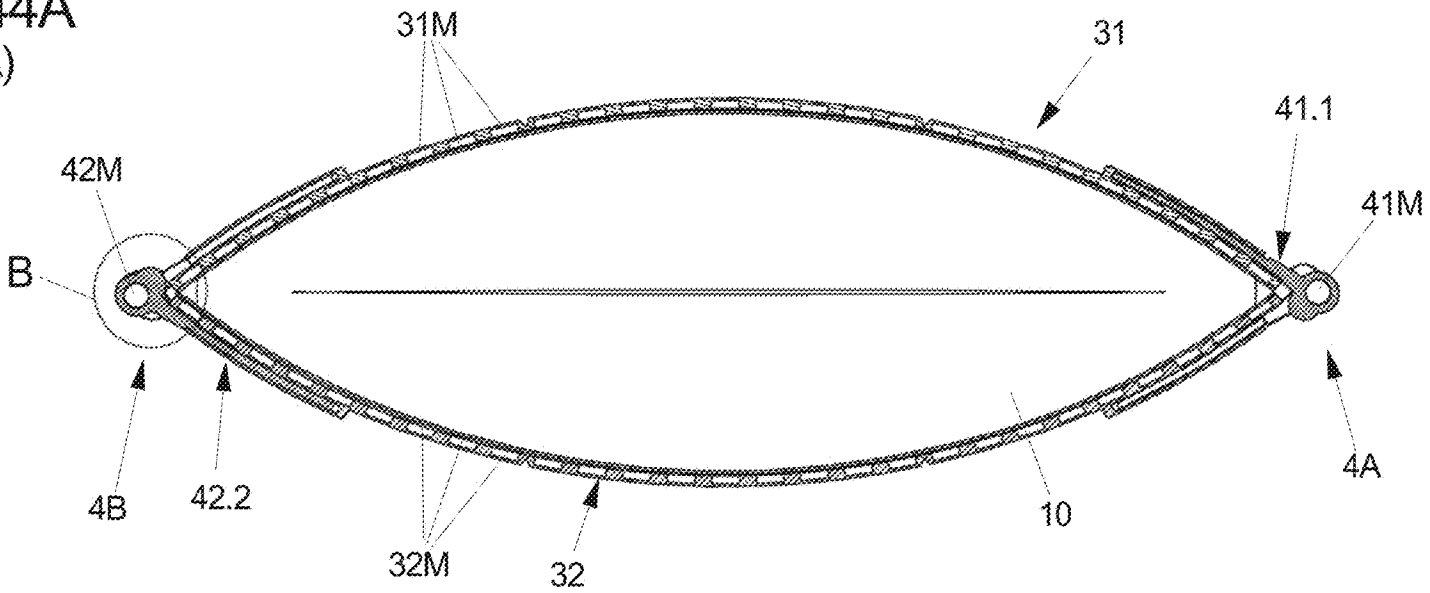
Figure 44B:
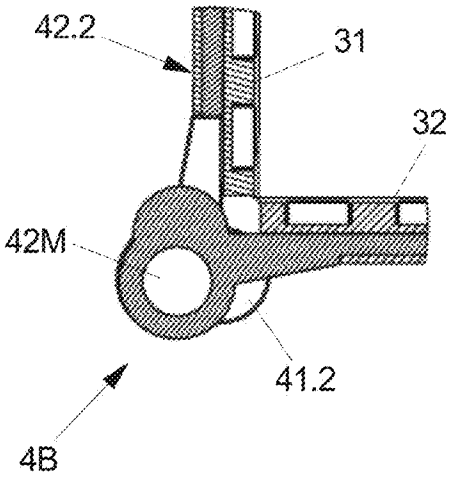

FIGS. 1 to 3 are various views of the storage device 1 having the closure device 2 in the closure position, in which the closure combination, formed by the first and second closure parts 31 and 32, is held in the closure position by means of the third closure part 33 on the front side 101A of the (first) wall 101. FIGS. 4-6 in turn show, in views corresponding to FIGS. 1 to 3, the storage device 1 having 2 the closure device in a folded-out release position. In said release position, the closure combination 3 is folded down from the third closure parts 33, such that the first and second closure parts 31 and 32 are displaceable away from one another, in order to release the opening O to the hollow body 10. FIGS. 7 to 9 show the storage device 1 having the closure device 2 and its first and second closure parts 31 and 32 in the open position. In this case, the views in FIGS. 7 to 9 are in each case rotated about 180° with respect to the views of FIGS. 4 to 6, such that for example FIGS. 7 and 8 each show a rear side 102B of the storage device 1, formed by the other, second wall 102.

In the open position, the two closure parts 31 and 32 are locked by two hold-open mechanisms 4A and 4B, such that the closure device 2 remains open, and thus the opening O remains accessible, without a user having to permanently apply a force manually to the closure parts 31 and 32. A hold-open mechanism 4A or 4B consequently applies an opening force which at least assists with the first and second closure parts 31, 32 assuming the open position and/or with the locking of the first and second closure parts 31, 32 in the open position. In the present case, a hold-open mechanism 4A or 4B is formed in each case, for this purpose, with two pairs of locking elements 41.1, 42.1 or 41.2, 42.2. In this case, the locking elements 41.1, 42.1 or 41.2, 42.2 of a hold-open mechanism are provided in each case spaced apart from one another in a rest position, in the closed position of the first and second closure parts 31 and 32 in accordance with FIGS. 4 to 6. When the closure parts 31 and 32 are displaced into the open position of FIGS. 7 to 9, the locking elements 41.1, 42.1 or 41.2, 42.2 are adjusted out of the rest position into a locking position, in which the open position of the closure parts 31 and 32 is locked by the locking elements 41.1 to 42.2, in pairs. For example, two locking elements 41.1, 42.1 or 41.2, 42.2 of a hold-open mechanism 4A, 4B of the closure device 2 interact magnetically, in order to lock the closure parts 31 and 32 in the assumed open position and to apply a holding force which must first be overcome by a user in order to adjust the closure parts 31 and 32 towards one another again, along the closing axis S, and thus to close the closure device 2.

In this case, first locking elements 41.1 and 41.2 of the two hold-open mechanisms 4A and 4B are in each case associated with the first closure part 31 and are fixed or shaped thereon. In this case, the first locking elements 41.1 and 41.2 in each case protrude beyond ends of the respective strip-shaped closure part 31 of the x-axis, referred to as the transverse axis, along which the first closure part 31 extends. Thus, each first locking element 41.1, 41.2 protrudes beyond a respective lateral edge 101R of the associated closing portion 101S, and thus of the associated wall 101. Analogously, second locking elements 42.1, 42.2 of the hold-open mechanisms 4A, 4B, which are provided on the second closure part 32, also protrude laterally beyond ends of the second closure part 32 and lateral edges 102R of the other closing portion 102S, and thus of the other wall 102, of the storage device 1.

In a closed position of the first and second closure parts 31 and 32, corresponding to FIGS. 4 to 6, the laterally protruding locking elements 41.1, 42.1 or 41.2, 42.2 of a hold-open mechanism 4A or 4B are angled and spaced apart from one another by a protruding portion, with respect to the transverse axis or the x-direction. When the first and second closure parts 31, 32 are transferred into their open position shown in FIGS. 7 to 9, the locking elements 41.1, 42.1 and 41.2, 42.2 are pivoted towards one another in pairs, and specifically about a pivot or hinge axis, in parallel with the vertical direction z, on the respective closing portion 101S or 102S. By means of the pivot movements associated with the opening of the closure device 2, the locking elements 41.1, 42.1 or 41.2, 42.2 of a respective hold-open mechanism 4A or 4B in each case bridge an adjustment path s, until the respective locking elements 41.1, 42.1 or 41.2, 42.2 have come into contact with one another and thus have assumed a locking position.

The assumption of said locking position is assisted by magnetic force. For this purpose, each locking element 41.1 to 42.2 comprises a magnet element 41M or 42M in the laterally protruding portion. In this case, the magnet elements 41M, 42M of a pair of locking elements 41.1, 42.1 or 41.2, 42.2 of a hold-open mechanism 4A or 4B interact with one another in a magnetically attracting manner. Consequently, if the respective locking elements 41.1, 42.1 or 41.2, 42.2 of a hold-open mechanism 4A or 4B are moved towards one another by a defined amount, by opening the closure device 2, the magnetic force applied by the magnet elements 41M, 42M is sufficiently great to automatically adjust the locking elements 41.1, 42.1 or 41.2, 42.2 towards one another, into the locking position visible in FIGS. 7 to 9.

The holding force applied by the hold-open mechanisms 4A, 4B is then also defined by the applied magnetic attractive force in the locking position, which holding force must be overcome on the user side in order to adjust the first and second closure parts 31 and 32 back in the direction of the closed position, and thus to close the opening O again. In this case, the holding force that is applied magnetically by the magnets 41M, 42M of a hold-open mechanism 4A or 4B acts substantially in parallel with the closing axis S, and thus along the y-axis or in parallel with the y-direction.

In the case of the storage device shown in FIGS. 1 to 9, an elongate locking element 41.1-42.2 is provided on a respectively associated first or second closure part 31 or 32, without in this case extending over the entire length of the respective closure part 31 or 32, and thus additionally stiffening the respective closure part 31 or 32, apart from a respective lateral end of the respective closure part 31 or 32. Furthermore, in the present case the closure parts 31 and 32 are in each case formed from a material that is inherently non-flexible or at least flexible only to a certain extent, in particular in order to assist with flat contact of the closing portions 101S, 102S in the closed position of the first and second closure parts 31 and 32, in particular in order to assist with sealing contact of the closing portions 101S and 102S. In order to ensure a bulge of the closure parts 31 and 32 as well as of the third closure part 33 when opening the storage device 1, in each case weakening regions in the form of notches K are provided purposely on the closure parts 31, 32, 33. In the region of the respective notches K, the material of which the respective closure part 31, 32 or 33 is formed is purposely reduced, such that portions of the respective closure part 31, 32 or 33 are connected in an articulated manner via a notch K in the manner of a film hinge, and thus so as to be displaceable relative to one another.

In a variant, it is also possible for a plurality of separate (smaller or shorter) closure parts to be provided in a manner separated from one another in the transverse direction. Said closure parts would then be completely separated from one another in the region of a notch K. In this case, however, a more flexible region of a respective closing portion 101S or 102S or the wall 101 or 102 forming the respective closing portion, could act as a film hinge.

In a further variant of FIGS. 10 to 18, alternatively configured hold-open mechanisms 4A and 4B are provided. If, here or in the figures explained in greater detail in the following, identical reference signs are used, these also refer to identical components and functional elements.

For example, the variant of FIGS. 10 to 18 again provides a pair of locking elements 41.1, 42.1 or 41.2, 42.2 in each case, for each hold-open mechanism 4A and 4B, via which locking elements the closure parts 31 and 32 are locked in their open position. Here, too, the locking elements 41.1, 42.1 or 41.2, 42.2 interact in pairs, in a magnetically attracting manner, in order to lock the open position of the closure parts 31 and 32. In contrast to the variant of FIGS. 1 to 9, in this case, in a locking position, magnetic forces of magnet elements 411M, 422M; 412M, 421M on the locking element side act along an effective axis extending perpendicularly to the closing axis S and thus in parallel with the vertical direction z. Thus, in the case of a displacement of the first and second closure parts 31, 32 out of their closed position into the open position, the corresponding magnet elements 411M, 422M and 412M, 421M are then also displaced beyond one another at least in part, until the respective locking position is assumed. For example, in each case one first magnet element 412M or 422M of a locking element is then arranged on an end of the respective closure part 31 or 32, on a portion of the respective locking element that surrounds the respective lateral edges 101R, 102R at least in part. A second magnet element 411M or 421M, with which the first magnet element 422M or 412M interacts, in a magnetically attracting manner, in the locking position for locking the open position, is provided so as to be spaced apart therefrom, on the respective other locking element. In this way, a sufficiently high magnetic attractive force for automatically transferring the locking elements 41.1, 41.2 or 41.2, 42.2 further into the locking position and for holding them in the locking position acts between the first and second magnet elements 412M, 421M and 422M, 411M only by means of a displacement of the locking elements 41.1, 41.2 or 41.2, 42.2 in the direction of the locking position.

In this case, the first magnet elements 412M, 422M of the locking elements 41.1, 42.1 or 41.2, 42.2 of a hold-open mechanism 4A, 4B, which magnet elements are arranged on the partially surrounding and thus projecting portions, can also be polarized opposingly to one another, such that the first magnet elements 412M, 422M, in the closed position of the closure parts 31 and 32, assist with holding the locking elements in the rest position.

The first or second locking elements 41.1, 41.2 (for the first closure part 31) or 42.1, 42.2 (for the second closure part 32), which are associated with a closure part 31 or 32, are configured to be offset from one another in the present case. That is to say that a first locking element 42.1 on the first hold-open mechanism 4A is positioned and pivotable under the second locking element 42.1, based on the vertical direction z, while the first locking element 41.2 on the other hold-open mechanism 4B is arranged and pivotable above the second locking element 42.2 there.

In particular in a development of the variant of FIGS. 10 to 18, a hold-open mechanism 4A and/or a hold-open mechanism 4B can additionally integrate a latching device, by means of which the locking position assumed by a respective pair of locking elements 41.1, 42.1 or 41.2, 42.2 is additionally secured. For this purpose, a displaceably mounted latching pin (or another form-fitting connection element) is then provided for example on one of the locking elements, which pin can plunge in a form-fitting manner into a latching opening or a latching hole of the other locking element, at least in part, when the locking position is reached. If the locking elements are intended to be adjustable again, relative to one another, and thus the closure parts 31, 32 are intended to be adjustable out of the open position, first of all the latching pin must be pushed or pulled out of the latching opening or the latching hole. Instead of a latching pin in combination with a latching opening or a latching hole, other latching components can of course also be provided (of which at least one is adjustably mounted), by means of which in particular form-fitting and/or force-fitting latching of two locking elements 41.1, 42.1 or 41.2, 42.2 of a hold-open mechanism 4A, 4B can be achieved.

The variant of FIGS. 19 to 27 provides hold-open mechanisms 4A, 4B of the closure device 2 in which locking of the closure parts 31 and 32 in their open position takes place not magnetically, but rather purely mechanically. For this purpose, in each case a first locking element 41.1 or 41.2 engages, with a laterally protruding guide web 413, into a curved guide channel 423 of a second locking element 42.1 or 42.2 of the respective hold-open mechanism 4A or 4B. The guide web 413 is guided in the respective guide channel 423, in the case of a displacement of the locking elements 41.1, 42.1 or 41.2, 42.2 out of their rest position and into the locking position. In this way, when the locking position is assumed, a latching element configured in the form of a latching lug 424 on a guide channel wall of the respective guide channel 423 can latch in a form-fitting manner into a latching opening, configured as a latching groove 414, of the associated guide web 413 as soon as the locking position is assumed. Thus, in the variant of FIGS. 19 to 27, the open position of the first and second closure parts 31 and 32 is locked by mechanical latching of the two locking elements 41.1, 42.1 or 41.2, 42.2 of a respective hold-open mechanism 4A and 4B.

If a sufficiently high actuating force is applied in order to displace the latching lugs 424 out of their respective latching grooves 414, the locking is released and the closure parts 31 and 32 can be brought back into their closed position, along the closing axis S.

In the variant of FIGS. 28 to 36, each locking element 41.1 to 42.2 is equipped with two magnets 411M, 412M or 421M, 422M in each case, in order to lock the open position of the closure parts 31 and 32 in a manner assisted by magnetic force. In this case, each locking element 41.1 to 42.2 in each case comprises a support arm 425, which in each case surrounds the lateral edges 101R, 102R in part, on a long side of the storage device 1. In each case a first magnet element 412M or 421M is provided on said support arm 425. Upon transfer of the first and second closure parts 31, 32 into the open position, and thus opening of the closure device 2, the respective support arm 425 is brought into contact with a base 426 of the respective other locking element, by performing a pivot movement. A magnetic force applied by a magnet pair 412M, 422M or 411M, 421M, in each case, of a hold-open mechanism 4A or 4B then acts, in the assumed locking position, at an angle relative to the closing axis S and thus at an angle relative to the y-direction, in the present case e.g. at an angle of approximately 45°. However, in this embodiment the magnetic force then acts again (as e.g. also in the embodiment of FIGS. 1-9) in a normal plane with respect to a hinge axis, about which the respective locking element 41.1 to 42.2 is pivotable out of the rest position and into the locking position.

In the case of the variant of FIGS. 28 to 36, too, the locking elements 41.1, 42.1; 42.1, 42.2 on the hold-open mechanisms 4A and 4B of a closure part 31 or 32 are configured to be twisted relative to one another, such that for example a first locking element 41.1 of the first closure part 31 rests on one hold-open mechanism 4A, with respect to the vertical direction z, having its support arm 425 under the support arm 425 of the second locking element 42.1 of said hold-open mechanism 4A, while the first locking element 41.2 of the first closure part 31 rests on the other hold-open mechanism 4B having its support arm 425 above the support arm 425 of the second locking element 42.2 of the other hold-open mechanism 4B. Thus, a base-side magnet element 411M or 421M in each case is then also positioned so as to be offset in each case, relative to a carrier arm-side magnet element 412M or 421M of the same locking element 41.1-42.2, based on the vertical direction z.

In a deviation from the variant shown in FIGS. 28 to 36, it is of course also possible for a locking element 41.1-42.2—in the present case L-shaped in cross section—to be provided on an opening mechanism 4A or 4B merely on one of the first or second closure parts 31, 32, which locking element is pivotable about a hinge axis in parallel with the spatial direction z, when the closure parts 31, 32 are displaced into their open position. A locking element which interacts with the pivotable locking element and by means of which the open position is then locked can then be formed for example merely by an end portion of a closure part 32, 31 which is opposite the closure part 31 or 32 comprising the pivotable locking element. Consequently, the respective closure part 32 or 31 comprises an integrated locking element comprising the magnet element 411M, with which a magnet element 421M (integrated in the support arm 425) of the pivotable locking element interacts in the locking position.

FIGS. 37 to 45 show a further variant of a closure device 2, in which locking element-side magnet elements 41M, 42M of a hold-open mechanism 4A or 4B are in each case displaced beyond one another, at least in part, in the case of an adjustment of the first and second closure parts 31 and 32 out of the closed position and into the open position. In this case, magnet elements 41M and 42M of a hold-open mechanism 4A or 4B, which interact with one another, are arranged in a head portion of the respective locking element 41.1-42.2, which head portion in each case projects laterally and in the present case is disc-shaped. Then, in the locking position, a magnetic force applied by a magnet element pair 41M, 42M for locking the closure parts 31 and 32 in their open position again acts perpendicularly to the closing axis S and thus in parallel with the vertical direction z.

The variant of FIGS. 46 to 54 is a development of the variant of FIGS. 1 to 9. In this case, the hold-open mechanisms 4A and 4B are configured identically. In a deviation from the variant of FIGS. 1 to 9, however, no handle elements 310, 320 are provided on the first and second closure parts 31 and 32, via which handle elements a user can engage on the first and second closure parts 31, 32, in order to adjust the closure parts 31 and 32 between the closed position and the open position. Rather, the variant in FIGS. 46 to 54 provides that the locking elements 41.1-42.2, in each case optionally formed integrally with an associated closure part 31 and 32, are also provided for manual application of an operating force thereon, in order to adjust the closure parts 31 and 32 out of the closed position, shown in FIGS. 49 to 51, and into the open position. Thus, moving together, and associated pivoting, of the locking elements 41.1, 42.1 or 41.2, 42.2 of a hold-open mechanism 4A or 4B in the direction of their locking position automatically results in the first and second closure parts 31 and 32 being pushed away from one another in their central region. The locking elements 41.1, 42.1 or 41.2, 42.2 of a hold-open mechanism 4A or 4B thus in each case form operating portions for manual force application, such that the first and second closure parts 31 and 32-in the case of a closure combination 3 present in the release position-can be adjusted out of their closed position and into the open position by displacement of the respective first and second locking elements 41.1, 42.1 or 41.2, 42.2 out of their rest position in the direction of the locking position.

In order to assist such operation of the closure device 2, the strip-shaped closure parts 31, 32 (as well as the third strip-shaped closure part 33) can be produced for example from a resilient material having discrete magnet elements 31, 32 or 33 embedded therein, or from a resilient, magnetic material.

Figure 45:
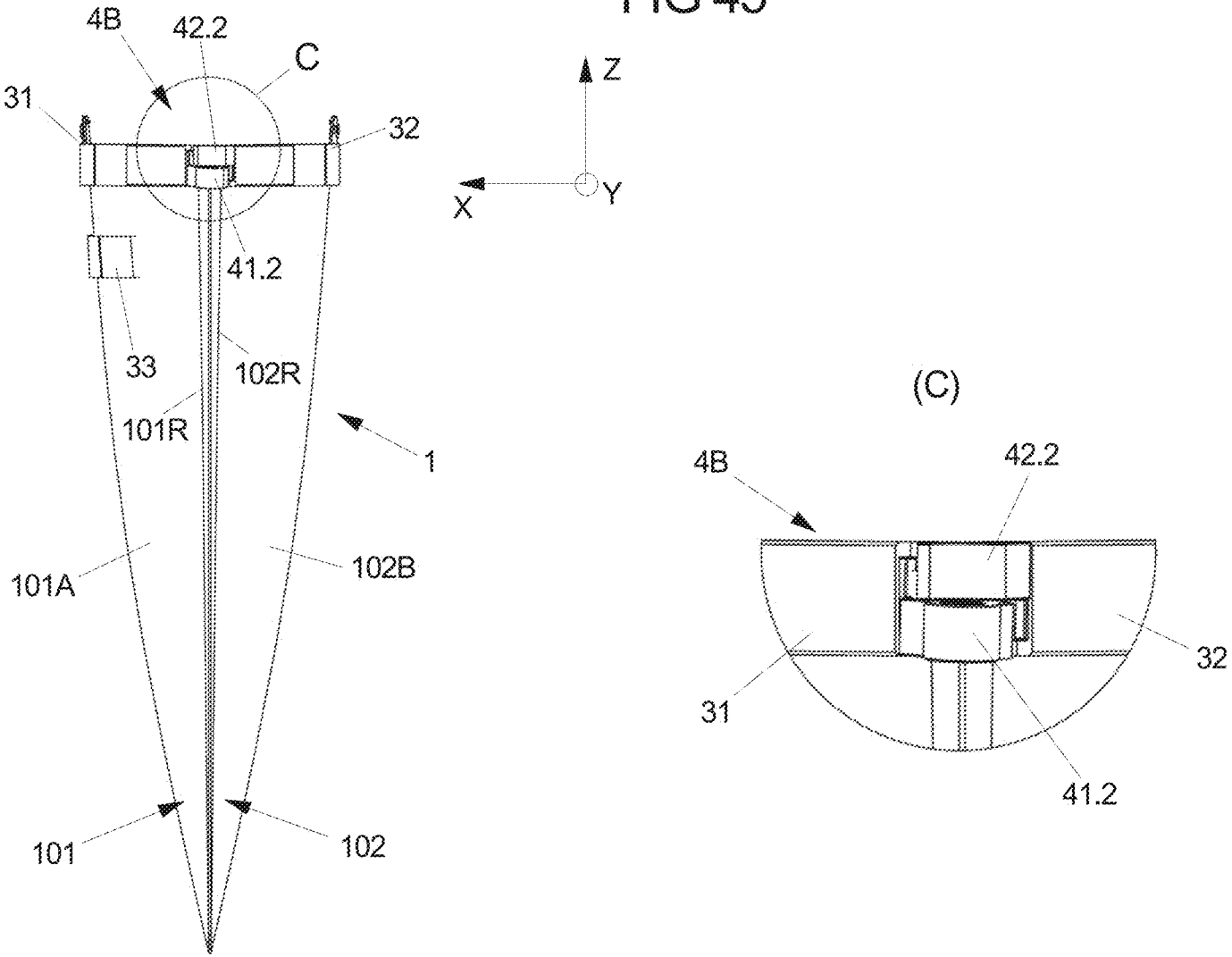
Figure 47:
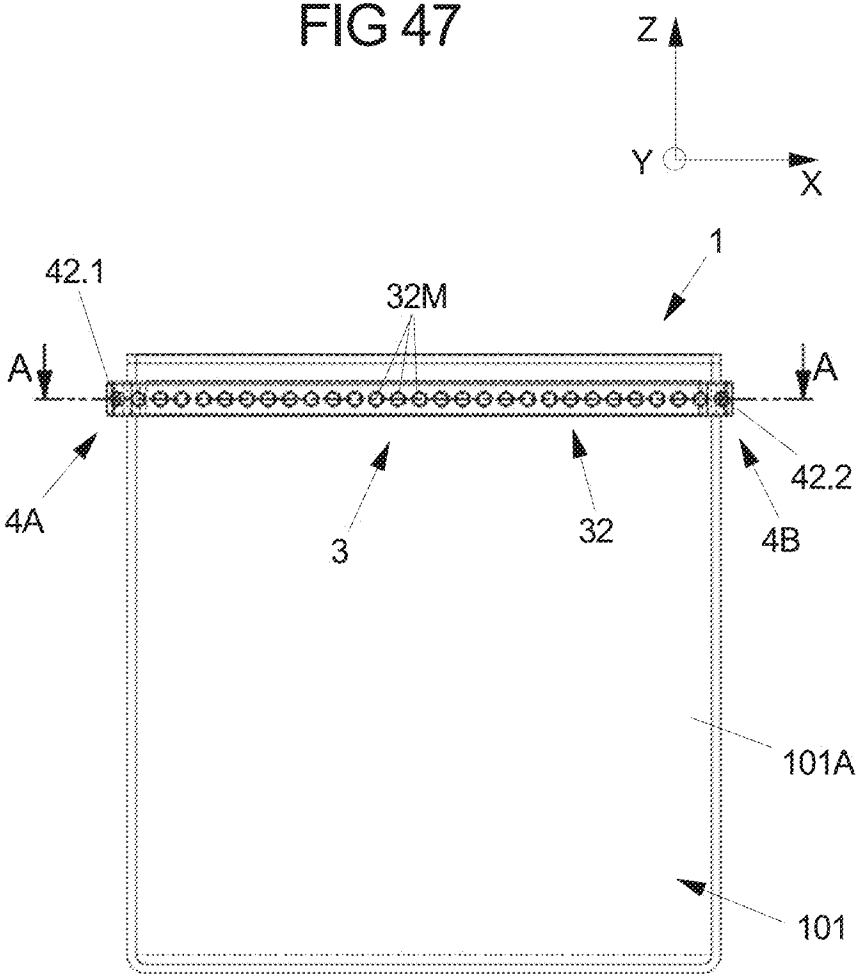
FIGS. 46-54 show, in views corresponding to FIGS. 1 to 9, the storage device comprising a further variant of a proposed closure device, in which no actuation portion for opening and closing the closure device is provided on the first and second closure parts of the closure device.
Figure 46:
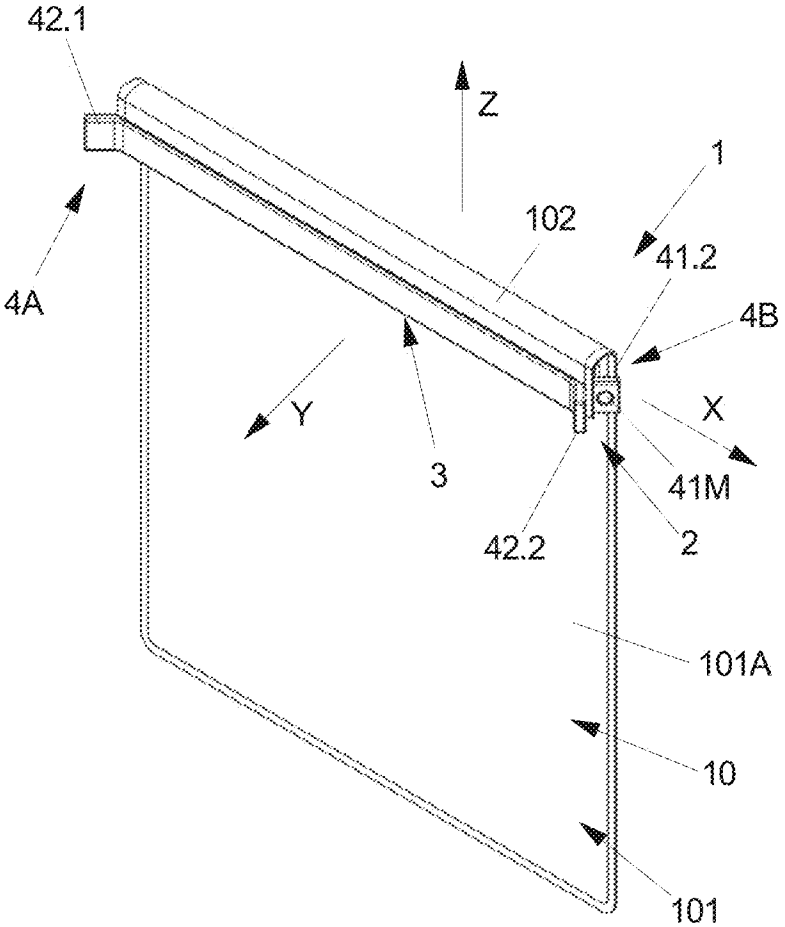
Figure 47A:
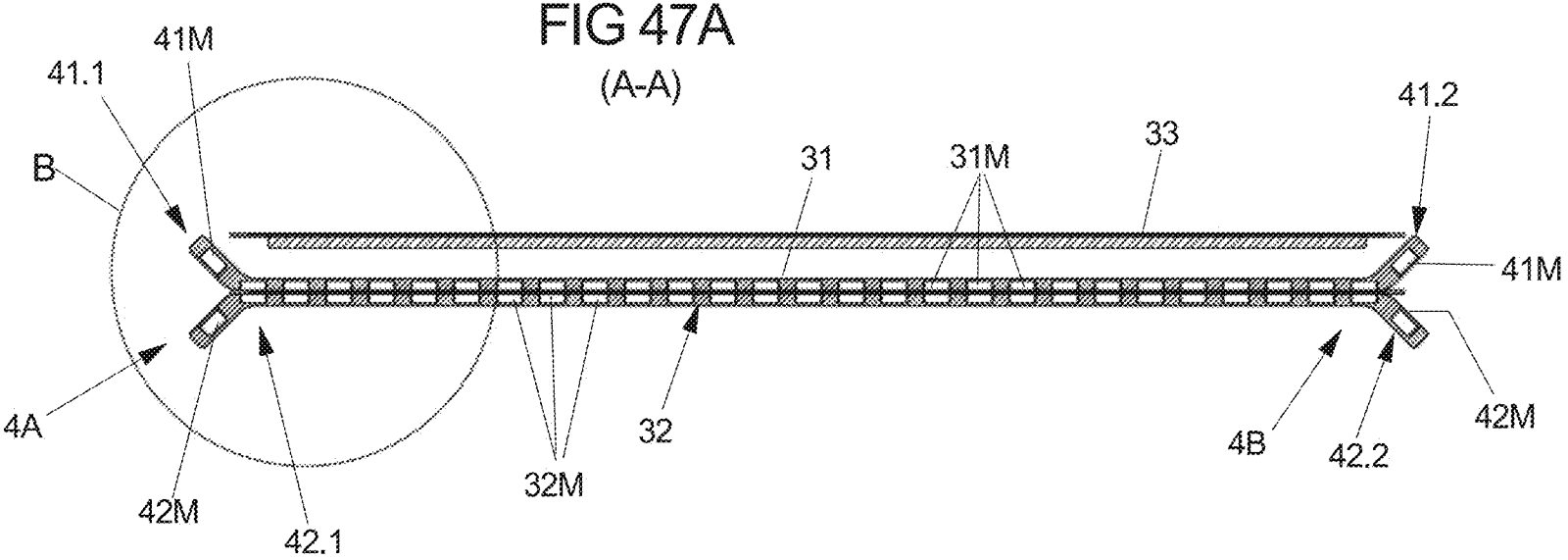
Figure 47B:
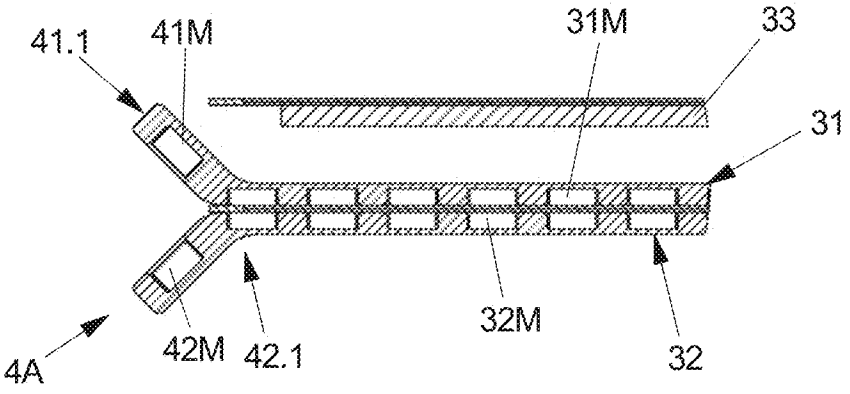
Figure 48:
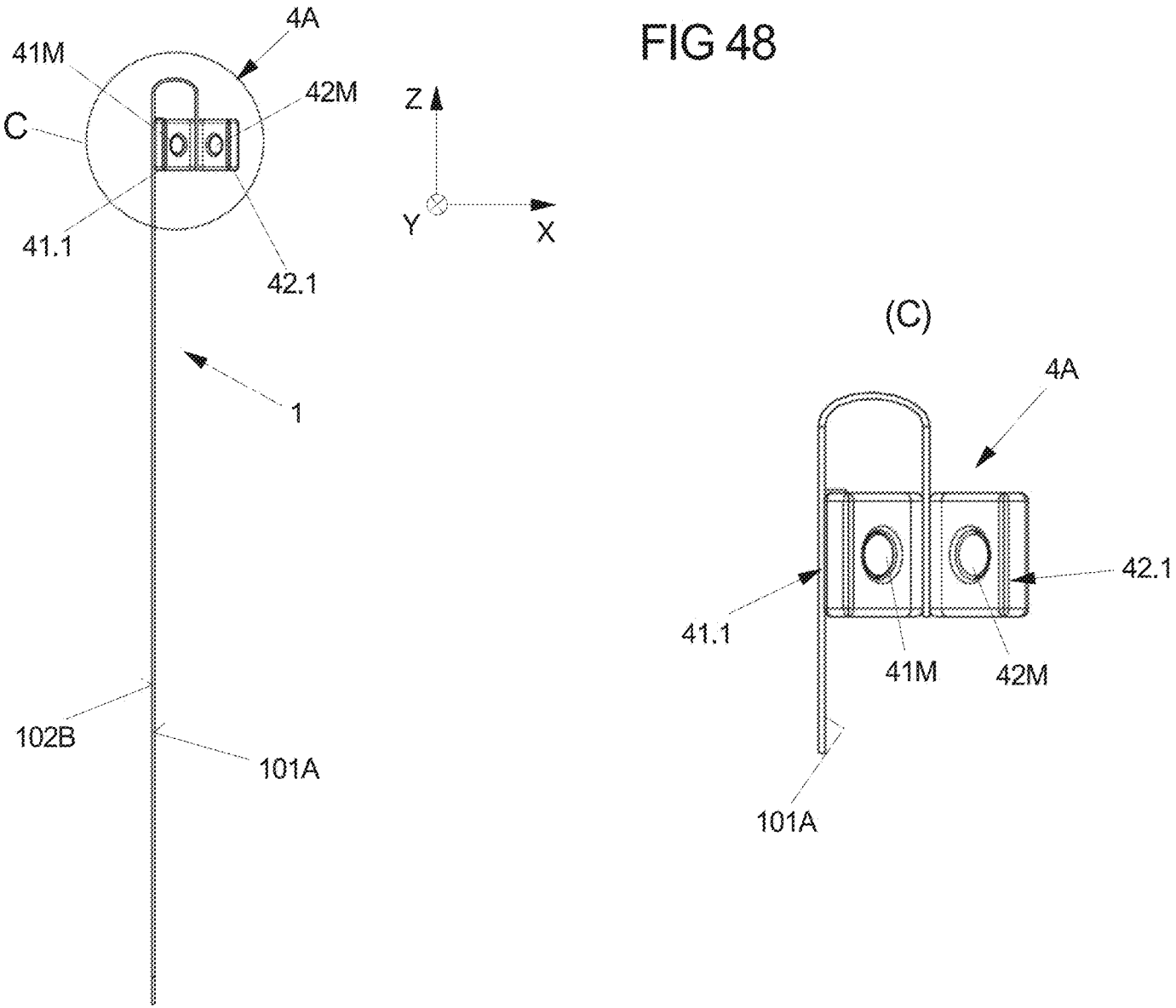
Figure 50:
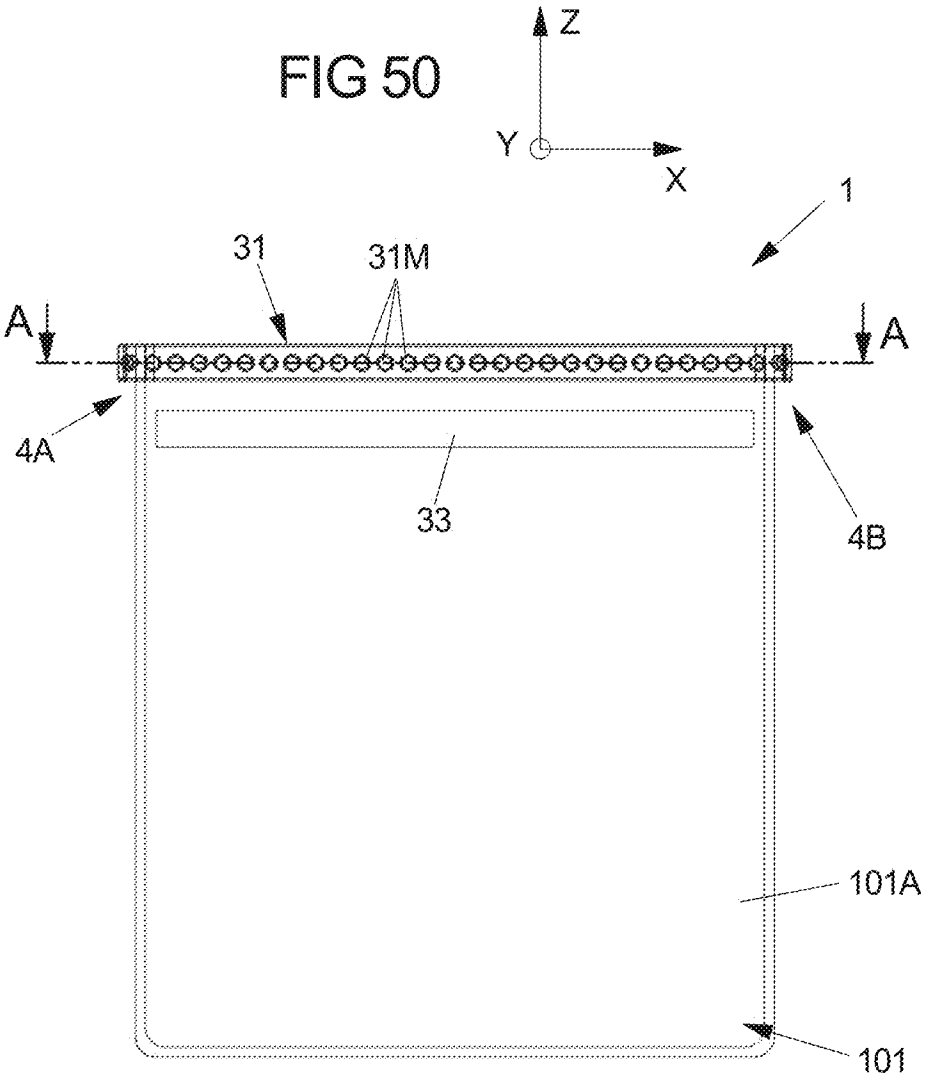
Figure 49:
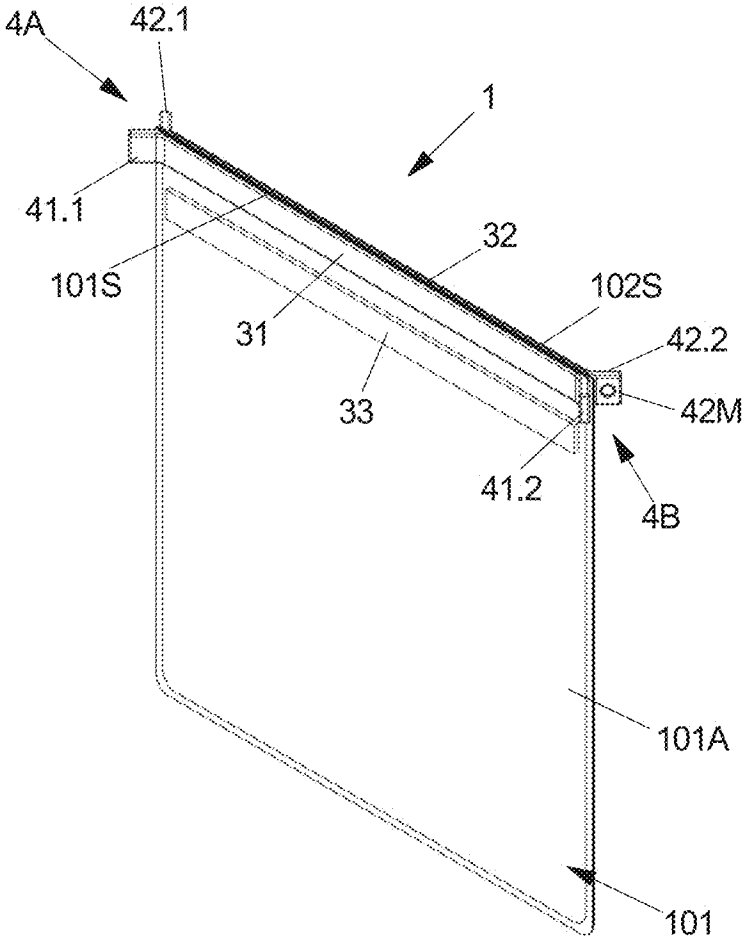
Figure 50A:
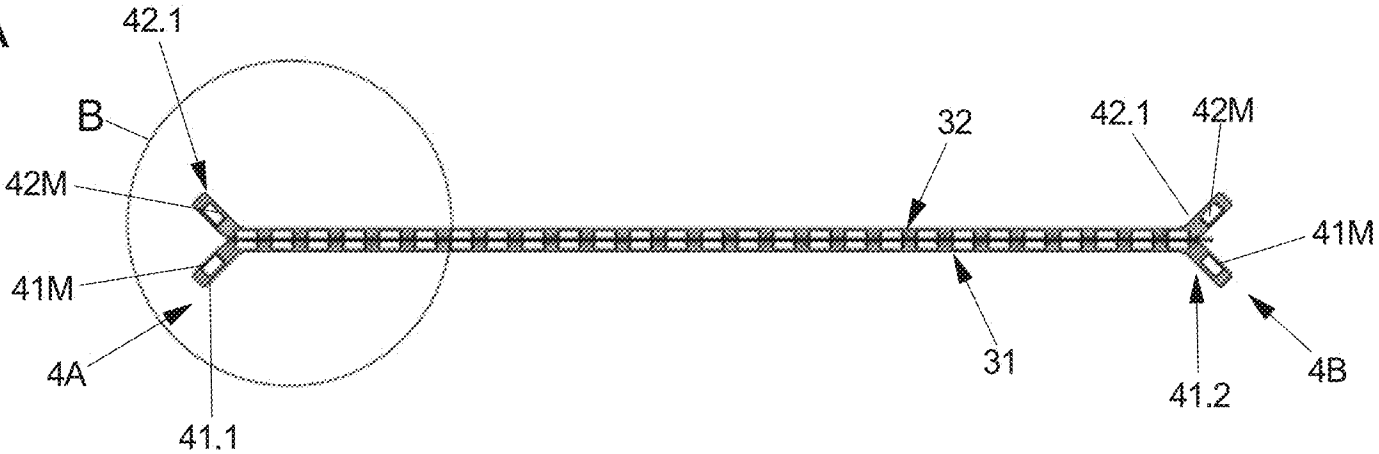
Figure 50B:
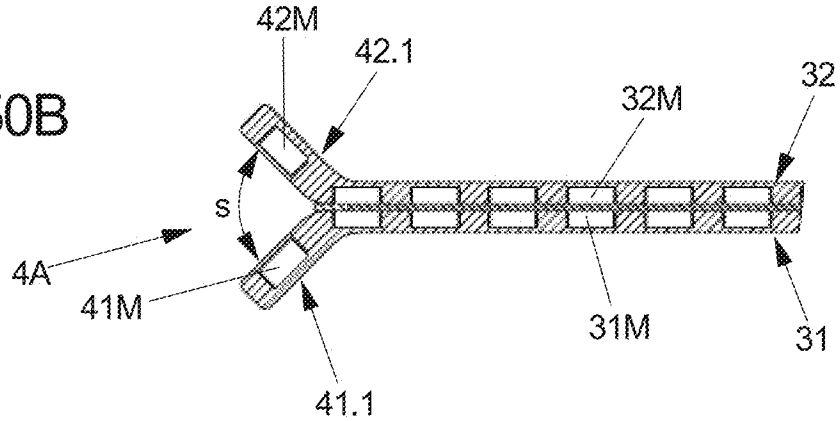
Figure 51:
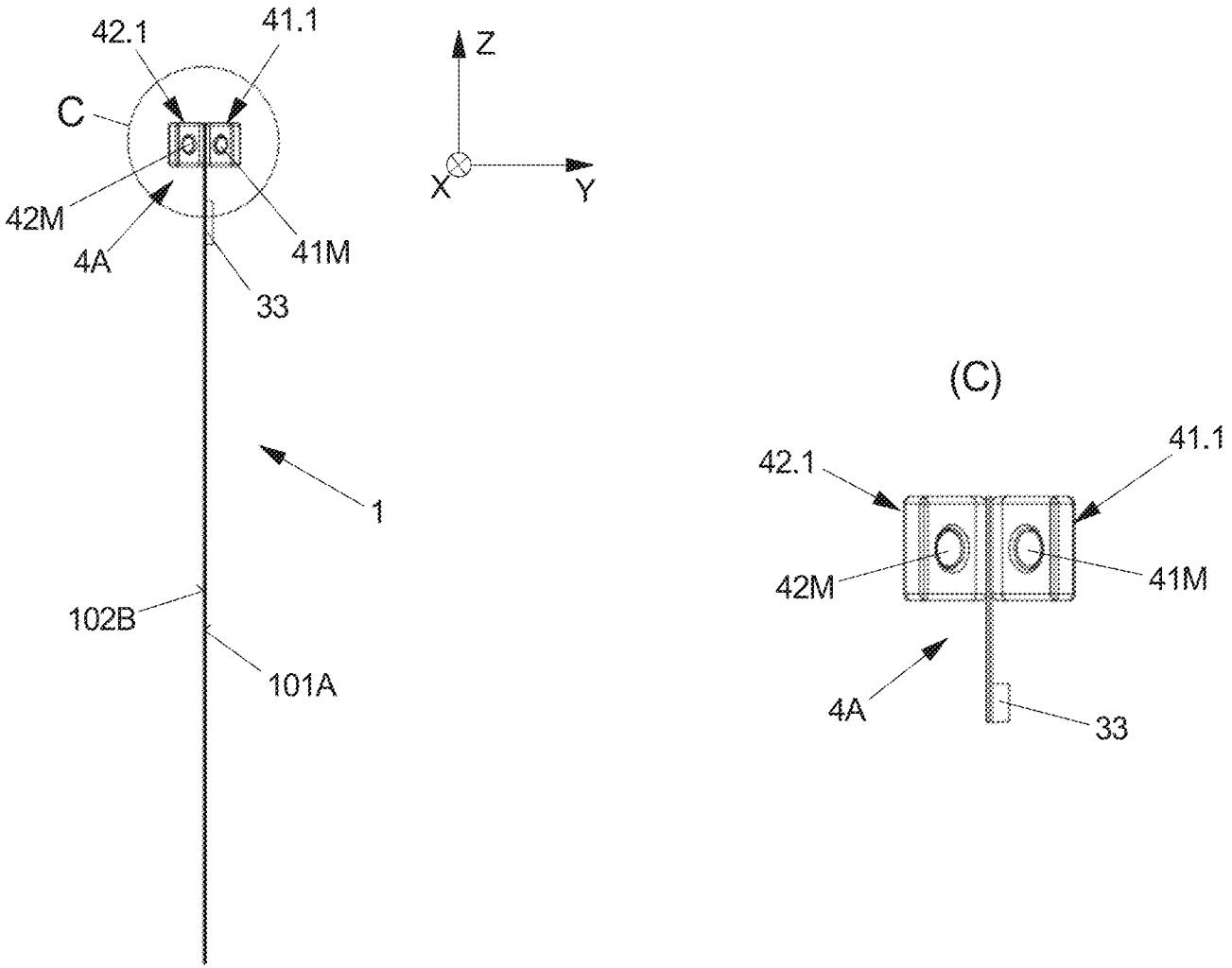
Figure 53:
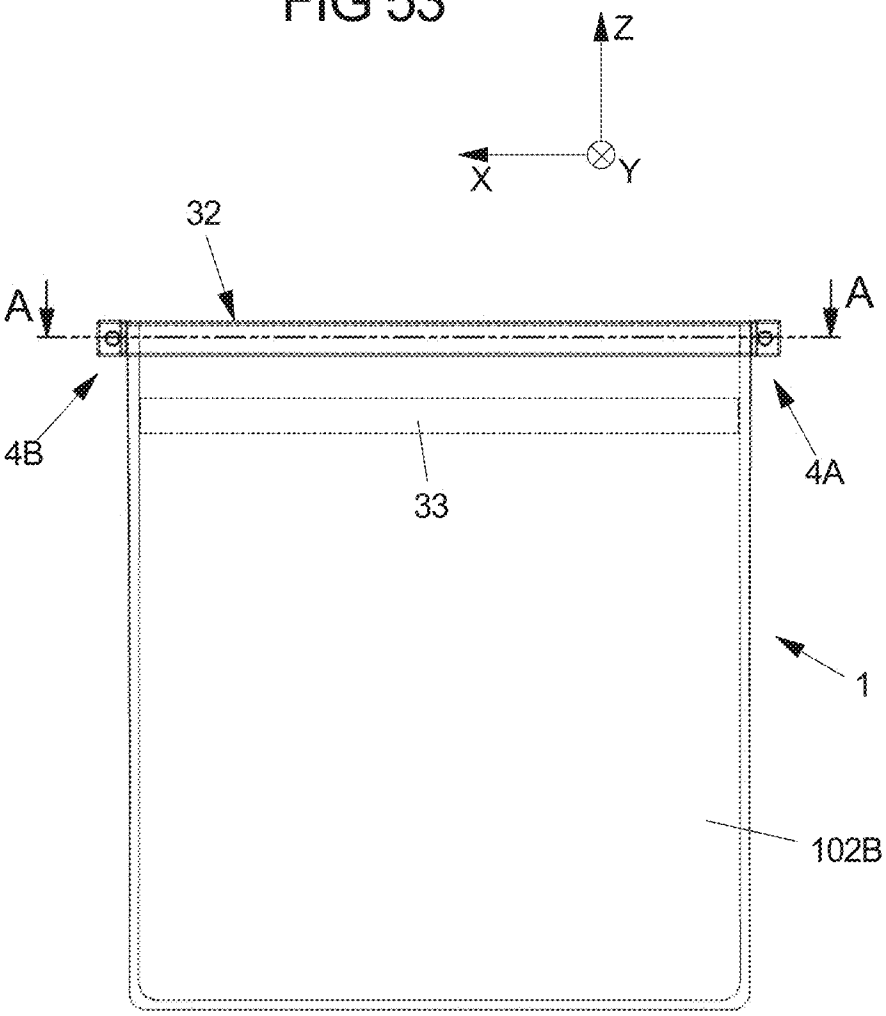
Figure 52:
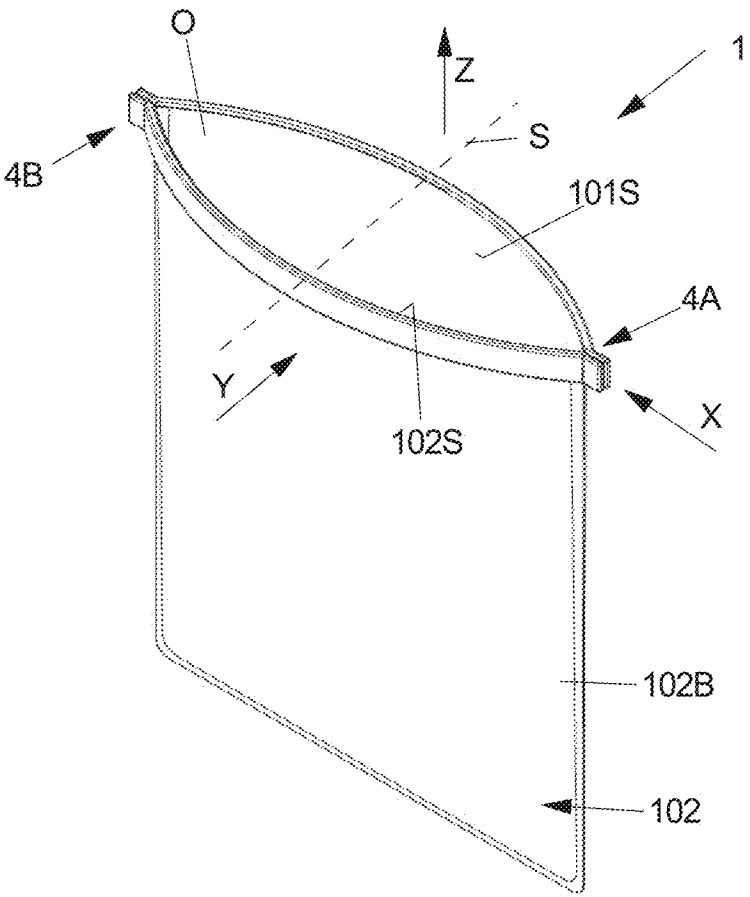
Figure 53A:
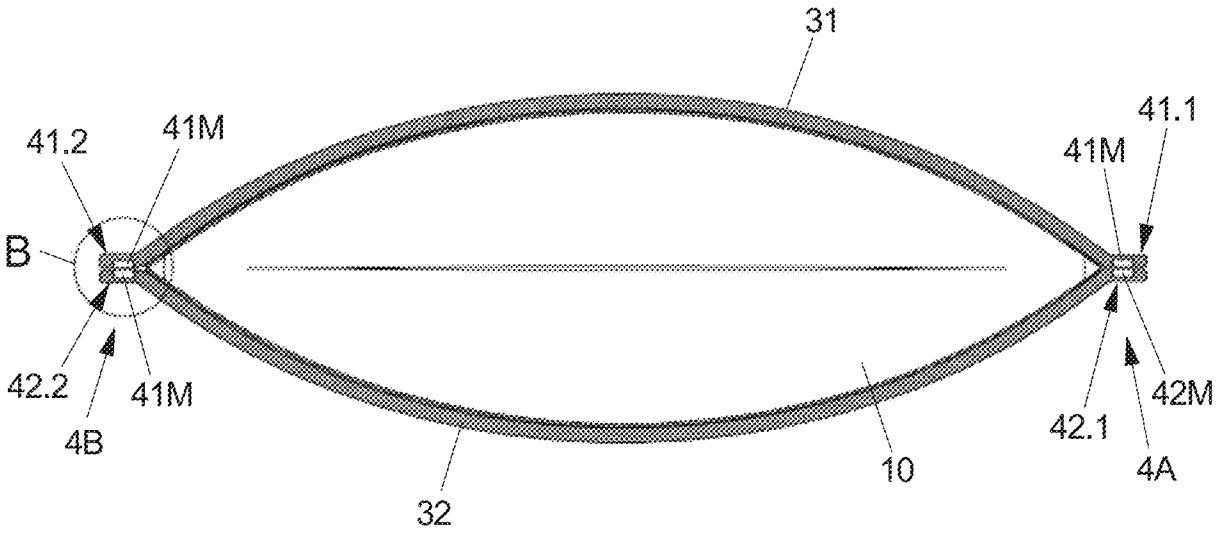
Figure 53B:
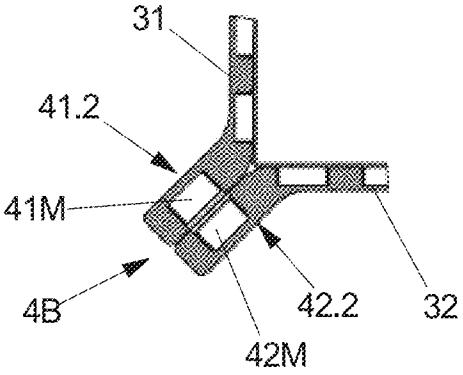
Figure 54:
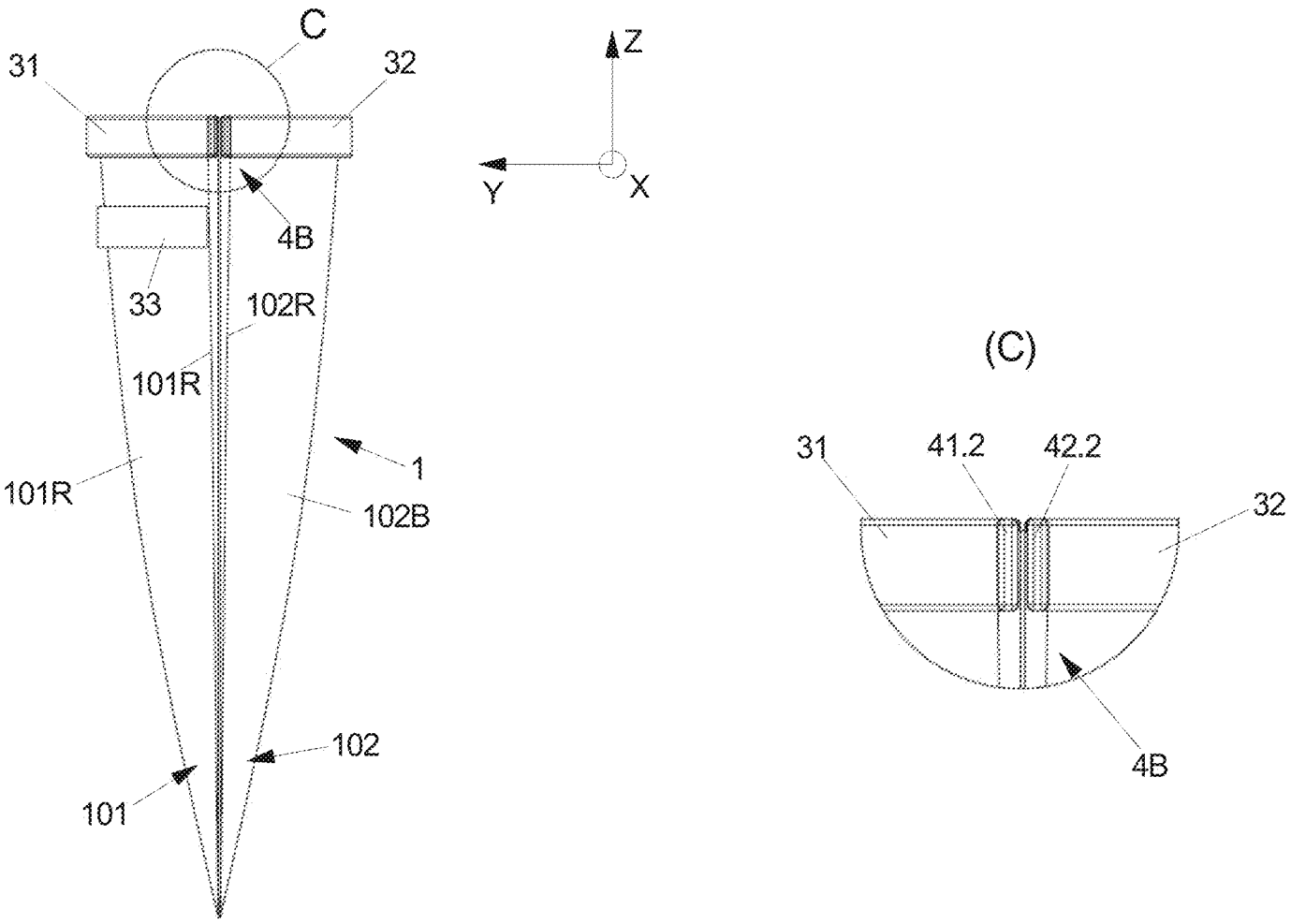
Figure 56:
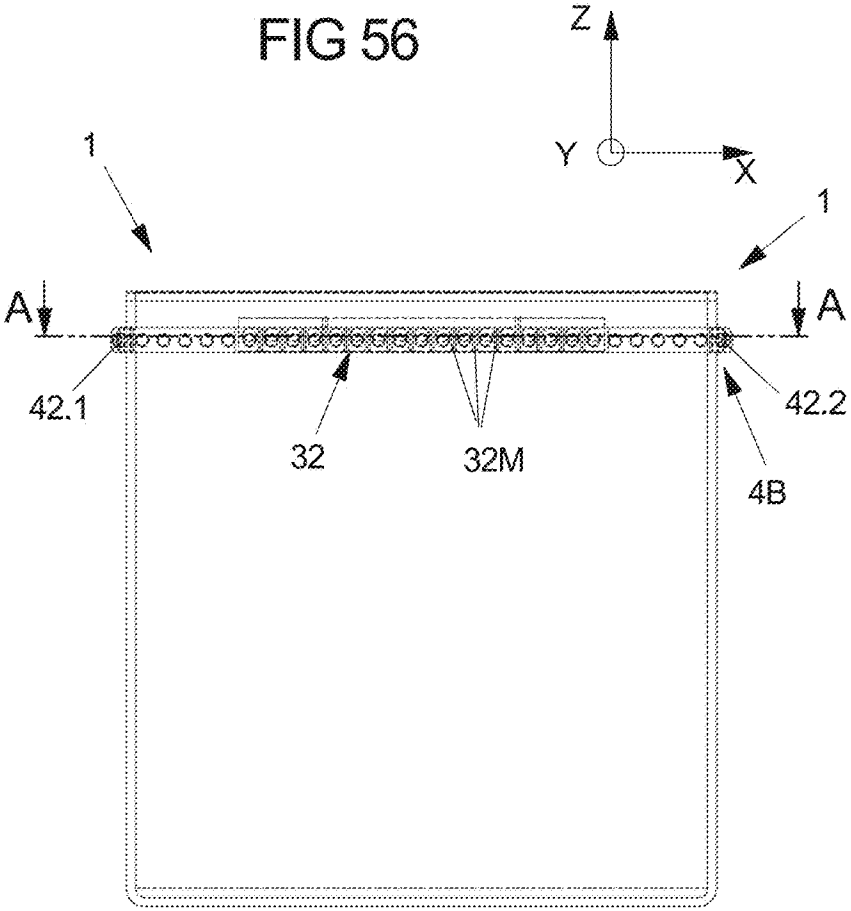
FIGS. 55-60 show, in views corresponding to FIGS. 46 to 51, a development of the variant of FIGS. 46 to 54, in which the first and second closure parts are more significantly segmented.
Figure 55:
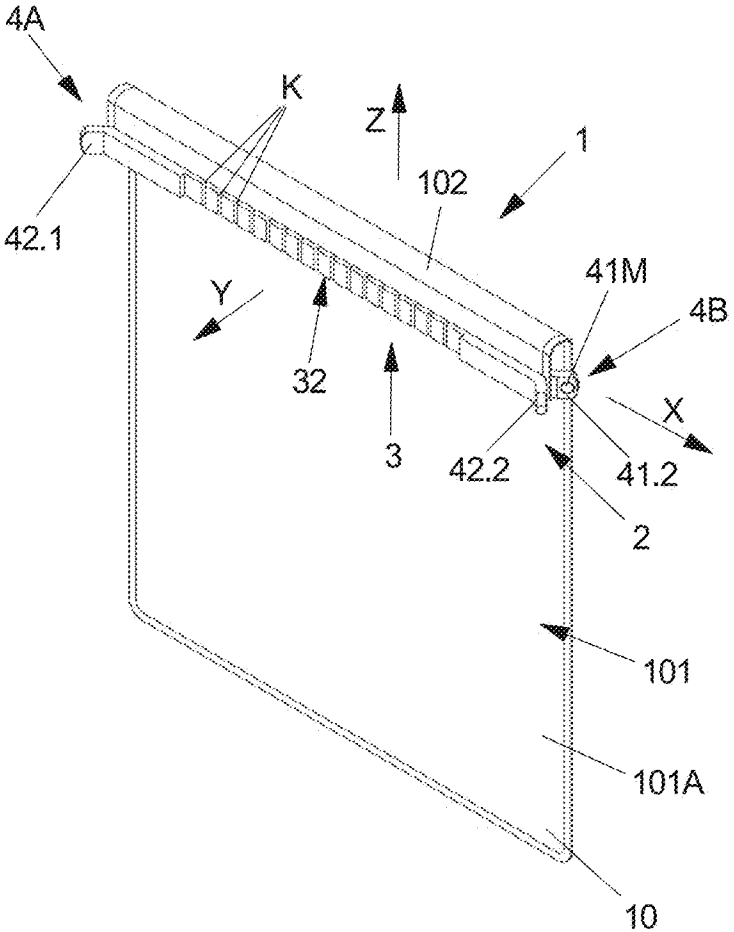
Figure 56A:
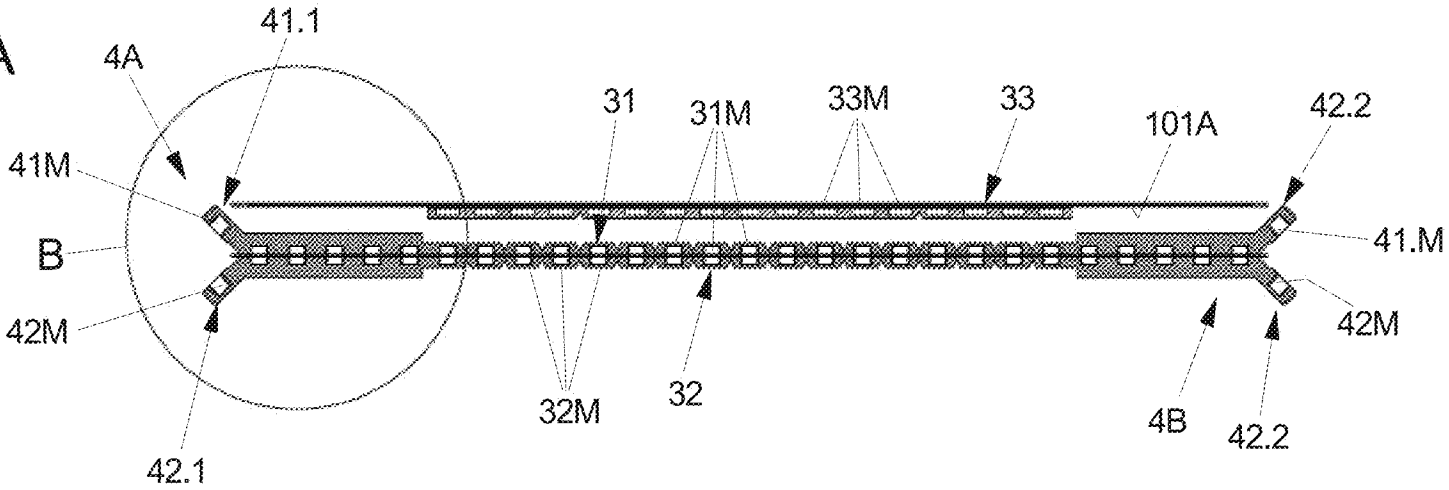
Figure 56B:
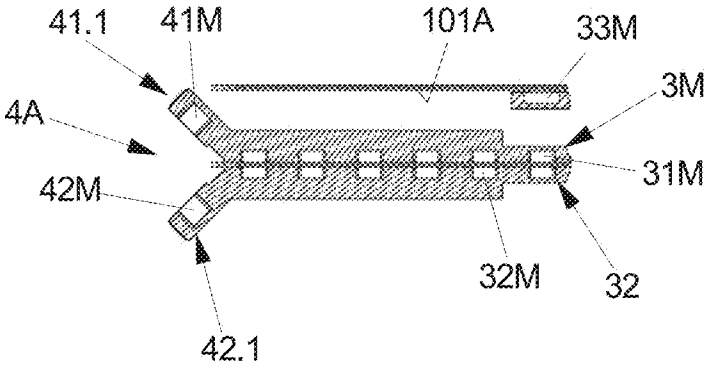
Figure 57:
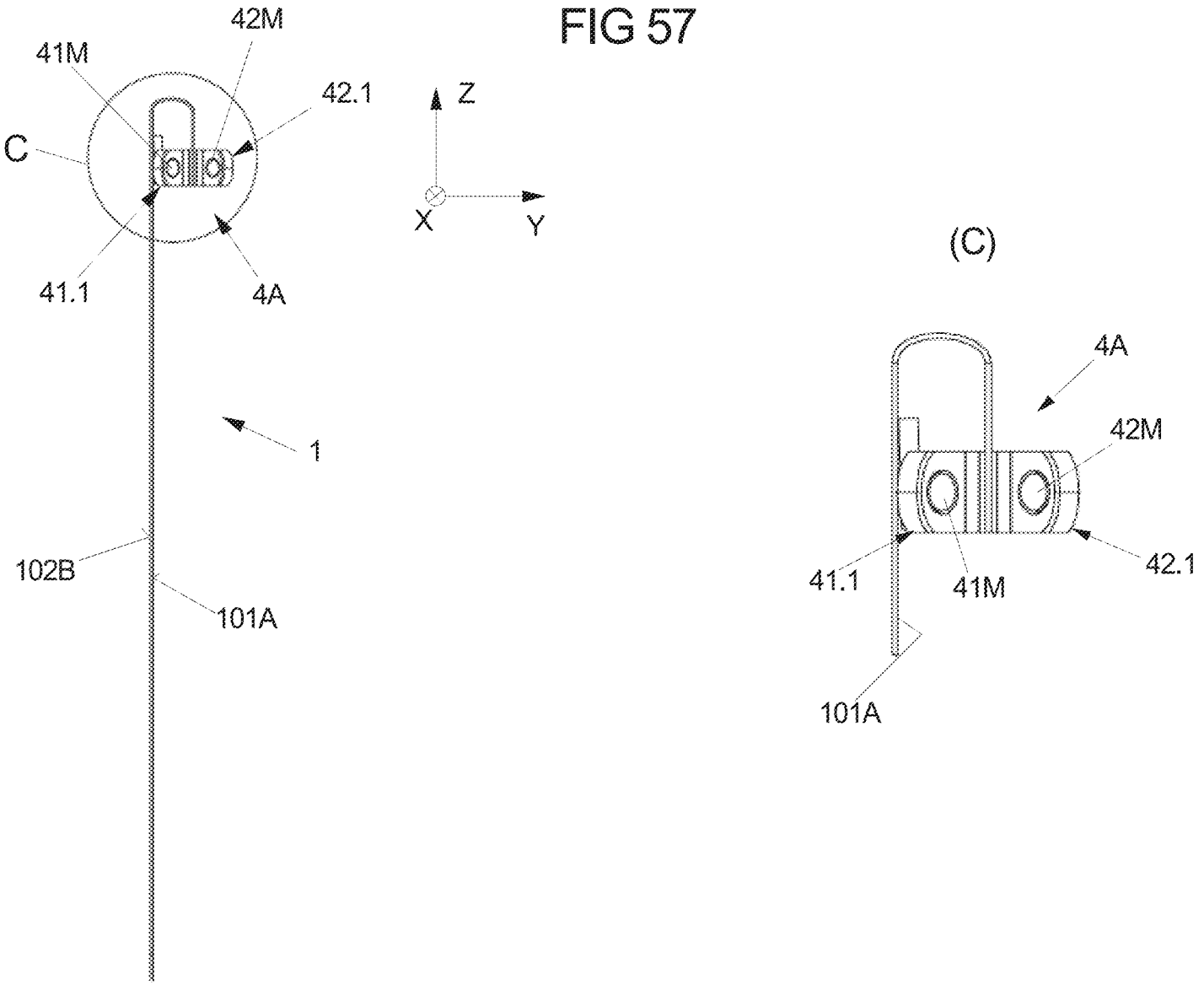
Figure 59:
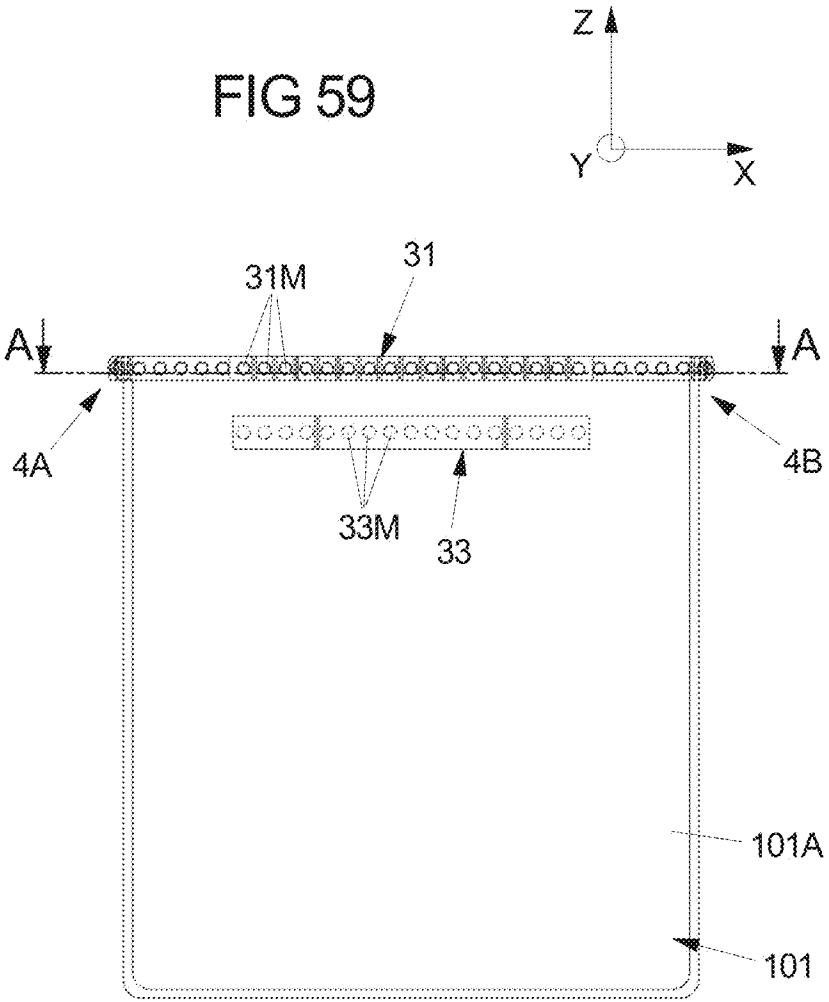
Figure 58:
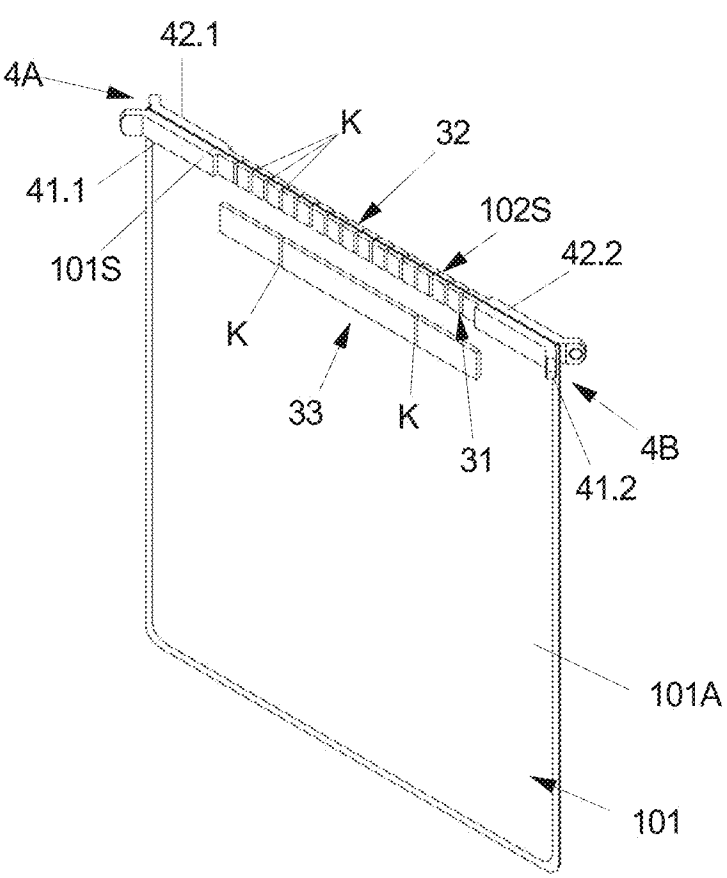
Figure 59A:
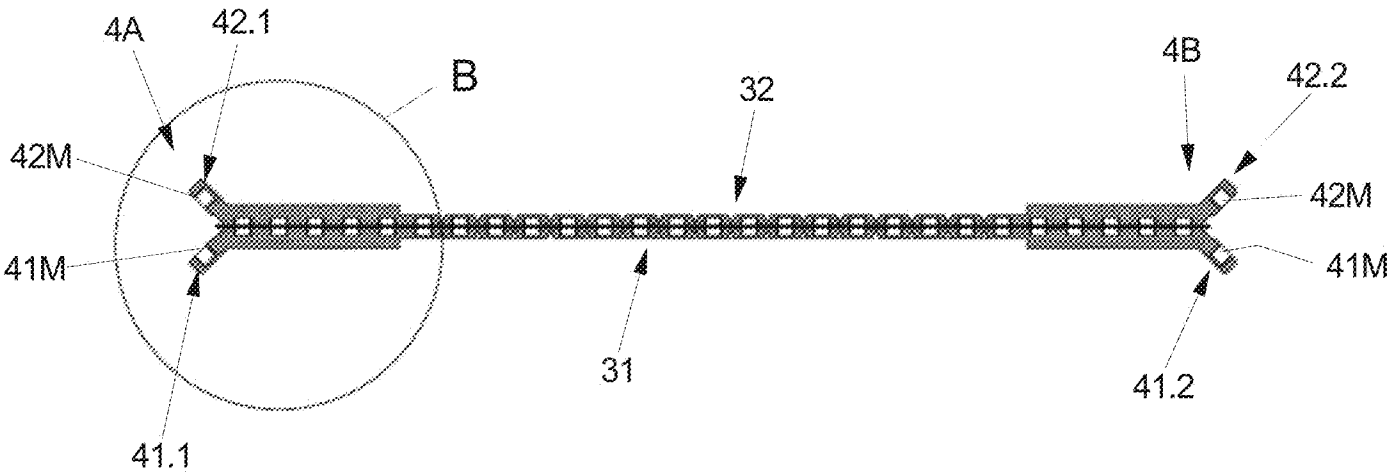
Figure 59B:
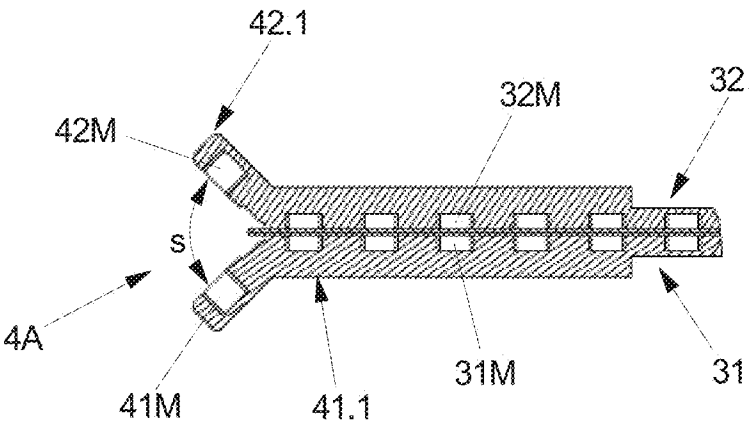
Figure 60:
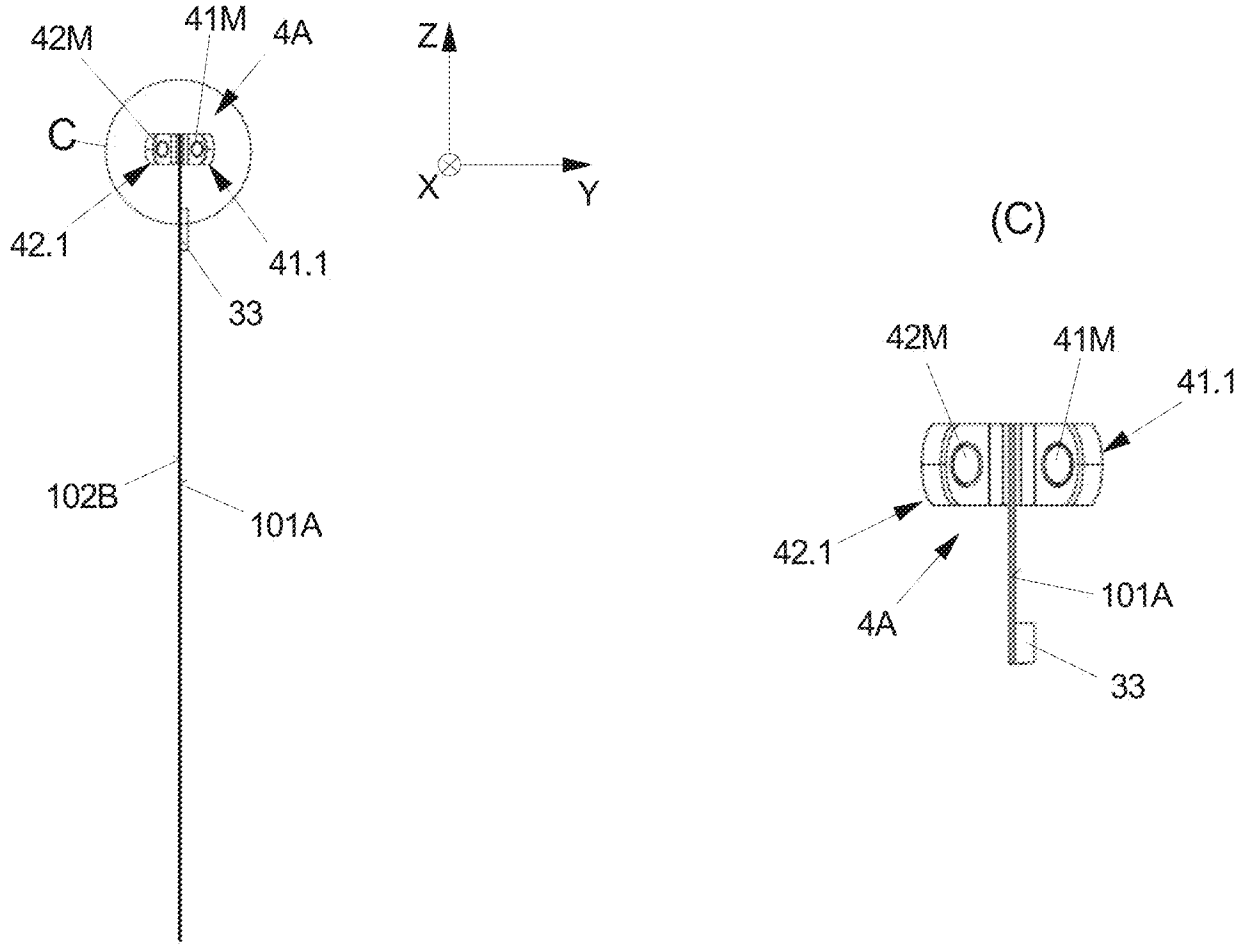

In a development according to FIGS. 55 to 60, in contrast to the variant of FIGS. 46 to 45 all that is intended is to provide a flexibility or elasticity, required for the bulging of the first and second closure parts 31 and 32 in the case of an adjustment into the open position, not (only) by the material used for the first and second closure parts 31 or 32. Rather, in this case a plurality of notches K extending in parallel with the vertical direction z is provided on each first and second closure part 31, 32. Consequently, in this case the first and second closure parts 31 and 32 are segmented via the notches K. The individual magnet elements 31 or 32 of the closure parts 31, 32 are then arranged in one of the segments in each case.

In the present case, the elongate locking elements 41.1-42.2 are provided on the end side, on the respective first and second closure part 31, 32. In this case, for example analogously to the embodiment of FIGS. 1 to 9 explained above, a respective locking element-side magnet element 41M or 42M on a portion of the respective locking element 41.1-42.2 that is angled away from the respective closure part 31 or 32, and thus with respect to the transverse axis or the x-direction, in the closed position.

Figure 62:
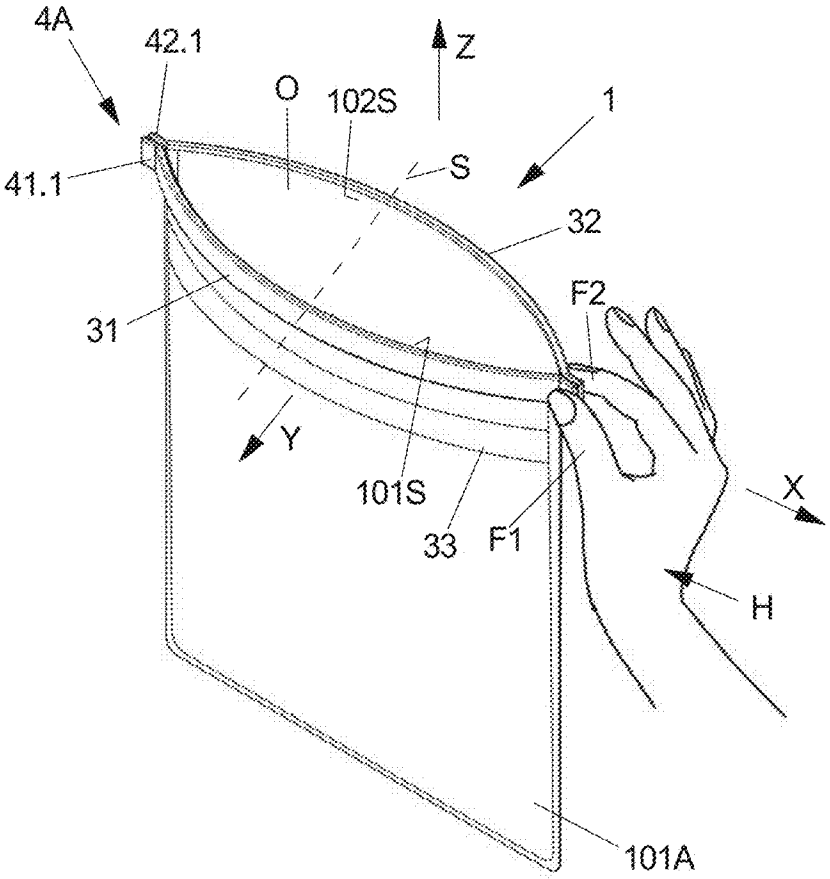
FIG. 62 shows, in a view corresponding to FIG. 61, the storage device comprising the first and second closure parts in the open position.
Figure 61:
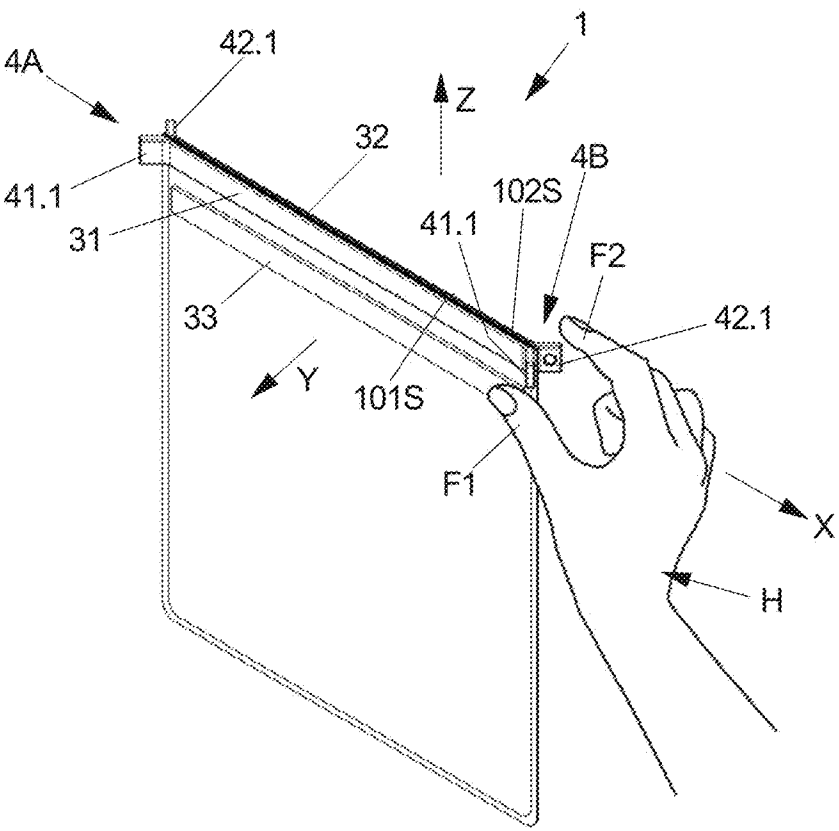
FIG. 61 is a perspective view of the storage device comprising the closure device according to FIGS. 46 to 54, showing a manual force application on locking elements of a hold-open mechanism for opening the closure device and thus for a displacement of the first and second closure parts out of a closed position, which is shown, into an open position.

FIGS. 61 and 62 are perspective views of a storage device 1 according to FIGS. 46 to 54, illustrating the use of the locking elements 41.1-42.2 of the hold-open mechanisms 4A, 4B for opening the closure device 2. In this case, FIG. 61 shows the storage device 1 having the closure device 2 in the release position, and the first and second closure parts 31 and 32 in the closed position. In this case, a hand H of a user engages with two fingers F1 and F2—in the present case thumb and forefinger—on the locking elements 41.2 and 42.2 of the hold-open mechanism 4B. By being pressed together, the locking elements 41.2, 42.2 are moved towards one another, in accordance with FIG. 62, bridging the adjustment path s and thus the spacing between the two protruding portions of the locking elements 41.2 and 42.2, such that they come into contact with one another. The pivot movement of the locking elements 41.2, 42.2, caused thereby, is associated with the first and second closure parts 31 and 32 being pushed away from one another at the edge of the opening O, such that the first and second closure parts 31 and 32 are transferred into the open position and the cavity 10 becomes accessible via the opening O. On account of the magnetic forces applied by the magnet elements 41M and 42M of the hold-open mechanisms 4A and 4B, the first and second closure parts 31 and 32 remain in the open position, even if the user removes their hand H from the closure device 2.

Figure 63:
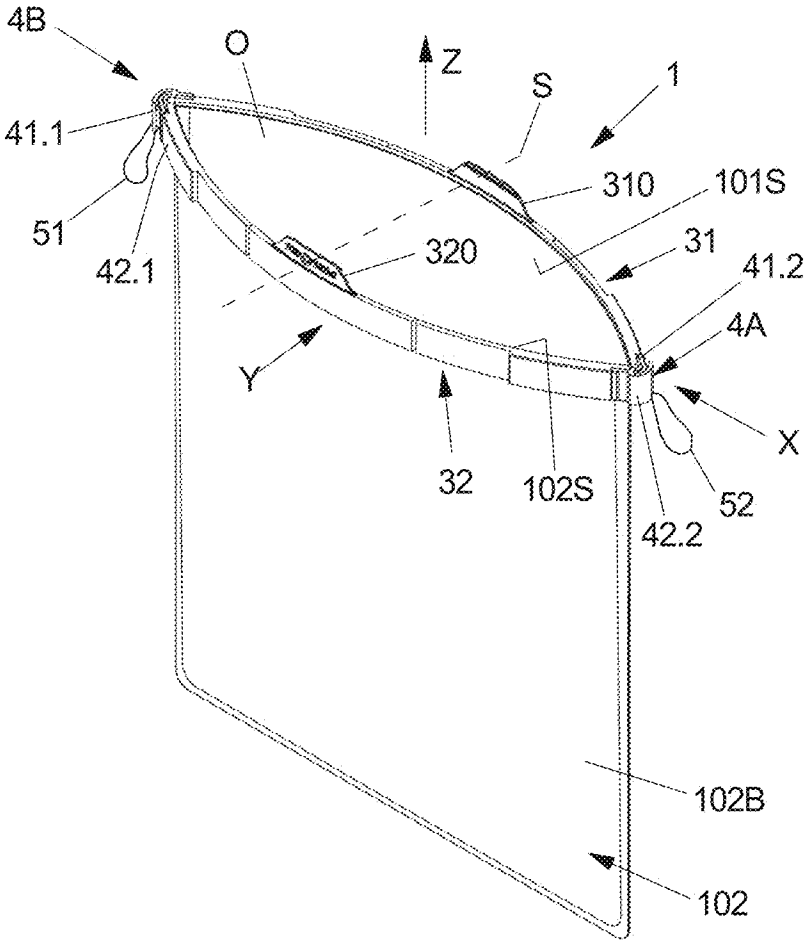
FIG. 63 shows a development of the variant of FIGS. 19 to 27, illustrating the storage device in the open position, in a view according to FIGS. 25.
Figure 64B:
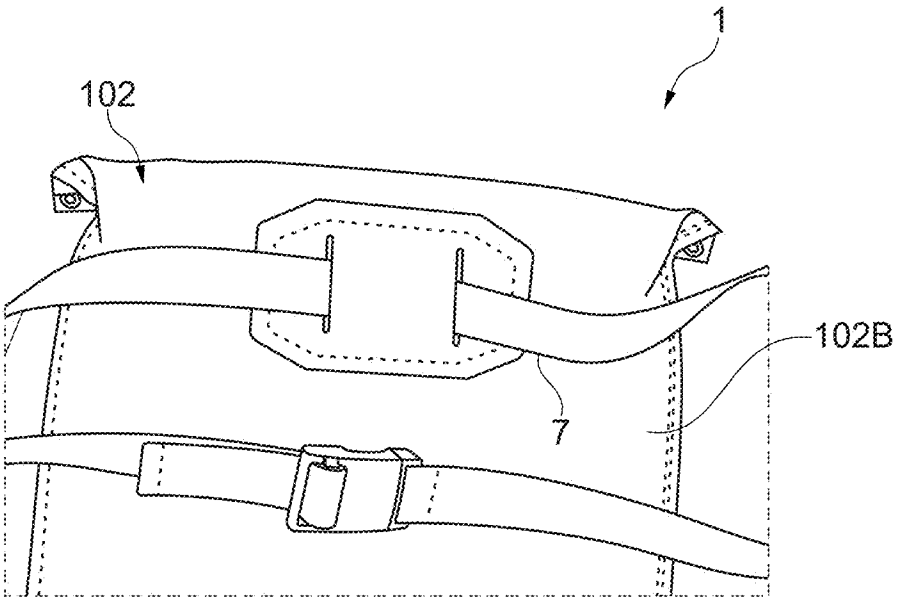
FIGS. 64A-64B show a further variant of a storage device in the form of a pouch or a bag, looking at a front side (FIG. 64A) and a rear side provided with a belt (FIG. 64B).
Figure 64A:
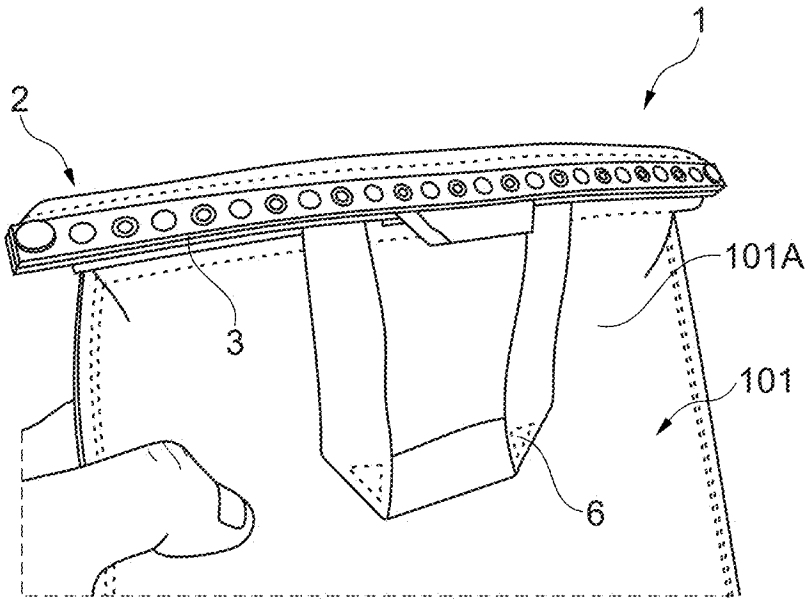
Figure 65C:
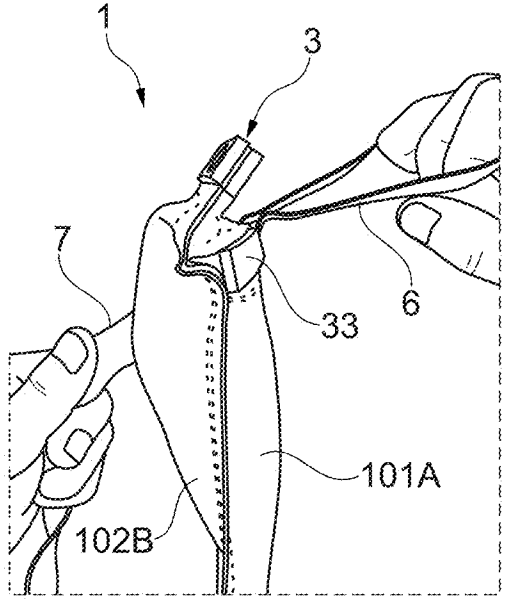
FIGS. 65A-65E show the storage device of FIGS. 64A and 64B in different phases during transfer of a closure combination out of a closure position and into a release position, and subsequent adjustment of first and second closure parts into an open position.
Figure 65B:
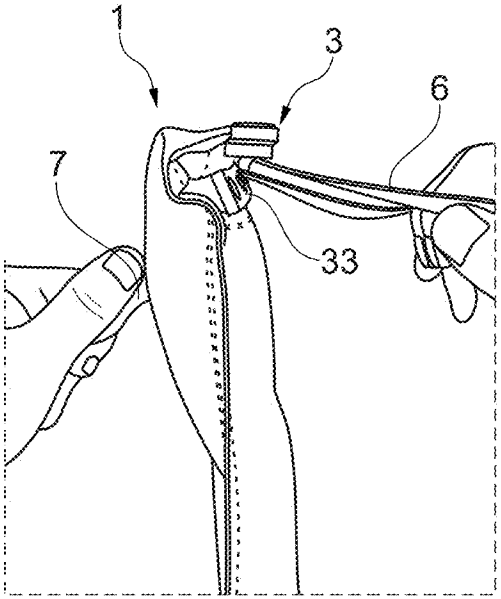
Figure 65A:
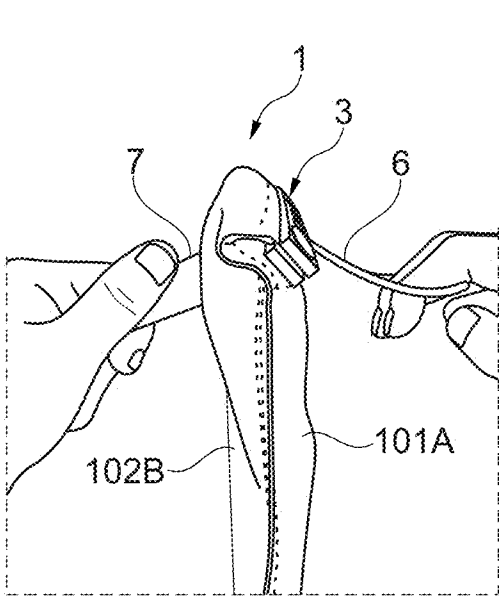
Figure 65E:
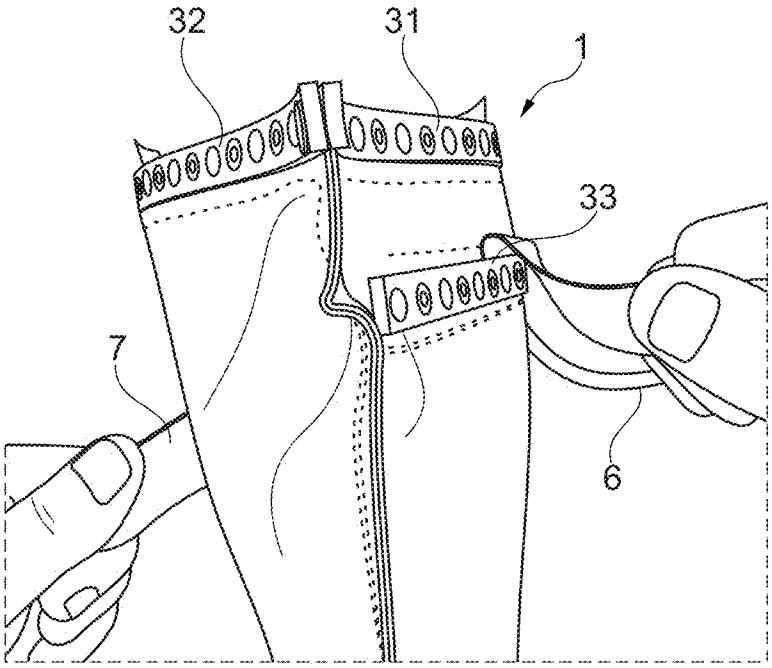
Figure 65D:
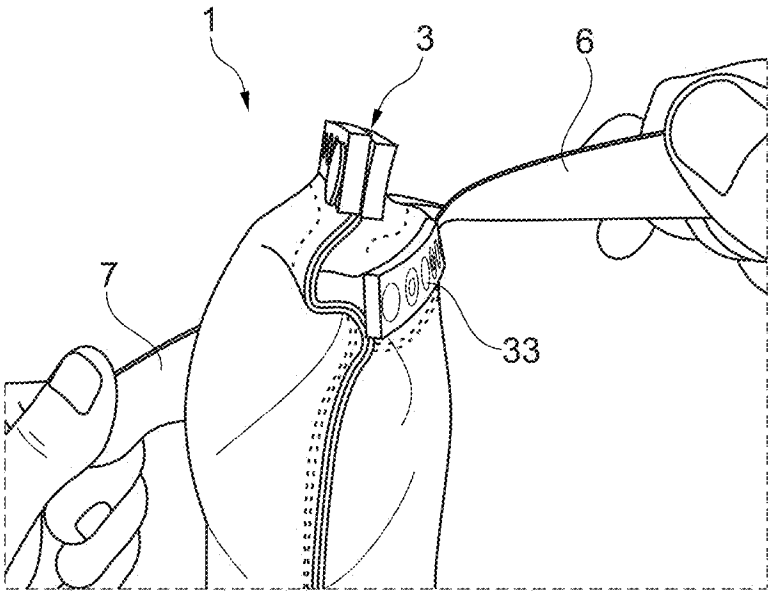

FIG. 63 shows a possible development of the variant of FIGS. 19 to 27, in which an additional unlocking element in the form of an actuation loop 51, 52 is also provided, on each of the hold-open mechanisms 4A, 4B. For example, in a variant of FIGS. 19 to 27, a latching connection comprising the latching lug 424 and the latching groove 414 can in principle be configured such that, in the case of a manually applied force on the closure parts 31 and 32 present in the open position, the latching is released without destruction, and thus the locking is also released. In a possible development, however, it can also be provided, in accordance with FIG. 63, that the corresponding form-fitting latching first has to be released separately by means of a prior, additional force application on the respective hold-open mechanism 4A, 4B. Thus, for example in the present case, it may be necessary to pull on the actuation loop 51 or 52. Said actuation loop 51, 52 is in each case connected to the portion of a locking element 41.1 or 42.2 forming the latching lug 424, such that the latching lug 424 can be brought out of engagement with the respective latching groove by the force application.

Instead of the actuation loop 51 or 52 shown, of course an unlocking element configured in a different manner can also be provided, for example a rigid ring.

Alternatively or in addition to the variants explained above, it can also be provided, however, for the first and second closure parts 31 and 32 to be held in the open position by an additional element, for example by a rod attached to the inside of the closure parts 31,32.

Alternatively or in addition, the closure device 2 can also be configured having a deceleration means. A deceleration means of this kind is then configured to temporally limit the locking in the open position, following a completed transfer of the closure parts 31 and 32 into the open position, before the closure parts 31 and 32 are displaced automatically back into the closed position again, for example under action of a corresponding preload, e.g. a resilient preload, in the direction of the closed position. For example, a corresponding deceleration means can comprise one or more deceleration elements, e.g. in the form of suction cups and/or adhesion elements. Corresponding deceleration elements of the deceleration means can thus apply a holding force that decreases over time. Corresponding deceleration elements can be provided for example on laterally protruding portions of the locking elements 41.1, 42.1 or 41.2, 42.2 which are brought into locking contact with one another with transfer of the locking elements 41.1, 42.1 or 41.2, 42.2 into the locking position, or of the closure parts 31 and 32 into the open position. The holding force applied via said contact then reduces continuously however, or suddenly after a predefined time period has elapsed, if no further force is applied, by the user, to the respective hold-open mechanism 4A or 4B. The first and second closure parts 31 and 32 are thus automatically adjusted back into the closed position as soon as a corresponding restoring force is greater than the decreasing holding force.

FIGS. 64A-64B, 65A-65D and 66A-66C show a further variant of a pouch-shaped storage device 1 comprising a variant of a proposed closure device 2. In this case, the storage device 1 of FIGS. 64A to 66C is configured as a pouch or bag, which can be worn by a person on the back 102B, via a waist belt 7. An actuation tab 6 is provided on the front side 101A, on the closure device 2. By pulling the actuation tab 6, the closure combination 3 of the closure device 2 can be pulled out of the closure position—counter to the magnetic force applied by the third closure part 33—and into the release position (cf. FIGS. 65A to 65C) and, in the assumed release position, the first and second strip-shaped closure parts 31 and 32 can be transferred into their open position (cf. FIGS. 65D to 65E).

In this case, the ends of the actuation tab 6 are fixed on the front side 101A, in the region of the third closure part 33, in order to overcome the respective magnetic forces by manually pulling on the actuation tab 6, applying a comparatively low manual force, and thus be able to easily open the storage device 1 on the closure device 2.

Figures 66A, 66B, 66C:
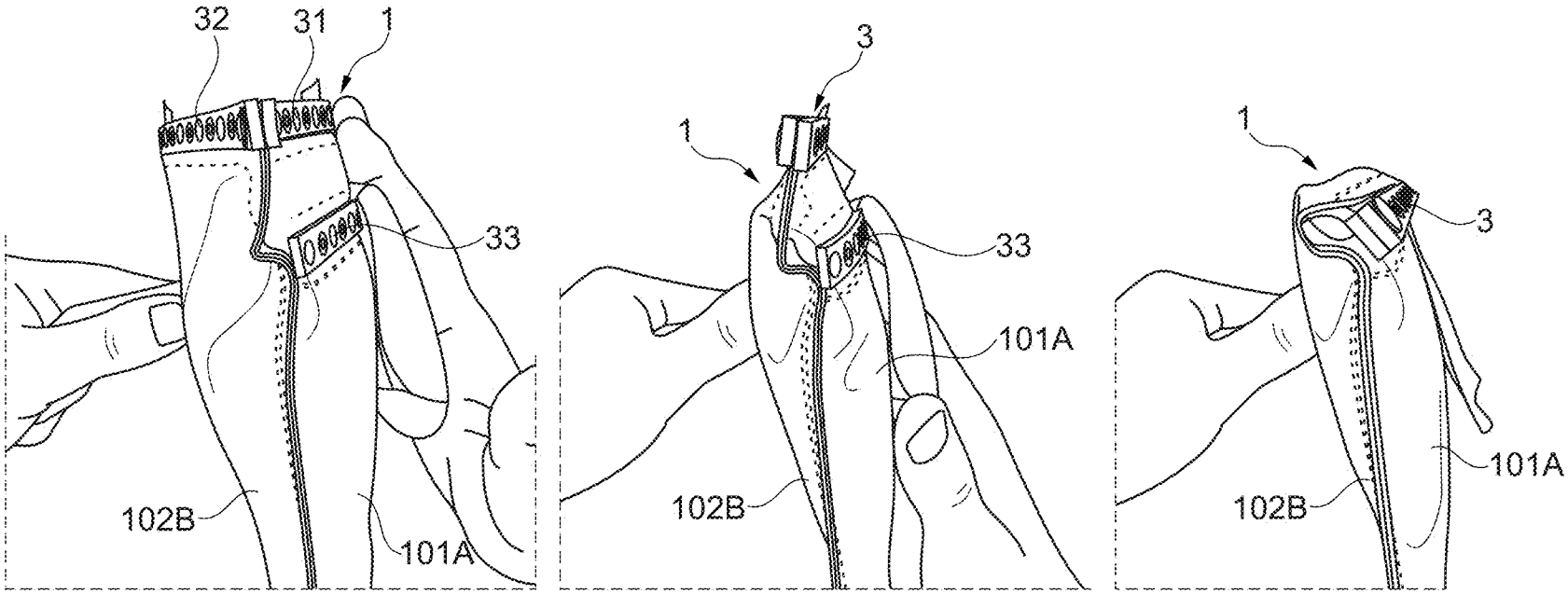
FIGS. 66A-66C show the storage device of FIGS. 64A to 65E in different phases during closing of the closure device and transfer of the closure combination into the closure position.

As is illustrated on the basis of FIGS. 66A to 66C, the closure device 2 that is held open by a proposed hold-open mechanism can also be easily closed again, in that the first and second closure parts 31 and 32 are moved sufficiently close to one another in their central region, such that they assume their closed position. Subsequently, the closure combination 3 is folded over, in the closure position, in the direction of the third closure part 33.

The possibility for simple one-handed opening of the storage device 1, illustrated by the actuation tab 6 (or another handle-like or tab-like actuation element) in the variant of FIGS. 64A to 65E, is furthermore also in principle advantageous without the first and second closure parts 31 and 32 being held in an open position via a hold-open mechanism. For example, the storage device 1 can be opened by a user with a flowing movement-over different movement phases-via the actuation tab 6. By means of pulling on the actuation tab 6, firstly the closure combination 3 can be folded out of the magnetically held closure position and into the release position. Subsequently, in the release position the first and second closure parts 31 and 32, which are held magnetically against one another, can be separated from one another via the actuation tab 6, and transferred out of the closed position and into the open position. Maintaining the open position via a hold-open mechanism can additionally be advantageous in this connection, but is merely optional.

In a deviation from the storage device 1 shown in FIGS. 64A to 65E, it is furthermore not necessary for a user to engage on the rear side 102B when the storage device 1 has been fixed via the waist belt 7. Instead of a waist belt 7, another type of fastening can furthermore also be provided.

FIGS. 67A to 69C are various views of a further variant of a pouch-shaped storage device 1 comprising a variant of a proposed closure device 2, which, when the closure device 2 is open, holds the closure device 2 in an open state via a hold-open mechanism.

In the case of the storage device 1 of FIGS. 67A to 69C, once again an actuation tab 6 is provided on the front side 101A of the storage device 1. In this case, ends of the actuation tab 6 are in each case fastened on an intermediate space between a centrally arranged third closure part 3 and a further third closure part 331 or 332 that is adjacent thereto in each case. In this case, the three third closure parts 331, 33 and 332 are in each case configured in a strip-shaped manner and are provided in succession along the transverse axis.

Figure 67A:
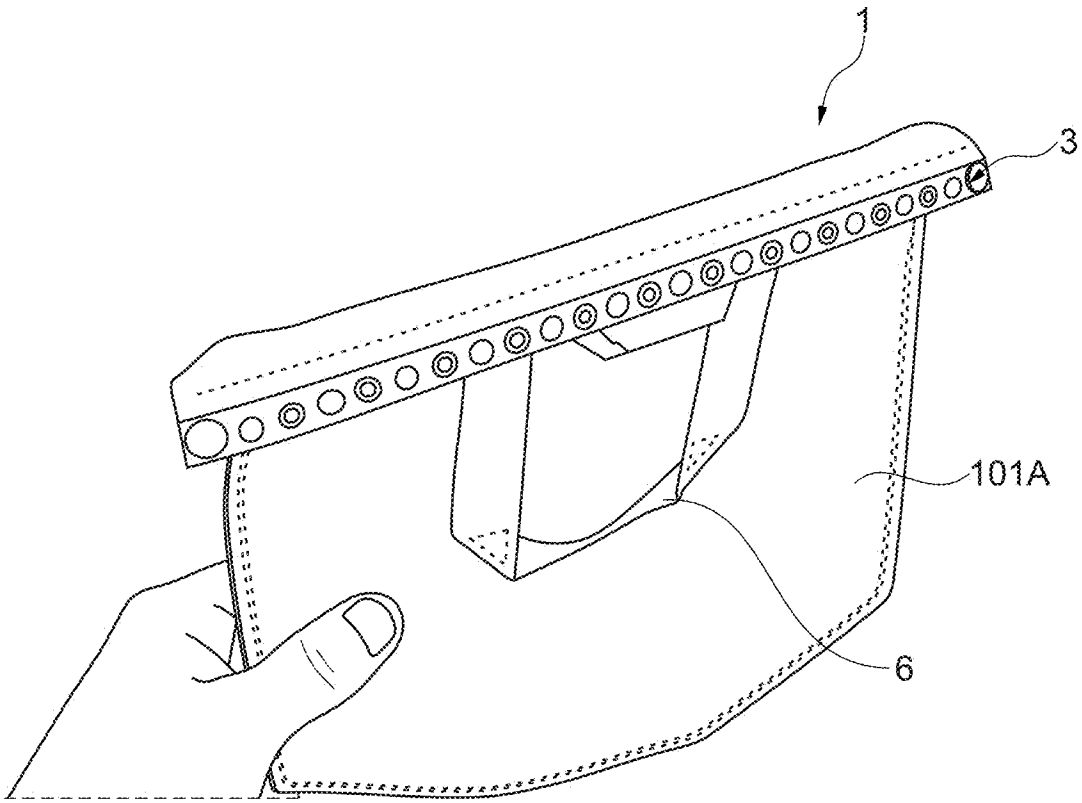
FIG. 67A-67B show a further storage device comprising a closure device in a closure position (FIG. 67A) and in a release position (FIG. 67B).
Figure 67B:
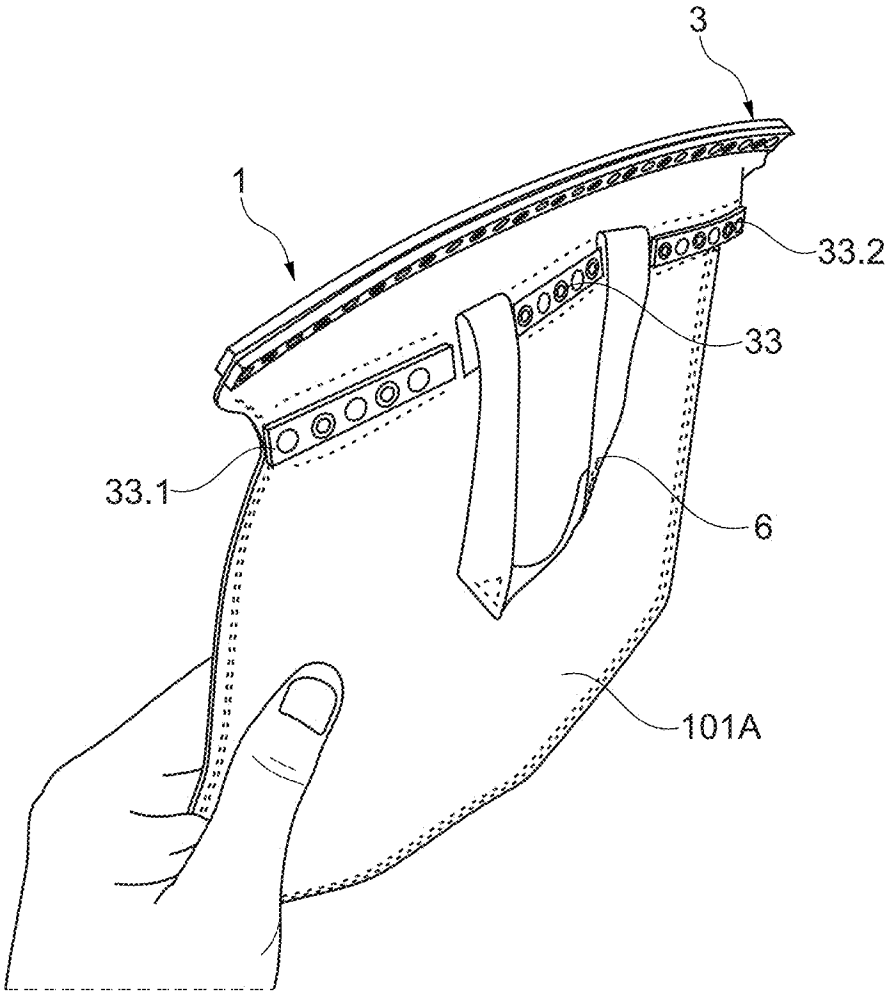
Figure 67C:
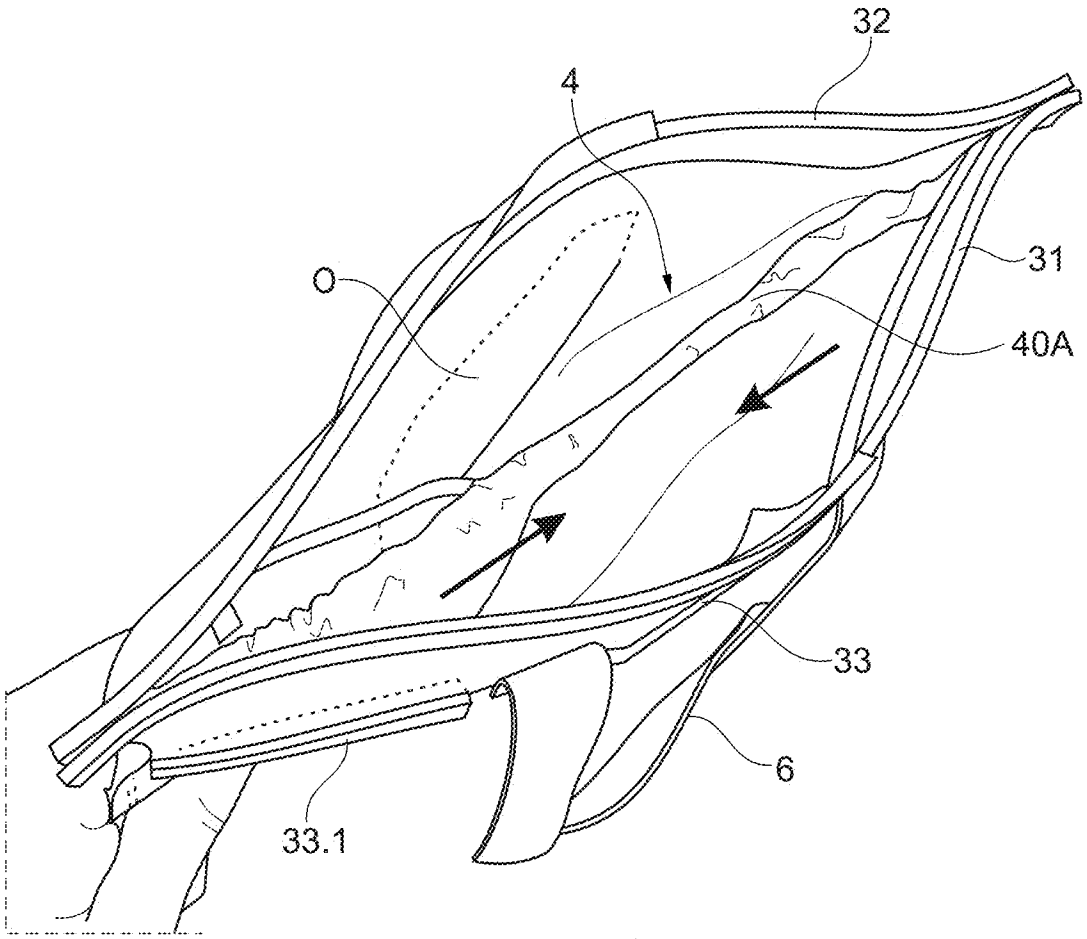
FIG. 67C shows the storage device of FIGS. 67A and 67B comprising first and second closure parts of the closure device in an open position and with a view into the interior of the storage device in which an intermediate wall comprising a flexible, optionally resilient, locking element is provided.
Figure 68B:
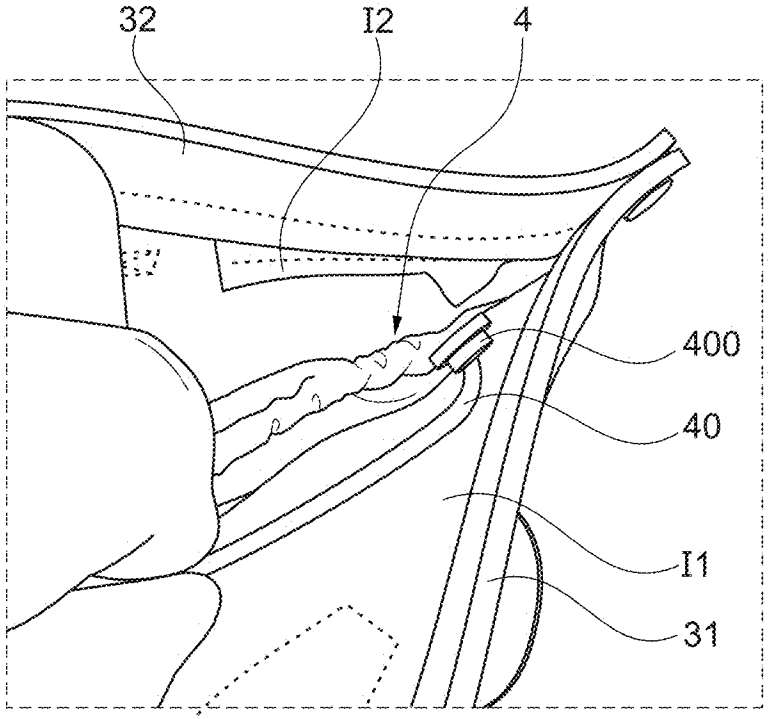
FIGS. 68A-68B are enlarged details of FIG. 67C, looking at a portion of the flexible locking element, configured here as a tensioning cable, which can be tensioned more strongly from an opening in the intermediate wall, by pulling.
Figure 68A:
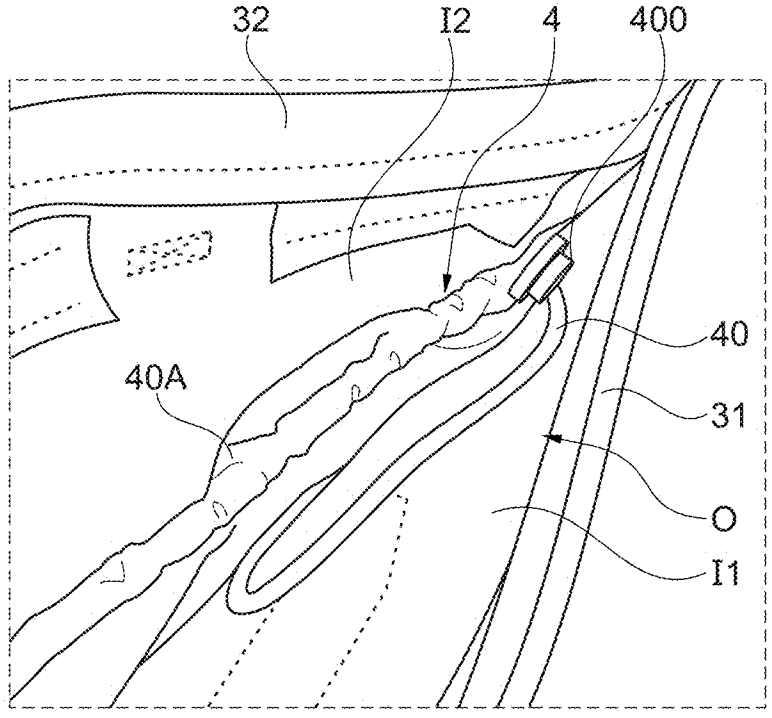
Figure 69C:
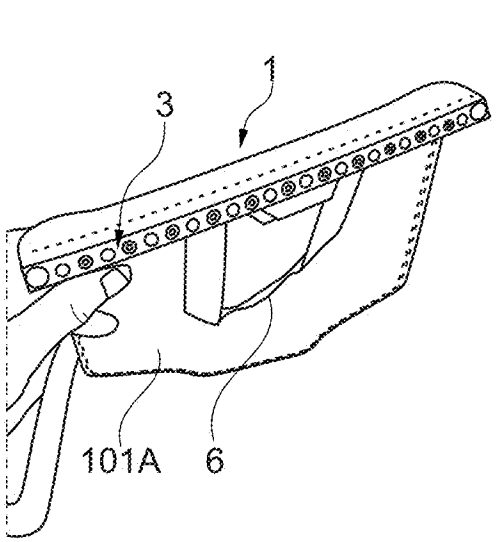
FIGS. 69A-69C show the storage device of FIGS. 67A to 68B in different phases during closing of the closure device and transfer into the closure position.
Figure 69B:
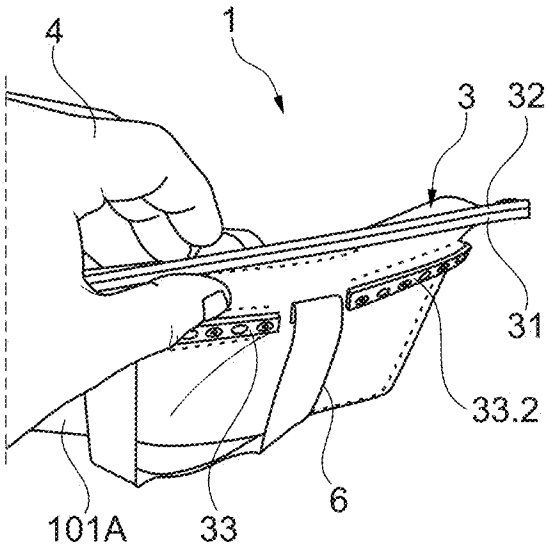
Figure 69A:
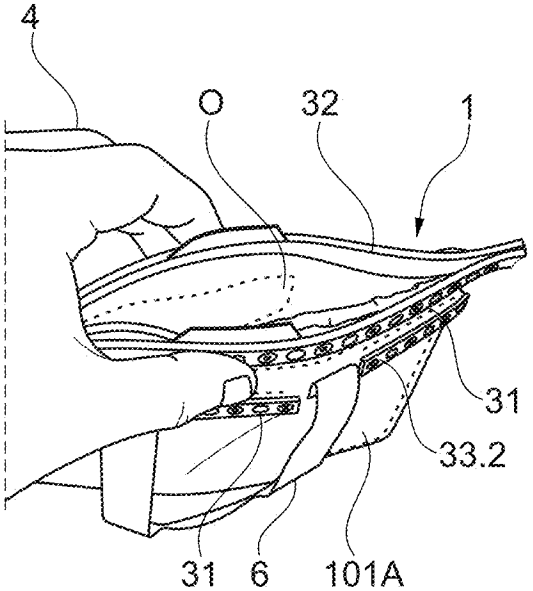

As is illustrated in particular on the basis of the partial perspective plan view of FIG. 67C and the enlarged details of FIGS. 68A and 68B, the storage device 1 of FIGS. 67A to 69C comprises a hold-open mechanism 4 having an inner flexible locking element in the form of a (resilient) tensioning cable 40. An intermediate wall 40A is provided in the interior of the storage device 1, by which intermediate wall the inner cavity of the storage device 2 is divided into two compartments I1 and I2, in the present case of approximately the same size. On an upper edge facing the opening O that can be closed by the closure device 2, and thus in the region of an upper edge of the intermediate wall 40A, the tensioning cable 4 is guided inside the intermediate wall 40A. Two mutually opposing (longitudinal) edges of the storage device 1 are connected to one another and preloaded towards one another via the tensioning cable 40, in the interior of the storage device 1. A corresponding tensioning force applied by the tensioning cable 40 then also acts on the first and second closure parts 31, 32, which are interconnected at their ends at said lateral longitudinal edges, such that the first and second closure parts 31, 32 are preloaded into their open position via the tensioned tensioning cable 40. Thus, under action of the tensioned tensioning cable 40 the central region of the first and second strip-shaped closure parts 31 and 32 are pushed outwards, when the magnetic forces, by which the first and second closure parts 31, 32 are held against one another in the closed position, are overcome manually.

In order to optionally re-tension the tensioning cable 40 and thus be able to readjust a tensioning force applied thereby, a cable portion, here in the form of a cable loop, is guided out of the intermediate wall 40A. When the storage device 1 is open, said cable portion is manually accessible for a user, in accordance with FIG. 68B. A user can then pull on the cable portion with one hand, in order to more strongly tension the tensioning cable 40. In this case, the cable portion that is pulled further out of the intermediate wall 40A by the pulling can be locked via a cable locking means 400, for example in the manner of a cord clamp, in order to maintain the readjusted cable tension. The storage device 1 is closed in accordance with FIGS. 69A to 69C, by approaching the first and second closure parts 31 and 32 towards one another, counter to the tensioning force applied by the tensioning cable 40.

Figure 70B:
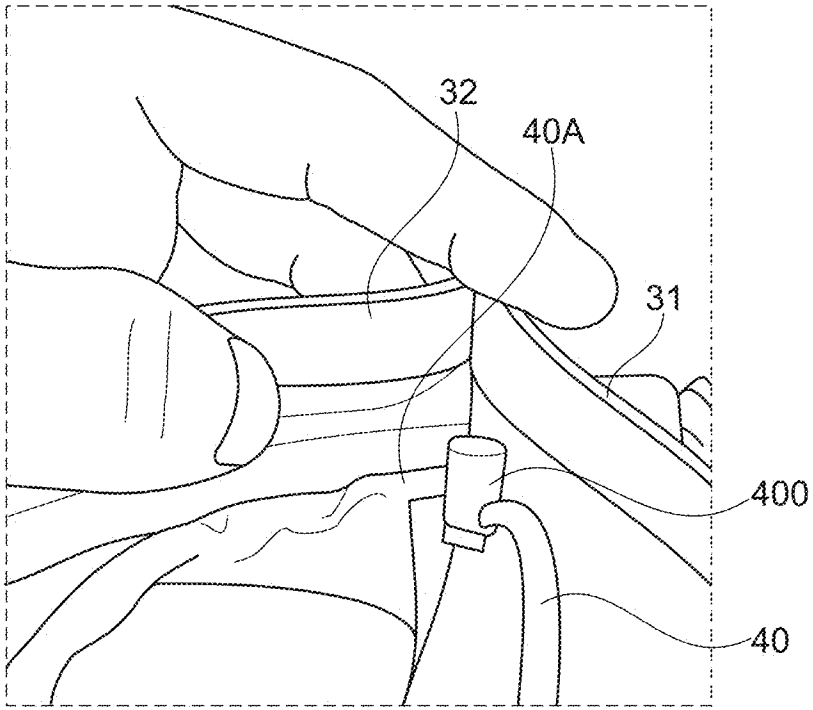
FIGS. 70A-70B show a further variant of a storage device comprising a tensioning cable, accommodated in an intermediate wall, having alternative cable locking means.
Figure 70A:
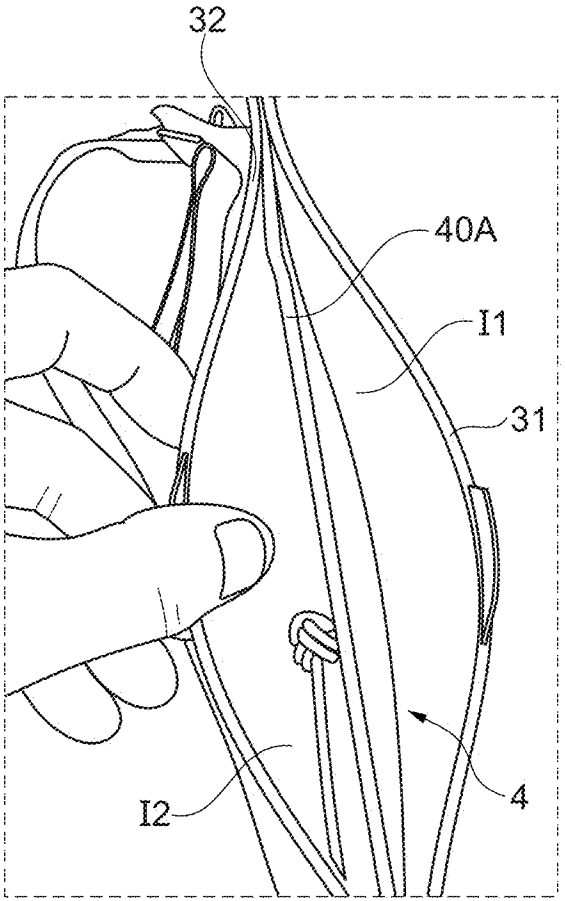

In the variant of a storage device 1 in accordance with FIGS. 70A and 70B, above all the volume of the storage device 1 is configured differently. This can therefore be, for example, a smaller pouch or a smaller bag. An inner tensioning cable 40 is also provided here as a part of the hold-open mechanism 4, which cable extends in an intermediate wall 40A and can be re-tensioned via a cable locking means 400.

Figure 71C:
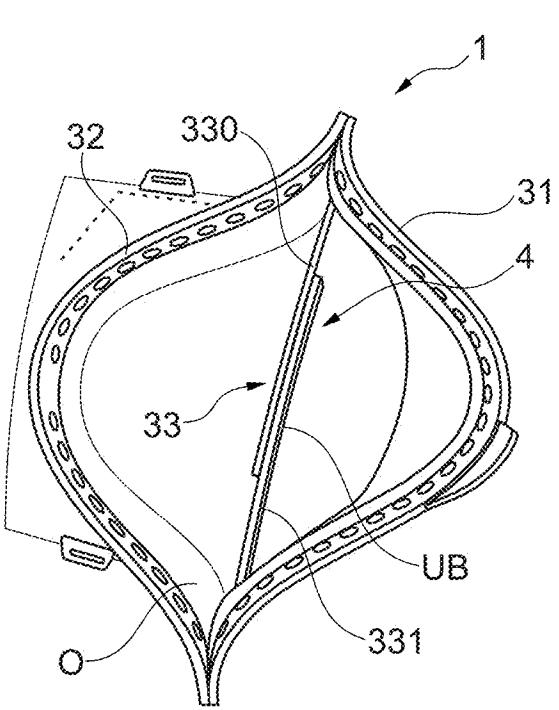
FIGS. 71A-71C show a further variant of a storage device having a closure device that is open to differing extends, i.e. central regions of first and second closure parts of the closure device that are at different spacings from one another, wherein the open position assumed in each case remains locked by a two-part third closure part in the interior of the storage device, the two portions of which closure part, configured as locking elements, remain fixed to one another in overlapping regions.
Figure 71B:
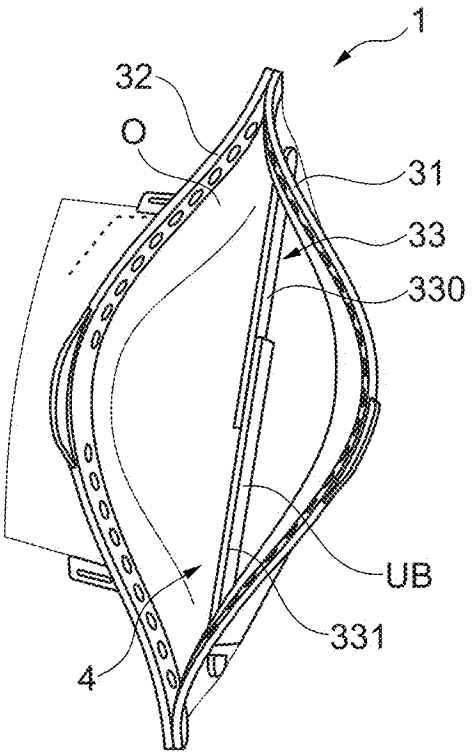
Figure 71A:
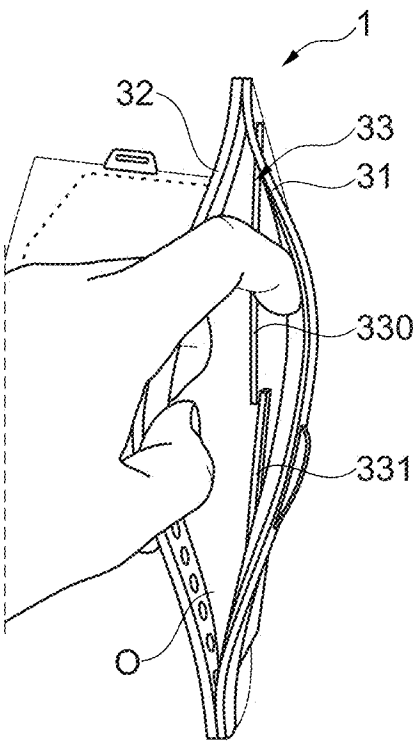

In a variant of a storage device 1 of FIGS. 71A to 71C, the third closure part 33, via which the closure combination 3 can be magnetically held in the closure position, is not provided on the front side 101A, but rather is arranged within the storage device 1. Furthermore, the third closure part 33 is configured in a divided manner in this case, such that it is formed by two elongate portions which, in the present case, can act as locking elements 330 and 331 of a hold-open mechanism 4 for the open position.

The two elongate locking elements 330 and 331 of the third closure part 33 directly adjoin one another in the closed position of the first and second closure parts 31, 32 (both in the closure position and in the release position). Thus, the closure combination 3 can be held in the closure position, as has already been explained above, by means of magnet elements arranged in the locking elements 330, 331 of the third closure part 33, and their magnetic interaction with the magnet elements of the first closure part 31.

When the closure device 2 of a storage device 1 of FIGS. 71A to 71C is opened, the two strip-shaped locking elements 330 and 331, which are in each case connected to a left-hand edge of the storage device, are how displaced relative to one another, however, such that they overlap one another, in accordance with FIG. 71B. In a resulting overlap region UB, in which portions of the locking elements 330 and 331 are opposite one another in an overlapping manner, the magnet elements of the first and second locking elements 330 and 332 act on one another in an attractive manner, such that an overlapping position of the locking elements 330 and 331 is retained. The locking elements 330 and 331 of the third closure part 33, which magnetically attract one another in the overlapping position, thus hold the longitudinal edges of the storage device 1 in a position in which they have been moved towards one another, and thus the first and second closure parts 31, 32, in the currently assumed open position.

If the closure device 2 is opened further, in that the first and second closure parts 31 and 32 are bulged further outwards, the two locking elements 330 and 331 of the first closure part 33 are thereby shifted relative to one another. The overlap region UB enlarges. This is then also retained in a further opened position, by means of the magnet elements in the overlapping portions of the locking elements 330, 331, which elements attract one another. Closing is possible only by overcoming the magnetic forces, in order to separate the locking elements 330, 331 from one another.

Figure 72B:
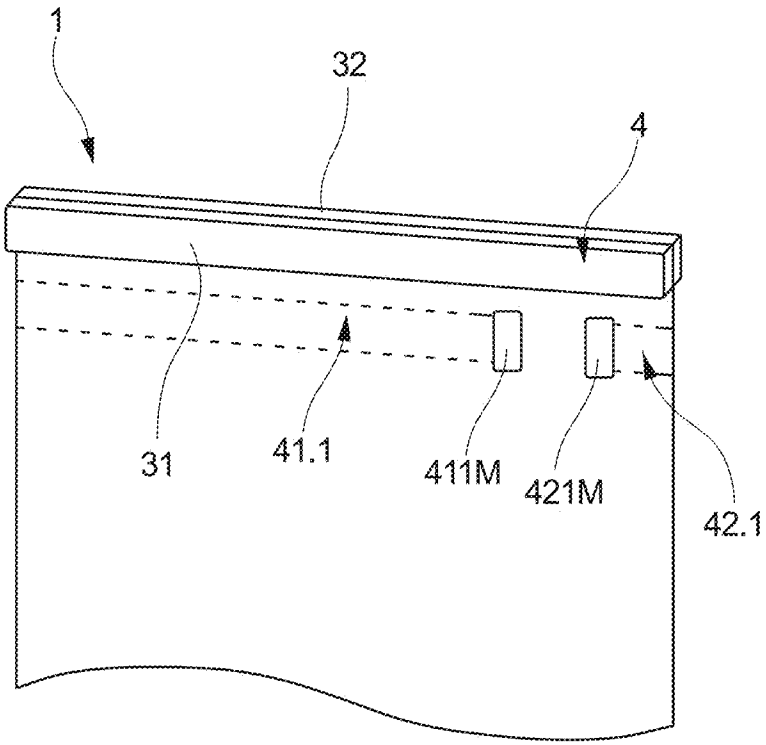
FIGS. 72A-72B show a further variant of a storage device in which an open position of first and second closure parts is maintained by two locking elements that are brought into contact with one another in the open position, in the interior of the storage device, such that it is possible for the first and second closure parts to assume a closed position only with separation of the first and second locking elements from one another.
Figure 72A:
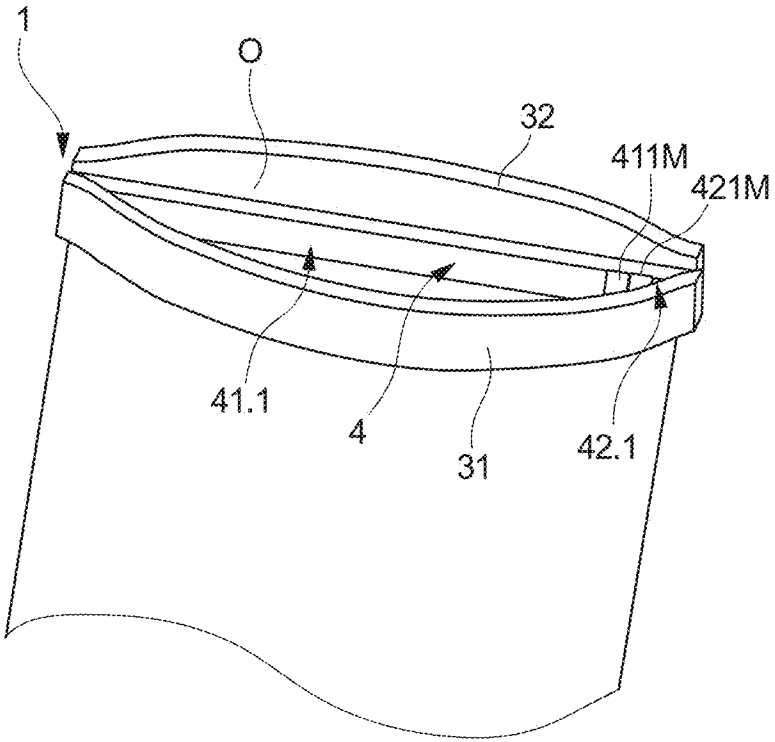

A hold-open mechanism 4 of FIGS. 72A and 72B is based on a comparable principle. In this case, a hold-open mechanism 4 is provided in the interior of a storage device 1, which hold-open mechanism comprises two locking elements 41.1 and 42.1 which are spaced apart from one another in the closed position of the first and second closure parts 31 and 32. In each case a magnet element 411M or 421M is provided on end pieces of the two inner locking elements 41.1 and 42.1 that face one another. If the two end pieces of the two locking elements 41.1 and 42.1, which end pieces carry the respective magnet elements 411M and 421M, are moved closer to one another upon opening the closure device 2, a connection between the two locking elements 41.1 and 42.1 is established by the magnetic attraction of the two magnet elements 411M and 421M. The interconnected locking elements 41.1 and 42.1 then exert a holding force on the longitudinal edges of the storage device 1, and thus on the first and second closure parts 31, 32 in their open position. A transfer of the first and second closure parts 31, 32 into their closed position is possible only by overcoming the holding force, such that the two locking elements 41.1 and 42.1, which are magnetically fixed to one another, are separated from one another again.

Figure 73B:
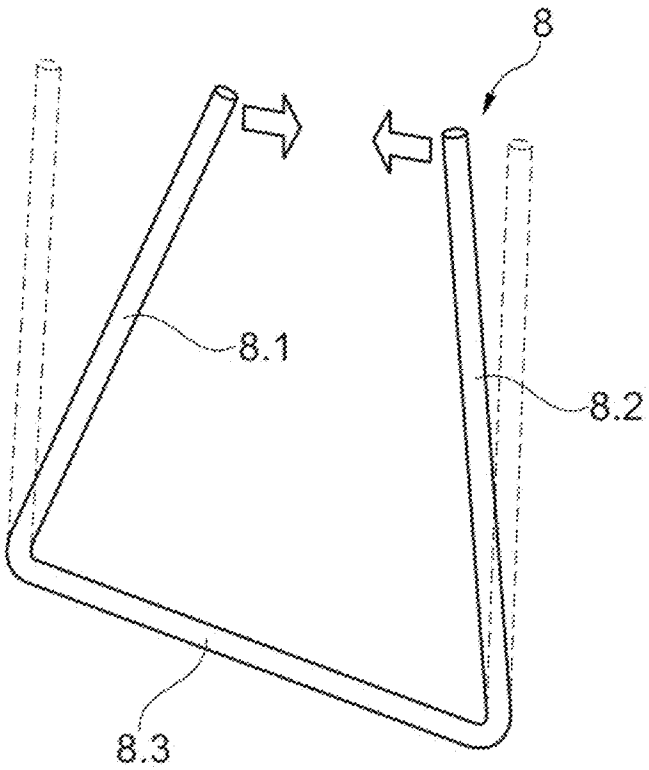
FIG. 73B is a detailed view of the U-shaped spring element in an unloaded state and (shown in dashed lines) in a loaded state when inserted into the storage device.
Figure 73A:
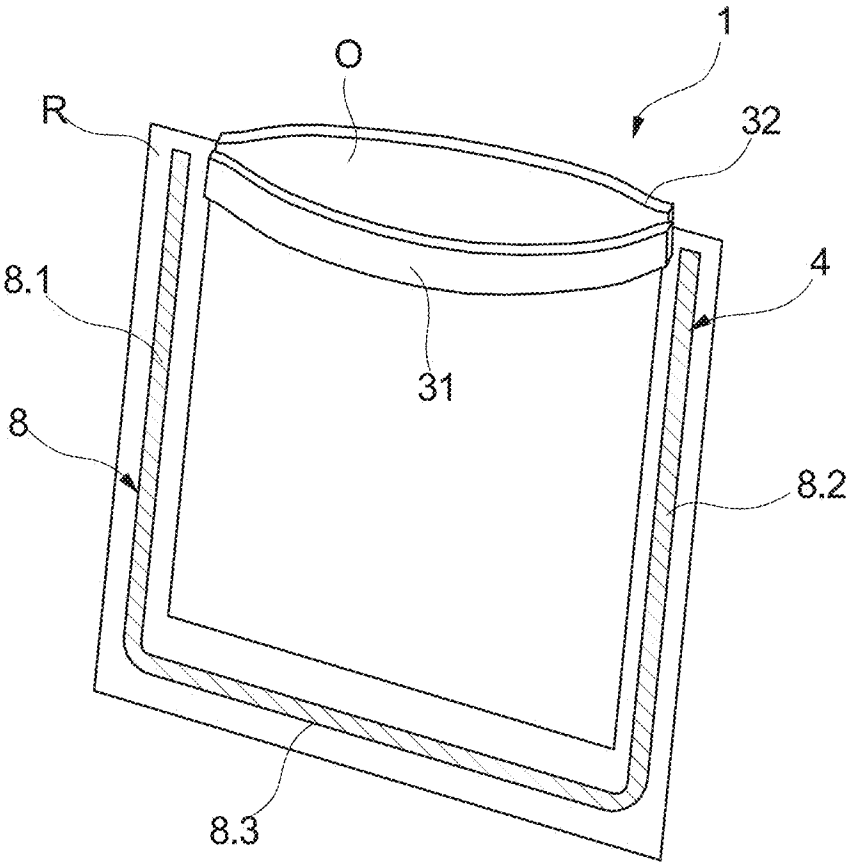
FIG. 73A shows a further variant of a storage device, in which an open position of first and second closure parts of a closure device of the storage device is achieved by a U-shaped spring element, in which two opposing limbs are preloaded towards one another, such that a transfer of the first and second closure parts out of the open position shown in FIG. 73A and into a closed position is possible only by overcoming the preload force of the first and second limbs.

In the variant of a storage device of FIGS. 73A and 73B, a hold-open mechanism 4 comprising a U-shaped tensioning element, here in the form of a spring element 8, is provided. Said U-shaped spring element 8 extends with a base 8.3 along a lower edge of the storage device 1. Two mutually opposing limbs 8.1 and 8.2 are interconnected via the base 8.3 and extend along the longitudinal side edges of the storage device 1, here within a peripheral edge portion R of the storage device 1. The two limbs 8.1 and 8.2 are preloaded towards one another (cf. also FIG. 73B). In this case, the limbs 8.1, 8.2 end in the region of the upper edge of the storage device 1 that bounds the opening O, such that the preload force of the two limbs 8.1, 8.2 is also transferred to the two closure parts 31 and 32, here in each case again strip-shaped. In this way, the first and second closure parts 31 and 32 strive to bulge outwards in their open position, under action of the preload of the limbs 8.1 and 8.2. In this case, moving the first and second closure parts 31 and 32 closer together in order to assume their closed position is possible only counter to the preload force applied by the limbs 8.1, 8.2, and thus a corresponding holding force. Consequently, after the closure device 2 has been opened, the open position is maintained under action of the two limbs 8.1 and 8.2.

Figure 74B:
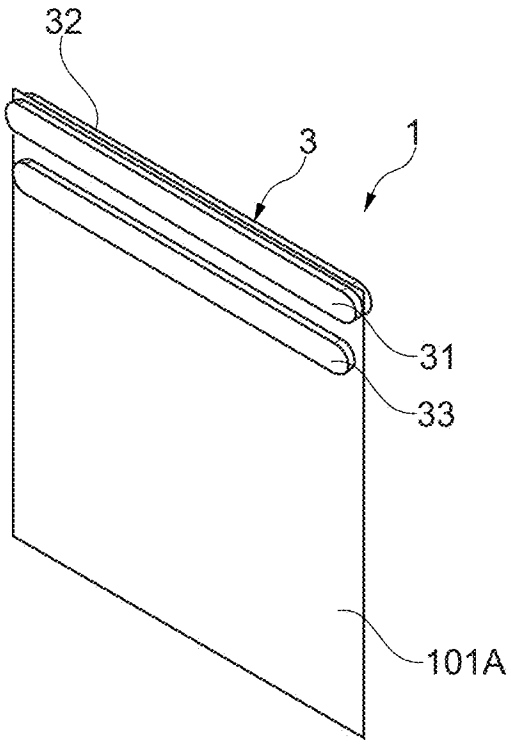
FIGS. 74A, 74B show further variants of a proposed storage device, in which in each case an elongate spring strip is provided on first and second closure parts, optionally as an integral component, which spring strip is preloaded to an outward bulge and thus retains the first and second closure parts in the open position, said drawings showing the first and second closure parts in the open position (FIG. 74A) and in the closed position (FIG. 74B).
Figure 74A:
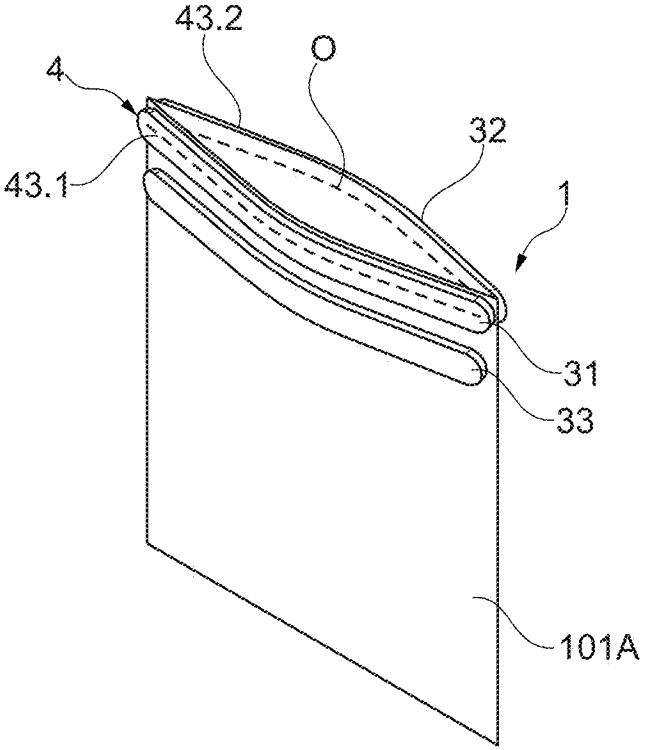

The same also applies for a variant according to FIGS. 74A and 74B. In this case, a hold-open mechanism 4 comprising two spring (steel) strips 43.1 and 43.2 is provided. The spring strips 43.1 and 43.2 extend, in the present case, along a respective associated closure part 31 or 32, or are an integral component of the respective closure part 31 or 32. In this case, a first spring strip 43.1 is associated with the first closure part 31, while a second spring strip 43.2 is associated with the second closure part 32. Each spring strip 43.1 or 43.2 is preloaded into a bulge direction, and specifically, in the present case, in such a way that the strip-shaped closure parts 31 and 32 are preloaded to an outward bulge in their central region, under action of the spring strips 43.1 and 43.2. Consequently, in order to close the closure device 2 such that the first and second closure parts 31 and 32 assume their closed position, a user must push the central regions of the first and second closure parts 31 and 32 towards one another, counter to the spring forces of the two spring strips 43.1 and 43.2.

A similar principle is provided in the storage device FIGS. of 75A to 75B. In this case, two spring strips 43.1 and 43.2 are provided as part of two hold-open mechanisms 4A, 4B.

Figure 75B:
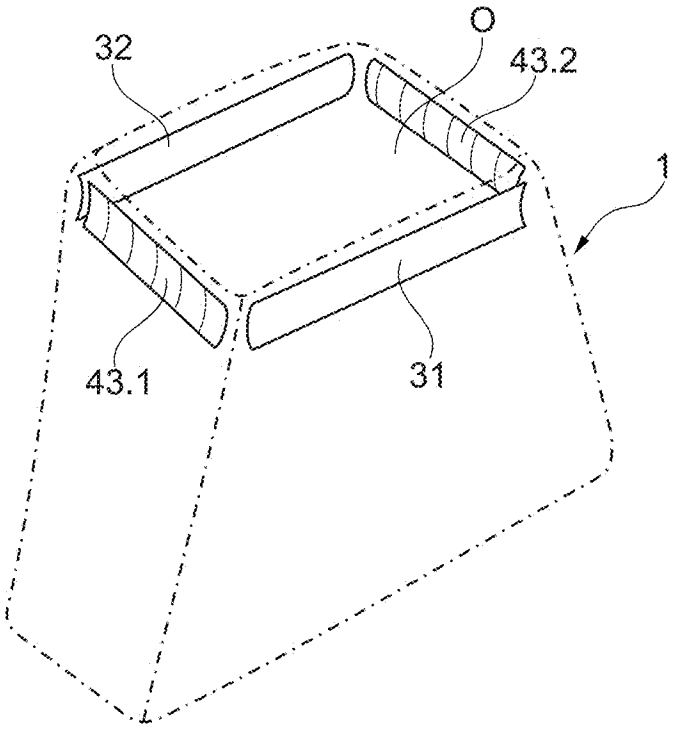
FIGS. 75A and 75B show a further variant of a storage device, in which an open position is maintained using two spring strips which, in the present case, are arranged in each case between two opposing ends of first and second closure parts on an opening edge of the storage device.
Figure 75A:
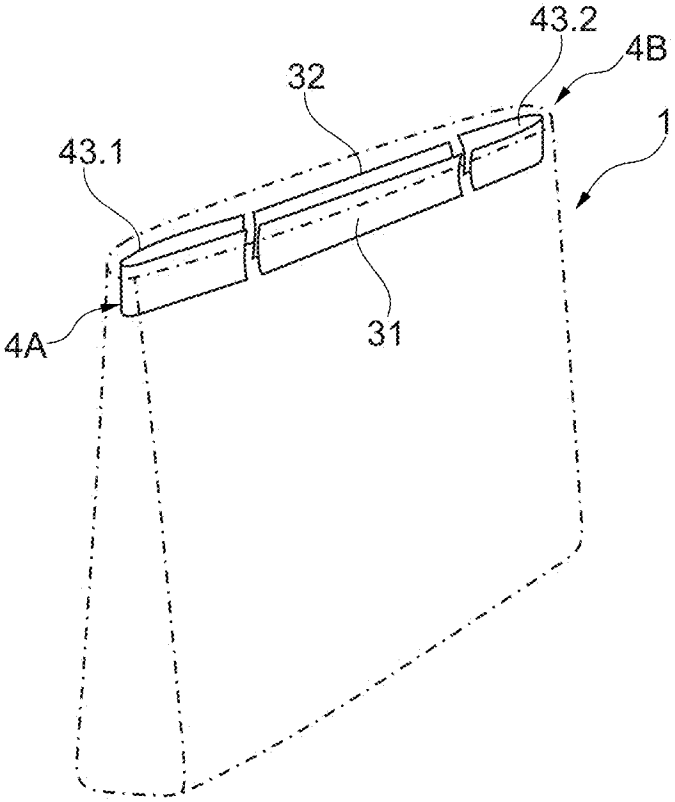

A first spring strip 43.1 extends between two, in FIG. 75A left-hand, longitudinal ends of the first and second closure parts 31 and 32. The other spring strip 43.2 in turn extends between two other, right-hand, longitudinal ends of the first and second closure parts 31 and 32.

The first and second spring strips 43.1 and 43.2 in each case strive to align themselves straight and thus in a manner preloaded into a state in which a respective spring strip 43.1 or 43.2 extends in a straight line. In the closed position of the first and second closure parts 31, 32, the two spring strips 43.1 and 43.2 are each bent once (centrally) and held in this state, bent once, via the magnetic forces of the first and second closure parts 31 and 32 that magnetically attract one another. If said magnetic force is overcome manually, the spring strips 43.1 and 43.2 fold out automatically on account of their respective preload, and thus displace the first and second closure parts 31, 32 into their open position and hold the first and second closure parts 31, 32 in a manner spaced apart from one another, in the open position (cf. FIG. 75B).

Figure 76C:
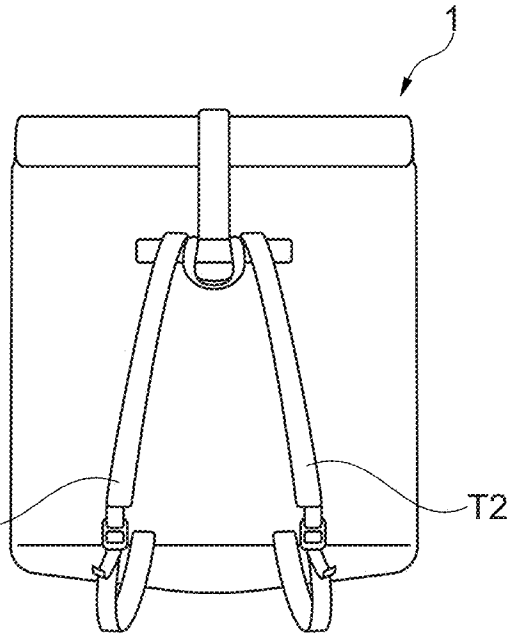
FIGS. 76A-76C are various views of a storage device configured as a rucksack, having a closure device provided thereon, the closure combination of which closure device is held in a closure position by means of a separate closure.
Figure 76B:
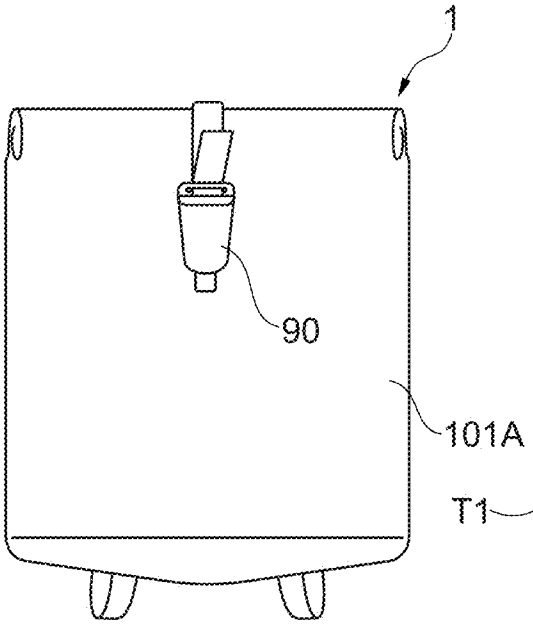
Figure 76A:
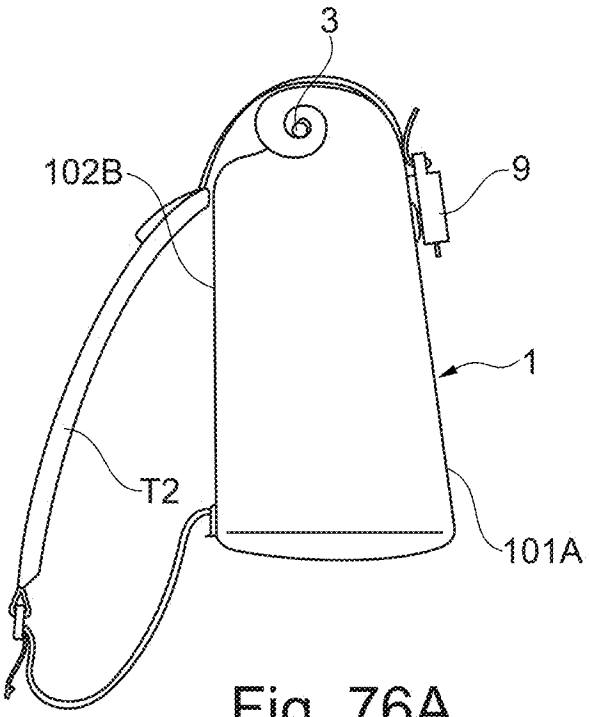
Figure 77C:
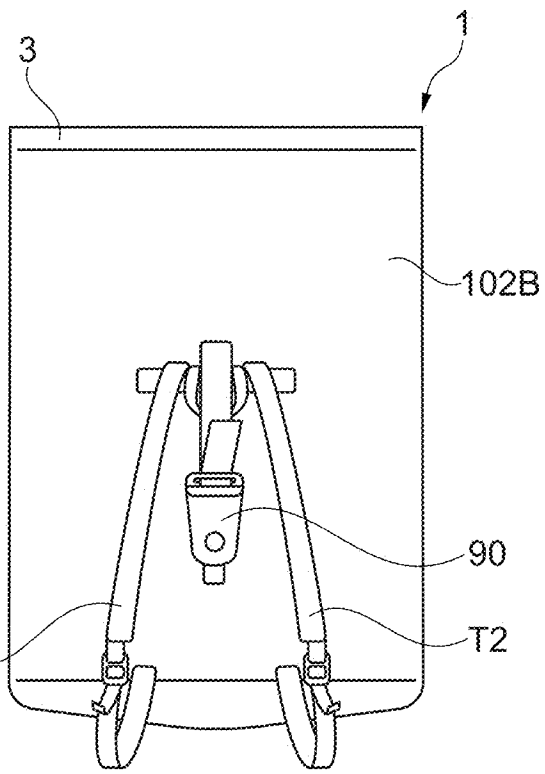
FIGS. 77A-77C are views, corresponding to FIGS. 76A to 76C, of the storage device having the closure combination in the release position, but still having first and second closure parts provided in the closed position.
Figure 77B:
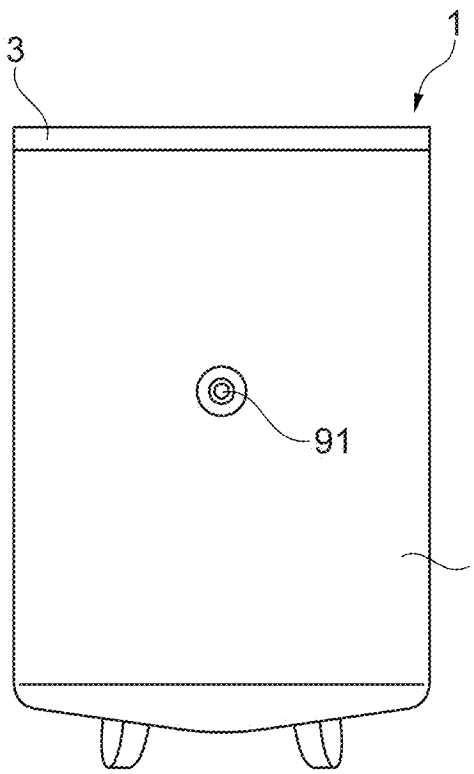
Figure 77A:
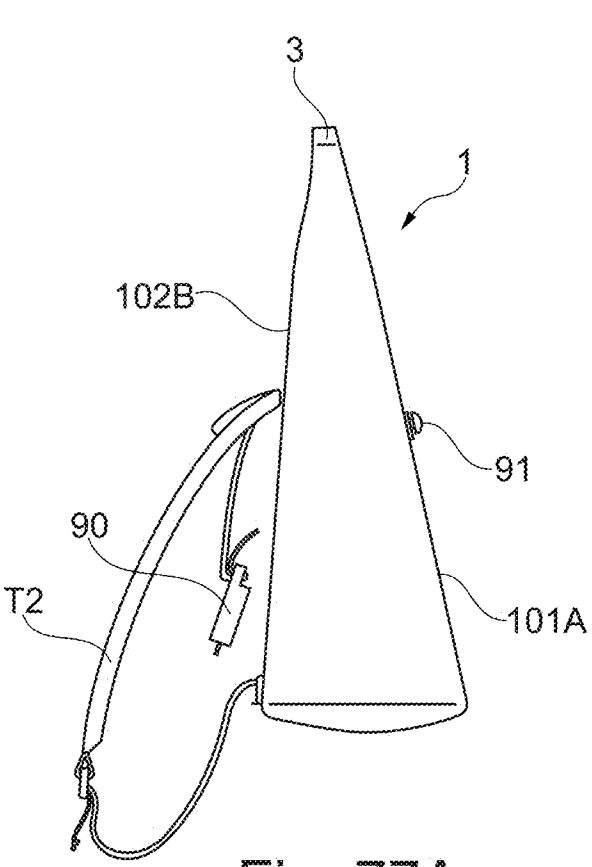
Figure 78B:
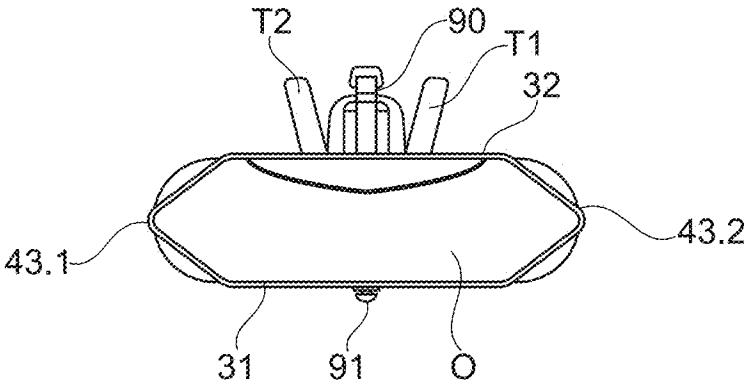
FIG. 78B shows the storage device of FIG. 78A in plan view, and thus looking into the interior of the storage device, through the opening on the upper side of the storage device which is held open by the closure device.
Figure 78A:
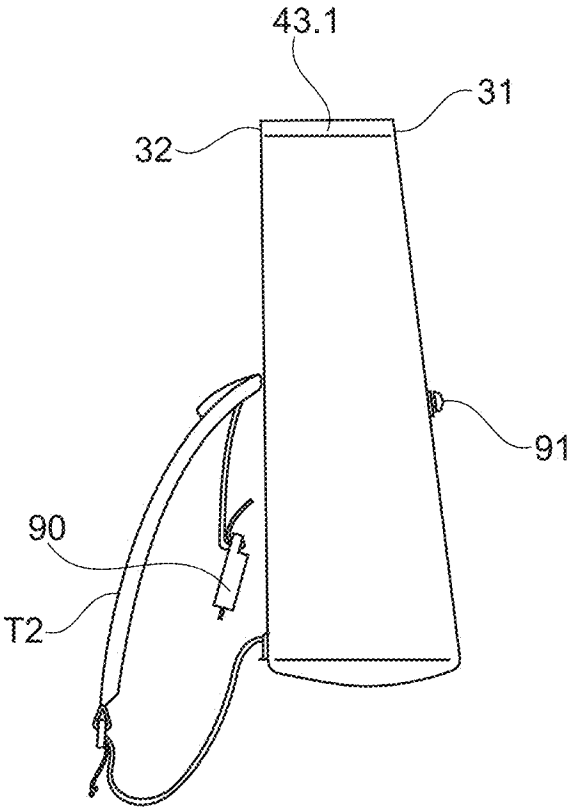
FIG. 78A shows, in a view corresponding to FIGS. 76A and 77A, the storage device having the first and second closure parts in an open position.

Hold-open mechanisms 4A, 4B corresponding to FIGS. 75A and 75B can be used for example in a storage device of FIGS. 76A and 78B. Said storage device 1 is configured as a rucksack which can be carried on a back by means of two carrying straps T1 and T2.

In a closed state, two mutually opposing walls of the rucksack 1 of FIGS. 76A to 78B are folded or rolled in. This rolled-together closure position is secured via a closure 9, in accordance with FIGS. 76A to 76C. For this purpose, a securing component 90 interacts with a mating part 91 of the closure 9, on the front side 101A of the rucksack 1. If an optionally magnetically assisted latching between the securing part 90 and the mating part 91 is released, in accordance with FIGS. 77A to 77C the rucksack 1 can be unrolled on its upper side, and as a result the closure device 2 with the closure combination 3 can be transferred into the release position. In the release position, the two first and second closure parts 31 and 32, which are held magnetically in the closed position, can be transferred manually into the open position.

In the open position, the closure parts 31 and 32 are held via hold-open mechanisms comprising spring strips 43.1, 43.2. Only after overcoming a holding force applied by the spring strips 43.1 and 43.2 can the two first and second closure parts 31 and 32 consequently be moved towards one another again, and thus be transferred into their closed position.

The concept on which the proposed solution is based is not limited to the embodiments set out above, but rather can also be implemented in an entirely different manner.

LIST OF REFERENCE SIGNS

1 Storage device
10 Hollow body
101, 102 Wall
101A Front side
102B Rear side
101R, 102R Lateral edge
101S, 102S Closing portion
2 Closure device
3 Closure combination
31,32, 33 First/Second closure part
33, 33.1, 33.2 Third closure part
310, 320 Handle element (actuation portion)
31M, 32M, 33M Magnet element
330, 331 Closure part portion (locking element)
4, 4A, 4B Hold-open mechanism
40 Tensioning cable (locking element)
40A Intermediate wall
400 Cable locking means
41.1, 41.2 First locking element
411M, 412M Magnet element
421M, 422M
413 Guide web
414 Latching groove (latching opening)
41M, 42M Magnet element
42.1, 42.2 Second locking element
423 Guide channel
424 Latching lug (latching element)
425 Carrier arm
426 Base
43.1, 43.2 Spring strip
51,52 Actuation loop (unlocking element)
6 Actuation tab (actuation element)
7 Waist belt
8 Spring element
8.1, 8.2 Limb
8.3 Base
9 Closure
90 Securing part
91 Mating part
F1, F2 Finger
H Hand
I1, I2 Compartment
K Notch (weakening region)
O Opening
R Edge portion
S Closing axis
s Adjustment path
T1, T2 Carrying belt
UB Overlap region
x, y, z Spatial direction

The invention claimed is:

1. A closure device for closing an opening, wherein the closure device comprises at least one first closure part and at least one second closure part, wherein the first closure part and the second closure part interact, in a magnetically attracting manner, in such a way that the opening is closed in a closed position of the closure device, for releasing the opening the first closure part and the second closure part are displaceable into an open position, counter to a magnetic force applied by the first and second closure parts, and the closure device comprises at least one hold open mechanism, via which the first and second closure parts are locked in the open position, and which counteracts a displacement of the first and second closure parts into the closed position, by means of a holding force, wherein the hold-open mechanism comprises at least one first locking element and at least one second locking element, and the first and second locking elements interact with one another in the open position in order to lock the first and second closure parts in the open position.

2. The closure device according to claim 1, wherein at least one of the holding force is applied via at least a form-fit, a force-fit, and/or a magnetic force, and the holding force is specified, via the hold-open mechanism, such that it can be overcome manually.

3. The closure device according to claim 1, wherein the hold-open mechanism applies an opening force which at least assists with the first and second closure parts assuming an open position and/or with the locking of the first and second closure parts in the open position, and which force is higher in the open position of the first and second closure parts than in the closed position, and is lower in the closed position of the first and second closure parts than in the open position, while a closing force, applied by the first and second closure parts, which force assists with a displacement of the first and second closure parts in the direction of the closed position, is higher in the closed position and lower in the open position.

4. The closure device according to claim 1, wherein at least one of for locking the first and second closure parts in the open position, the first and second locking elements are adjustable relative to one another from a rest position, bridging a predefined adjustment path, into a locking position, and the first and second locking elements interact with one another in a magnetically attracting manner, in order to lock the first and second closure parts in the open position.

5. The closure device according to claim 1, wherein the first locking element comprises at least one first magnet element and the second locking element comprises at least one second magnet element for locking the first and second closure parts in the open position, and a further magnet element is provided on at least one of the first and second locking elements, which further magnet element is polarized opposingly to a magnet element of the other locking element, such that magnet elements of the first and second locking elements repel one another in the rest position, and thus counteract a displacement of the first and second locking elements in the direction of the locking position, until a minimum adjustment path of the first and second locking elements relative to one another has been bridged.

6. The closure device according to claim 1, wherein the first and second locking elements are interconnected in a form-fitting manner, in the open position of the first and second closure parts, in order to lock the first and second closure parts in the open position.

7. The closure device according to claim 1, wherein the first closure part and the second closure part are provided for arrangement on first and second closing portions, wherein the at least one first locking element protrudes beyond an edge of the first closing portion, and the at least one second locking element protrudes beyond an edge of the second closing portion, such that the first and second locking elements are opposite one another.

8. The closure device according to claim 7, wherein in the open position of the first and second closure parts the first and second locking elements are in a locking position, in order to lock the first and second closure parts in the open position, and the first and second locking elements in each case comprise an operating portion which is coupled to an associated closure part and is provided for manual force application, and said elements are configured to adjust the closure parts out of the closed position and into the open position by displacement of the first and second locking elements out of a rest position in the direction of the locking position as a result of an actuation force applied manually to the operating portions.

9. The closure device according to claim 1, wherein the first and second locking elements are provided for arrangement in a cavity accessible via the opening, wherein a first end piece of the first locking element and a second end piece of the second locking element are spaced apart from one another in the closed position and interact with one another in the open position in order to apply the holding force.

10. The closure device according to any claim 1, wherein the first and second closure parts in each case extend along a transverse axis, and the first and second locking elements in each case protrude, by at least one portion, along the transverse axis, beyond ends of the closure parts.

11. The closure device according to claim 1, wherein the first closure part extends along a transverse axis and comprises at least two portions which are interconnected via a weakening region, via which the at least two portions can be displaced relative to one another, and/or the second closure part extends along a transverse axis and comprises at least two portions which are interconnected via a weakening region, via which the at least two portions can be displaced relative to one another.

12. The closure device according to claim 1, wherein the first and/or second closure part comprises one or more discrete magnet elements or consists of a magnetic material or a material acting as a magnetic armature.

13. The closure device according to claim 1, wherein the first and second closure parts form a closure combination in the closed position, which combination is adjustable from a release position, in which the first and second closure parts can be moved away from one another for releasing the opening, into a closure position, in which the closure combination and a third closure part interact with one another in such a way that the closure combination is held in the closure position, wherein the third closure part is provided for arrangement in a cavity accessible via the opening and is formed by two locking elements of the hold-open mechanism, which elements, in the event of an adjustment of the first and second closure parts from the closed position into the open position, overlap one another in an overlap region and interact in a magnetically attracting manner and/or latch together in a form-fitting and/or force-fitting manner in the overlap region, in order to apply the holding force.

14. The closure device according to claim 1, wherein the closure device is provided for closing an opening via which a hollow body is accessible, and/or in that the closure device is provided for arrangement on a storage device.

15. A storage device, comprising a hollow body for receiving at least one object and/or a liquid, wherein the at least one object and/or the liquid can be introduced into the hollow body via an opening which can be closed by a closure device according to claim 1.

16. The closure device according to claim 1, wherein the first and second locking elements are coupled to the first and second closure parts, such that the first and second locking elements (are transferred into a locking position when the first and second closure parts are displaced out of the closed position and into the open position, in which locking position the first and second locking elements interact with one another in order to lock the first and second closure parts in the open position.

17. The closure device according to claim 16, wherein the first and second locking elements interact with one another in a magnetically attracting manner, in order to lock the first and second closure parts in the open position, wherein the first locking element comprises at least one first magnet element and the second locking element comprises at least one second magnet element, and the first and second magnet elements are displaced towards one another or beyond one another at least in part, with displacement of the first and second locking elements into the locking position.

18. A closure device for closing an opening, wherein the closure device comprises at least one first closure part and at least one second closure part, wherein the first closure part and the second closure part interact, in a magnetically attracting manner, in such a way that the opening is closed in a closed position of the closure device, for releasing the opening the first closure part and the second closure part are displaceable into an open position, counter to a magnetic force applied by the first and second closure parts, and the closure device comprises at least one hold-open mechanism, via which the first and second closure parts are locked in the open position, and which counteracts a displacement of the first and second closure parts into the closed position, by means of a holding force, wherein at least one of the first and second closure parts in each case extend along a transverse axis, and the at least one hold-open mechanism comprises a flexible, in particular resilient, locking element for arrangement in a cavity that is accessible via the opening, wherein the flexible locking element is provided to apply a tensioning force to ends of the closure parts provided laterally along the transverse axis, in the open position, the closure device comprises a U-shaped tensioning element having a base and two limbs that are interconnected via the base, wherein the two limbs are preloaded towards one another and the tensioning element is provided for applying the holding force over the two limbs that are preloaded towards one another, in the open position, and for applying the holding force the closure device comprises at least one spring strip which is preloaded against an adjustment of the first and second closure parts out of the open position and into the closed position.

19. A closure device for closing an opening, wherein the closure device comprises at least one first closure part and at least one second closure part, wherein the first closure part and the second closure part interact, in a magnetically attracting manner, in such a way that the opening is closed in a closed position of the closure device, for releasing the opening the first closure part and the second closure part are displaceable into an open position, counter to a magnetic force applied by the first and second closure parts, and the closure device comprises at least one bold-open mechanism, via which the first and second closure parts are locked in the open position, and which counteracts a displacement of the first and second closure parts into the closed position, by means of a holding force, wherein the first and second closure parts form a closure combination in the closed position, which combination is adjustable from a release position, in which the first and second closure parts can be moved away from one another for releasing the opening, into a closure position, in which the closure combination and a third closure part interact with one another in such a way that the closure combination is held in the closure position.

* * * * *